US008181698B2

(12) United States Patent
Springett et al.

(10) Patent No.: US 8,181,698 B2
(45) Date of Patent: May 22, 2012

(54) MULTI-FUNCTION MULTI-HOLE DRILLING RIG

(75) Inventors: Frank Benjamin Springett, Spring, TX (US); Dean A. Bennett, Houston, TX (US); David Gilbert Reid, Spring, TX (US)

(73) Assignee: National Oilwell Varco L.P., Houston, TX (US)

( * ) Notice: Subject to any disclaimer, the term of this patent is extended or adjusted under 35 U.S.C. 154(b) by 84 days.

(21) Appl. No.: 12/634,930

(22) Filed: Dec. 10, 2009

(65) Prior Publication Data

US 2010/0147524 A1 Jun. 17, 2010

Related U.S. Application Data

(63) Continuation-in-part of application No. 12/316,801, filed on Dec. 15, 2008.

(60) Provisional application No. 61/189,146, filed on Aug. 15, 2008.

(51) Int. Cl.
*E21B 43/12* (2006.01)

(52) U.S. Cl. ..... 166/52; 166/313

(58) Field of Classification Search ..... 166/52, 166/76.1, 102, 313; 175/57, 161, 220
See application file for complete search history.

(56) References Cited

U.S. PATENT DOCUMENTS

| | | | | |
|---|---|---|---|---|
| 2,840,198 | A | 6/1958 | Woolslayer et al. | |
| 3,486,737 | A | 12/1969 | Campbell | 254/106 |
| 4,040,524 | A * | 8/1977 | Lamb et al. | 414/22.52 |
| 4,108,255 | A | 8/1978 | Smith | 175/9 |
| 4,208,158 | A | 6/1980 | Davies et al. | 414/22 |
| 4,616,454 | A | 10/1986 | Ballachey et al. | 52/115 |
| 4,744,710 | A | 5/1988 | Reed | 414/22 |
| 4,819,730 | A * | 4/1989 | Williford et al. | 166/355 |
| 4,899,832 | A | 2/1990 | Bierscheid, Jr. | 173/23 |
| 5,107,940 | A | 4/1992 | Berry | 175/85 |
| 5,492,436 | A | 2/1996 | Suksumake | 405/201 |
| 5,570,749 | A * | 11/1996 | Reed | 175/66 |
| 6,047,781 | A | 4/2000 | Scott et al. | 175/5 |
| 6,056,071 | A | 5/2000 | Scott et al. | 175/5 |
| 6,068,069 | A | 5/2000 | Scott et al. | 175/5 |
| 6,085,851 | A | 7/2000 | Scott et al. | 175/7 |
| 6,158,516 | A | 12/2000 | Smith et al. | 166/385 |
| 6,161,358 | A | 12/2000 | Mochizuki et al. | 52/651.05 |
| 6,343,892 | B1 | 2/2002 | Kristiansen | 405/195.1 |

(Continued)

FOREIGN PATENT DOCUMENTS

WO WO 2004/035985 4/2004

(Continued)

OTHER PUBLICATIONS

PCT/US2009/053849 International Search Report (Dec. 2, 2009).

(Continued)

*Primary Examiner* — William P Neuder
*Assistant Examiner* — Richard Alker
(74) *Attorney, Agent, or Firm* — Williams, Morgan & Amerson, P.C.

(57) ABSTRACT

A multi-function multi-hole rig including multiple machines for accomplishing various rig functions, e.g., drilling machine(s), tripping machine(s), casing machine(s), cementing machine(s), workover machine(s), etc., for drilling, completing and/or working over multiple wellbores without moving the rig. Rig functions may be performed one after the other and/or simultaneously, while allowing other functions related to completion and production to continue simultaneously.

60 Claims, 50 Drawing Sheets

U.S. PATENT DOCUMENTS

| | | | | |
|---|---|---|---|---|
| 6,443,240 | B1 | 9/2002 | Scott | 175/7 |
| 6,766,860 | B2 | 7/2004 | Archibald et al. | 166/341 |
| 6,932,553 | B1 | 8/2005 | Roodenberg et al. | 414/22.51 |
| 6,968,905 | B2 | 11/2005 | Adnan et al. | 166/384 |
| 6,973,979 | B2 | 12/2005 | Carriere et al. | 175/203 |
| 7,320,374 | B2 | 1/2008 | Folk et al. | 175/220 |
| 7,377,335 | B2 | 5/2008 | Jones et al. | 175/57 |
| 7,401,656 | B2 | 7/2008 | Wood et al. | 166/384 |
| 2002/0074125 | A1 | 6/2002 | Fikes et al. | 166/352 |
| 2003/0098150 | A1 | 5/2003 | Andreychuk | 166/77.2 |
| 2004/0200641 | A1 | 10/2004 | Jones et al. | 175/57 |
| 2007/0251725 | A1 | 11/2007 | Banks | 175/5 |
| 2008/0023228 | A1 | 1/2008 | Stevens | 175/57 |
| 2009/0025937 | A1 | 1/2009 | Robinson et al. | 166/351 |

FOREIGN PATENT DOCUMENTS

| | | | |
|---|---|---|---|
| WO | WO2008/103156 | A2 | 8/2008 |
| WO | WO 2008/118914 | | 10/2008 |
| WO | WO2010/019858 | A1 | 2/2010 |

OTHER PUBLICATIONS

Office Action from U.S. Appl. No. 12/316,801 dated Feb. 24, 2011.

PCT Search Report and Written Opinion from PCT/US2010/058835 dated Feb. 21, 2012.

* cited by examiner

MULTI-FUNCTION MULTI-HOLE DRILLING RIG

CROSS-REFERENCE TO RELATED APPLICATION

This application is a continuation-in-part of U.S. application Ser. No. 12/316,801, filed Dec. 15, 2008, which in turn claims priority to U.S. Application Ser. No. 61/189,146, filed Aug. 15, 2008.

BACKGROUND OF THE INVENTION

1. Field of the Invention

The present disclosure is directed to drilling oil, gas, and water wellbores in the earth; in certain particular aspects, to drilling, completing, and/or performing workover operations on such multiple wellbores from a single drilling rig; and, in certain particular aspects, to drilling, completing, and/or performing workover operations on such multiple wellbores so that they can be operated on simultaneously and/or are relatively close to each other.

2. Description of the Related Art

A wide variety of drilling rigs and methods are known for drilling oil, gas, and water wellbores in subsurface formations. In many known systems and methods, a single wellbore is drilled with a drilling rig and then, to drill another wellbore, the drilling rig is moved to a new location, often near the drilled wellbore.

Many patents and publications illustrate and describe conventional drilling rigs. For example, U.S. Pat. No. 7,320,374 proposes systems and methods as shown in FIGS. 1A and 1B in which a known top drive system TDS1 in a derrick 140 is suspended from a block becket 18 which is suspended from the derrick 140 in a typical manner. A standard block and hook for hooking a standard becket may be used. An elevator 74 supports a tubular stand 142 which includes two pieces (or three) of drill pipe 143. The stand 142 has been moved from a monkey board 145 with multiple made-up stands 149 to a position axially aligned with a wellbore 147. A mouse hole 144 may be used, e.g., to make stands. A driller controls drilling from a driller's panel 141. The stands 149 are located at a setback position ST. Optionally, the system includes an emergency brake system and/or an emergency shut down device and, optionally, either or both are controllable from the panel 141.

Also, by way of example only, as shown in FIG. 2, U.S. Pat. No. 5,107,940 proposes a known system TDS2 which includes a power swivel 30 and guide mechanism 51 mounted on a mast 102 of a conventional portable rotary earth drilling rig generally designated by the numeral 100. As will hereinafter be more fully explained, the power swivel 30 is pivotally secured through a floating torque arm assembly, called a carriage 70, to a pair of dollies 75 movable longitudinally on a guide track 51 mounted on the mast 102. The guide mechanism 51, illustrated in FIGS. 7-9, and the carriage 70, illustrated in FIGS. 10 and 11 of the drawings in the '940 patent, form a torque restraint system.

The drilling rig 100 is a conventional 118 foot vehicle-mounted hydraulically telescoping derrick, having an inclined mast 102 with a hook load capacity of, for example, 365,000 pounds. The mast 102 is typically inclined at a lean angle 119 of 3½ degrees relative to a vertical axis 125 centered over the well.

The mast 102 is pivotally mounted on a trailer 104 and is transported in a horizontal position with the upper mast section 115 telescoped into the lower mast section 110. When the mast 102 is erected, the telescoped sections 110 and 115 are rotated approximately 90 degrees about a horizontal axis to a vertical position by hydraulically-actuated rams 106. After legs on the lower mast section 110 engage the ground or other supporting surface, hydraulic fluid is delivered to hydraulically-actuated cylinders which raise the upper mast section 115 to the position illustrated in FIG. 1, wherein only the lower end of the upper section 115 extends downwardly into the upper end of the lower section 110.

The trailer-mounted rig includes a single drum drawworks 105 powered by diesel engines 103 through conventional transmissions and a compound box. A fast line 107 extends from drawworks 105 upwardly over a crown block 108, as illustrated in FIG. 2, to provide a number of lines 109 which carry a traveling block 112 connected to the power swivel 30 in the top drive system 20. A conventional folding substructure 140, equipped with a V-door 142, a catwalk 145, and two sets of pipe racks (not shown), parallel and juxtaposed to the catwalk, are mounted adjacent to the inclined telescoping mast 102.

The stand assembly system consists of a crown cantilevered single joint elevator snatch block 21 mounted directly over the mouse hole, an auxiliary cable 22, a live swivel assembly 23 and a single joint elevator 148. The system is permanently installed in the rig for use at any time.

The auxiliary cable 22 is designed to quickly attach to existing hydraulic or pneumatically-powered auxiliary tugger lines and is used to hoist a single joint 24' from the pipe ramp to the mouse hole, and to hoist a complete stand 25 from the mouse hole to the fingerboard 136 and set the stand 25 back on the setback SK.

The single joint elevator 148 is a specially-designed elevator with, for example, a 2,000 pound hoisting capacity for quick attachment to and release from the drill pipe. It is attached to the auxiliary cable 22 utilizing a live swivel assembly 23 to prevent upspiraling of the cable while shouldering up a stand 25 in the mouse hole. During operation, a stand 25 is attached to or removed from the drill string 150, utilizing elevator 48.

The guide track 51 is rigid and continuous; it extends longitudinally along mast 102. The guide track 51 is formed in at least two segments: a lower guide track segment 52, and an upper guide track segment 54, secured to the lower mast segment 110 and upper mast segment 115, respectively (see FIG. 1). The guide track 51 shown can be comprised of, for example, 3½ inch standard pipe sections, each approximately 20 feet long (for easy handling). However, it should be appreciated that guide track 51 may be formed of members having non-circular cross-sections, such as H-beams, without departing from the basic concept of the torque restraint system.

FIGS. 13-15 of U.S. Pat. No. 5,107,940 describe the procedure for making up a stand 25. FIGS. 16-18 of U.S. Pat. No. 5,107,940 describe how a made-up stand is added to a drilling string.

U.S. Pat. No. 4,108,255 proposes an apparatus for drilling concurrently a plurality of wells within a laterally confined area. The confines of the drilling apparatus employ a structure having vertically extending walls rising from a drilling floor. A plurality of wells are drilled, each employing a separate rotary drilling table and a separate draw work assembly mounted in vertical displacement from the drilling table associated therewith. The individual draw work assemblies associated with separate rotary drilling tables are utilized only to feed drilling pipe assemblies into the well and to aid in the actual drilling operation. To withdraw drilling pipe assemblies, a master draw works is provided and is mounted vertically above the draw work assemblies associated with particular rotary drilling tables. In addition, the draw work assemblies are preferably located on bridges which are rotatably mounted with respect to an upright central support, so that the bridges are rotatable about the upright support and carriages forming part of the draw works are movable along the bridges so that the carriages may be moved both radially and rotationally relative to the upright support. The confining structure of the vertically extending walls renders the well drilling apparatus suitable for construction for use in drilling wells on the floor of a body of water and also for use in drilling a plurality of wells in highly urbanized areas. This versatility is achieved by constructing the well drilling apparatus with exterior walls of the confining structure in the form of a facade, to resemble a commercial building or in the form of a water resistant caisson that may be lowered into a body of water to extend from the floor to the surface thereof. This patent proposes a well drilling apparatus located within a confining structure having cylindrical annular vertically extending walls rising from a drilling floor and enclosing a plurality of rotary drilling tables laterally displaced from each other proximate to the drilling floor and within the confines of the walls each arranged to accommodate separate drilling assemblies including drilling pipe for drilling separate wells at spatially separated locations at the drilling floor. Separate drilling draw work assemblies are mounted in vertical displacement from each of the rotary drilling tables for manipulating the drilling pipe and other portions of the drilling assembly utilized with the associated rotary table. Each of the separate drilling draw work assemblies is mounted on a separate bridge that extends laterally from an upright support and is supported at the vertically extending walls at a distance above the rotary drilling table with which it is associated.

It is often desirable to drill wellbores for hydrocarbon and water wells relatively near to each other, e.g., within 8 to 12 feet of each other (or more) in the case of land drilling, and often within 16 to 32 feet of each other (more or less) in the case of offshore/platform drilling. A variety of problems and disadvantages are associated with conventional ways for drilling wellbores that are close to each other. Often, using rigs designed for drilling one hole and then moving the rig to drill another hole, much of the total time expended to drill multiple holes is not time spent actually drilling.

The present disclosure is directed to various methods and devices that may avoid, or at least reduce, the effects of one or more of the problems identified above.

SUMMARY OF THE INVENTION

The following presents a simplified summary of the invention in order to provide a basic understanding of some aspects of the invention. This summary is not an exhaustive overview of the invention, and is not intended to identify key or critical elements of the invention or to delineate the scope of the invention. Its sole purpose is to present some concepts in a simplified form as a prelude to the more detailed description that is discussed later.

Generally, the subject matter disclosed herein relates to a multi-function rig and the apparatus, systems and methods for performing rig operations such as drilling, completions, workover operations and the like. The rig operations may be performed on multiple wellbores, e.g., multiple oil, gas and water wellbores, from a single rig without moving the entire rig.

According to one illustrative embodiment disclosed herein, a multi-function rig for performing rig operations on a plurality of spaced-apart wellbore locations and adapted to be movable between multiple wellbore location sites comprises a rig structure adapted to be positioned over the plurality of spaced-apart wellbore locations at a single wellbore location site. The multi-function rig further comprises at least one tubular movement apparatus proximate the rig structure and a plurality of machines operatively coupled to the rig structure and adapted to perform at least one of the rig operations on at least one of the spaced-apart wellbore locations. Moreover, at least one of the machines is adapted to be movable relative to the rig structure to positions proximate at least one of the spaced-apart wellbore locations without moving the multi-function rig from the single wellbore location site. Furthermore, at least one of the machines is adapted as a drilling machine to perform a drilling operation and to be movable relative to the rig structure to positions proximate at least one of the spaced-apart wellbore locations.

According to another illustrative embodiment disclosed herein, a method is disclosed for performing rig operations on a plurality of spaced-apart wellbore locations with a single multi-function rig adapted to be positioned over the plurality of spaced-apart wellbore locations at a single wellbore location site, the method comprising positioning the multi-function rig at the wellbore location site. The multi-function rig comprises at least one tubular movement apparatus proximate the rig structure and a plurality of machines operatively coupled to a rig structure and adapted to perform at least one of the rig operations on each of the spaced-apart wellbore locations, where at least one of the rig operations is a drilling operation. Additionally, at least one of the machines is adapted to be movable relative to the rig structure to positions proximate at least one of the spaced apart wellbore locations without moving the multi-function rig from the wellbore locations site, and at least one of the machines is adapted as a drilling machine to perform a drilling operation. The method further comprises moving the machine adapted as a drilling machine proximate at least one of the spaced-apart wellbore locations and performing a drilling operation on the wellbore location using the machine adapted as a drilling machine.

BRIEF DESCRIPTION OF THE DRAWINGS

The disclosure is understood by reference to the following description taken in conjunction with the accompanying drawings, in which like reference numerals identify like elements, and in which:

FIG. 17O is a perspective view showing a step in the illustrative method using the system of FIG. 15 as disclosed herein;

Figure 1A:
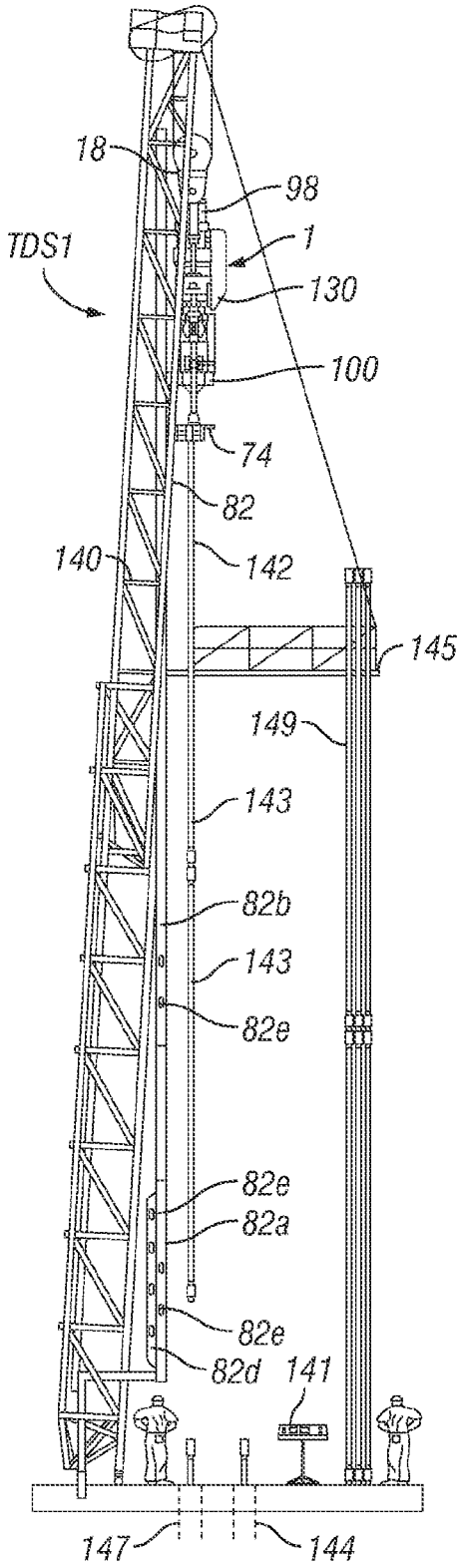
FIG. 1A (Prior Art)
FIG. 1A is a side view of a prior art drilling rig.
Figure 1B:
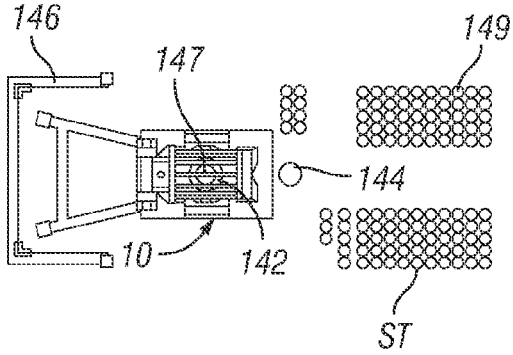
FIG. 1B (Prior Art)
FIG. 1B is a top view of the rig of FIG. 1A.
Figure 2:
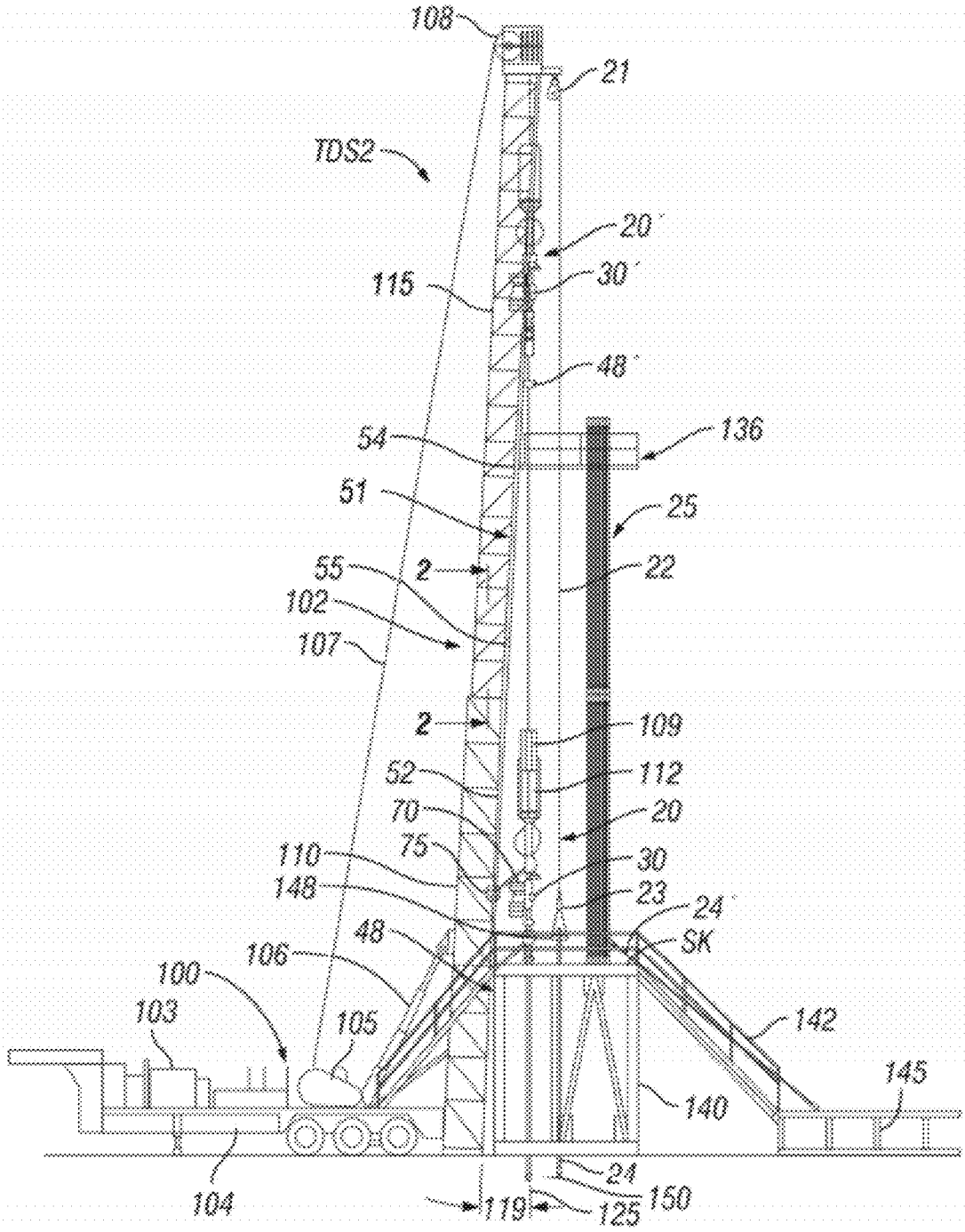
FIG. 2 (Prior Art)
FIG. 2 is a side view of a prior art drilling rig.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

The present invention includes features and advantages which are believed to enable the advancement of oil, gas and water wellbore drilling, completion, and/or workover operations. Various illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

According to some illustrative embodiments, various systems and methods are disclosed for drilling a plurality of closely spaced wellbores for oil, gas, and water wells. In some embodiments, the various rig operations, such as drilling, tripping, casing, cementing, and the like may be performed simultaneously, thereby effectively increasing the efficiency of the rig operations while saving valuable rig time.

In some embodiments, the systems and methods for drilling a plurality of closely spaced wellbores include multiple machines on a single multi-function rig for performing the various rig operations. Not by way of limitation, the multiple machines may include, for example, machines adapted for: drilling a wellbore; tripping drill pipe/tubulars and a drill bit in or out of a wellbore; casing a wellbore; installing heater machines in a wellbore; cementing a cased wellbore; producing an upper portion (sometimes called a "conductor hole") of a wellbore; and/or performing workover operations on existing wellbores.

In further embodiments disclosed herein, the systems and methods in which a multi-function multi-hole rig used for drilling, completing, and/or performing workover operations on multiple oil, gas or water wellbores comprises multiple machines adapted to be movable on the rig itself to each of several hole locations without moving the entire rig. This may be accomplished by moving the machines around or on the periphery of the rig. In one illustrative embodiment, such a rig may have a rig periphery, as viewed from above, which may be rectangular in shape. In other embodiments, such a rig may have a rig periphery, as viewed from above, which may be non-rectangular in shape. For example, the rig periphery may comprise a generally curved configuration, such as a circular shape, elliptical shape, oval shape and the like. In other embodiments, the rig periphery may comprise a general polygonal shape other than rectangular, such as octagonal, hexagonal, pentagonal, triangular and the like. Machines may be movable on a track or path around such a periphery, or a separate movable support supporting the machines may be adapted to move the machines around the periphery from one hole location to another.

Other embodiments disclosed herein may comprise movement apparatus located on or adjacent to the multi-function rig structure and adapted for moving each of the individual multiple machines relative to the rig structure to positions proximate the multiple wellbore locations without moving the entire rig. In one embodiment, the movement apparatus may be adapted to pick up a machine move it, and may comprise a crane, multiple cranes or a hoisting device. It should be noted that the term proximate as it is used herein and throughout the present disclosure is defined to comprise adjacent, adjoining, on, contiguous, immediate, nearby, close, neighboring, near, coupled to, and coupled with.

In another embodiment of the present disclosure, coil tubing units may be provided to aid in completion and drilling operations. In other embodiments, workover machines may also be provided to perform workover operations of existing wellbores, such as the repair and/or stimulation of existing production wells and the like.

In yet another illustrative embodiment, the multi-function rig may comprise a heater installation machine adapted for installing heating devices, apparatuses, tubulars and/or structure for a wellbore. A mud system may also be provided as part of the multi-function rig, which mud system may further include, for example, a mud pit, shakers, augers, mud pumps, de-gassers, de-sanders, de-silters, centrifuges, and the like.

Certain embodiments disclosed herein may also include pressure control equipment disposed proximate the rig structure on the wellbore location side. In some embodiments, the pressure control equipment may be adapted to support drilling loads during rig operations. In other embodiments, a frame may be disposed proximate the pressure control equipment, which in turn may be adapted to support drilling loads. It should be noted that, within the scope of the present disclosure, pressure control equipment may include, for example, wellheads, blowout preventers, flowline apparatus, diverter apparatus, and the like, as may generally be known in the art of drilling and production operations, or as may subsequently be developed.

Figure 3:
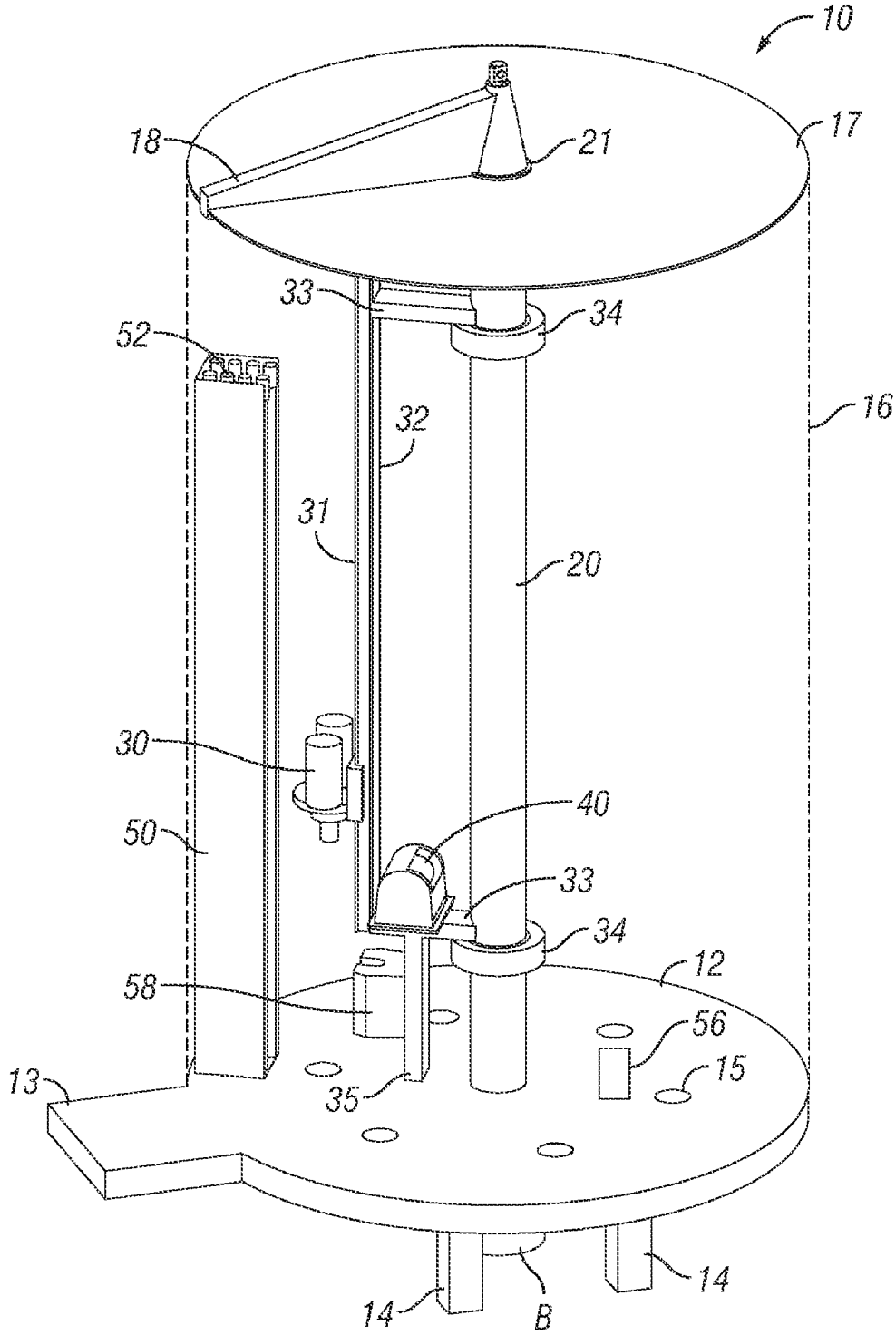
FIG. 3 is a perspective view of an illustrative drilling rig for drilling oil, gas and/or water wells as disclosed herein.

FIG. 3 illustrates one embodiment disclosed herein that comprises a center-support drilling machine in which a drilling machine may be rotatably mounted on a center support, e.g., a central pillar, so that the drilling machine may be rotatable on the center support for positioning over multiple wellbore locations. In other embodiments, additional machines, such as tripping, casing running, heater installing, cementing and the like may also be rotatably mounted on the center support. Moreover, in some illustrative embodiments one machine may be mounted above or below another machine and/or staggered at different levels on a center support.

As shown in FIG. 3, a system 10 comprises a base or rig floor 12 that may be supported by a plurality of supports 14. An upright pillar 20 may be fixedly secured to the rig floor 12. An optional shroud 16 (sides shown in dotted lines) may be provided for use in harsh weather environments. The optional shroud 16 may comprise a top 17, and may also encompass the majority of the rig floor 12. A crane 18 may be rotatably mounted on a top 21 of the pillar 20. A platform 13 projecting from the rig floor 12 may also be provided.

In the illustrative embodiment depicted in FIG. 3, six holes 15 penetrate and extend through rig floor 12, each hole corresponding to and above a location on the ground below the rig floor 12 where a wellbore is intended to be drilled and completed. In other embodiments, any number of such holes, both fewer and greater, may be provided, as may correspond to the number of wellbores required for the specification application.

A drilling machine 30 may be movably mounted for up and down movement on a beam 31, which may be part of a support 32 rotatably mounted on the pillar 20. Crossbeams 33 may be connected to rings 34 which encompass and rotate on the pillar 20. As shown in FIG. 3, a drawworks 40 may be mounted on the lower crossbeam 33 and supported by a beam 35 connected to the lower crossbeam 33 and extending down to the top of the rig floor 12.

A cartridge 50 with tubulars 52 therein (e.g., drill pipe) may be supported on the rig floor 12. In some embodiments, the cartridge 50 may be adapted to be movable around the rig floor 12 and adjacent a desired machine. As shown in FIG. 3, the cartridge 50 may be adjacent the drilling machine 30. Any suitable and desirable rig equipment and apparatuses may be located on the rig floor 12, such as an iron roughneck 58 and the like. Optional air treatment equipment 56 disposed on the rig floor 12 provides heated or cooled air to the system 10. In other embodiments, the equipment 56 may be located near the system 10, but not on the rig floor 12. A bucket B may be disposed below the rig floor 12 for collecting mud that may be circulated from the wellbore.

Figure 4:
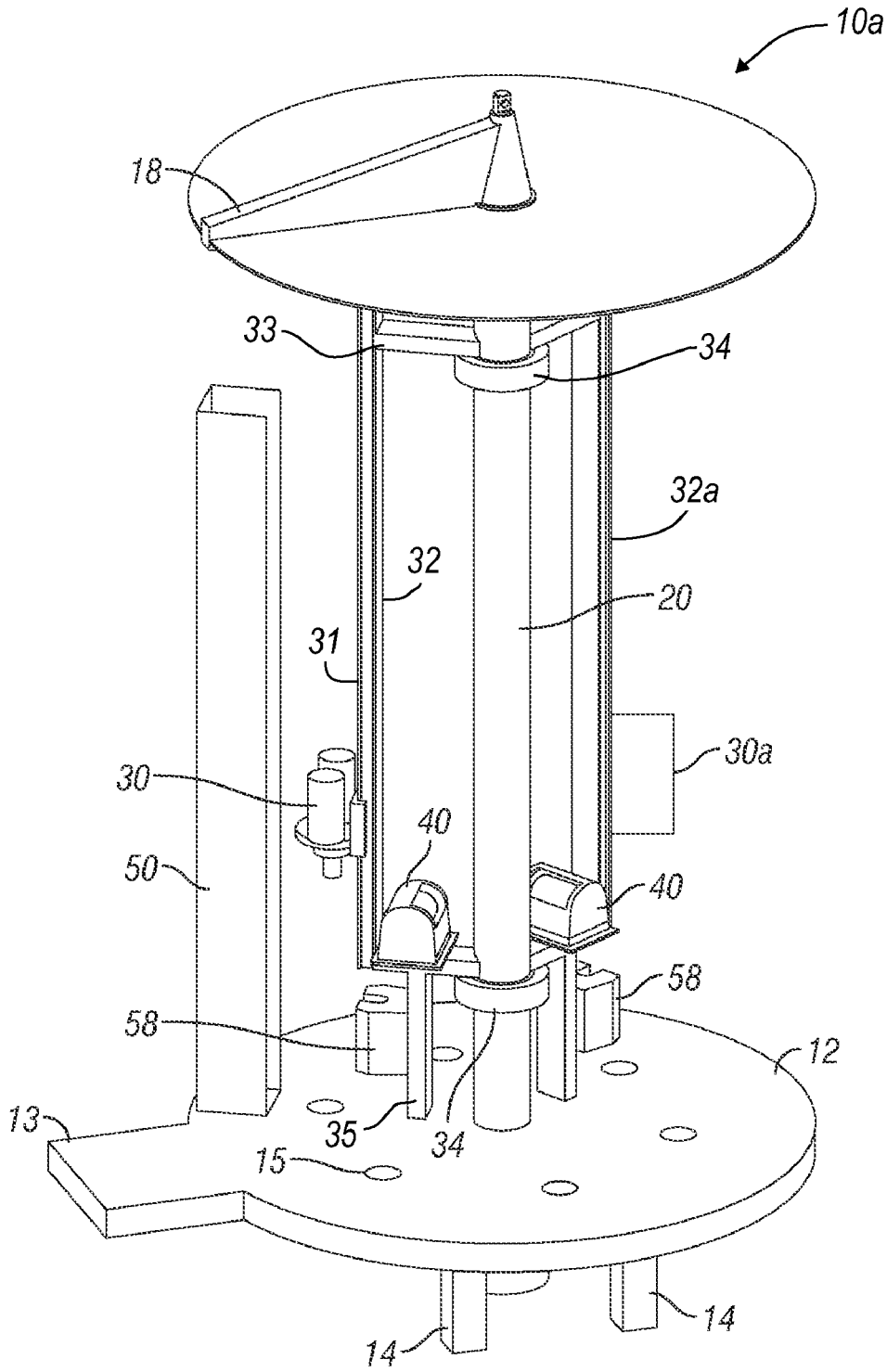
FIG. 4 is a perspective view of an illustrative drilling rig for drilling oil, gas and/or water wells as disclosed herein.

FIG. 4 shows another illustrative embodiment comprising a system 10*a* that is similar to the system 10 of FIG. 3 (note that like reference numerals indicate like system components). As illustrated in FIG. 4, an additional support 32*a* supports an additional machine 30*a* (shown schematically). The additional machine 30*a* may comprise any one of a drilling machine, tripping machine, a cementing machine, a casing machine, a heater installation machine, or any other machine used or useful on a drilling rig. In one embodiment, the additional machine 30*a* may be connected to and supported by the same ring 34 as machine 30. In other embodiments, there may be separate rings adapted for supporting the additional support 32*a* for the additional machine 30*a* and its respective drawworks. Optionally, an additional machine (not shown) supported by an additional support (not shown) may also be rotatably mounted on the pillar 20.

According to some embodiments, the drilling machines, tripping machines and casing running machines may comprise a tubular racking system that may be, in the traditional manner, disposed in front of the machine(s). As is known in many cases, a tubular racking system disposed in front of the machine(s) is a configuration in which the hole to be drilled is between the drilling machine and the tubular racking system and setback area. However, in other illustrative embodiments, a tubular racking system may be located behind the machine(s) rather then in front of the machine(s). As used herein and throughout the present disclosure, tubulars are defined to comprise drill pipes, square pipes, wired pipes, collars, heavy weights, bottom hole assembly components, downhole tools, bottom hole assembly with bit, casing, and any other apparatus, tools, etc., as is known in the art of drilling, completions and/or workover applications, or subsequently developed.

Figure 5A:
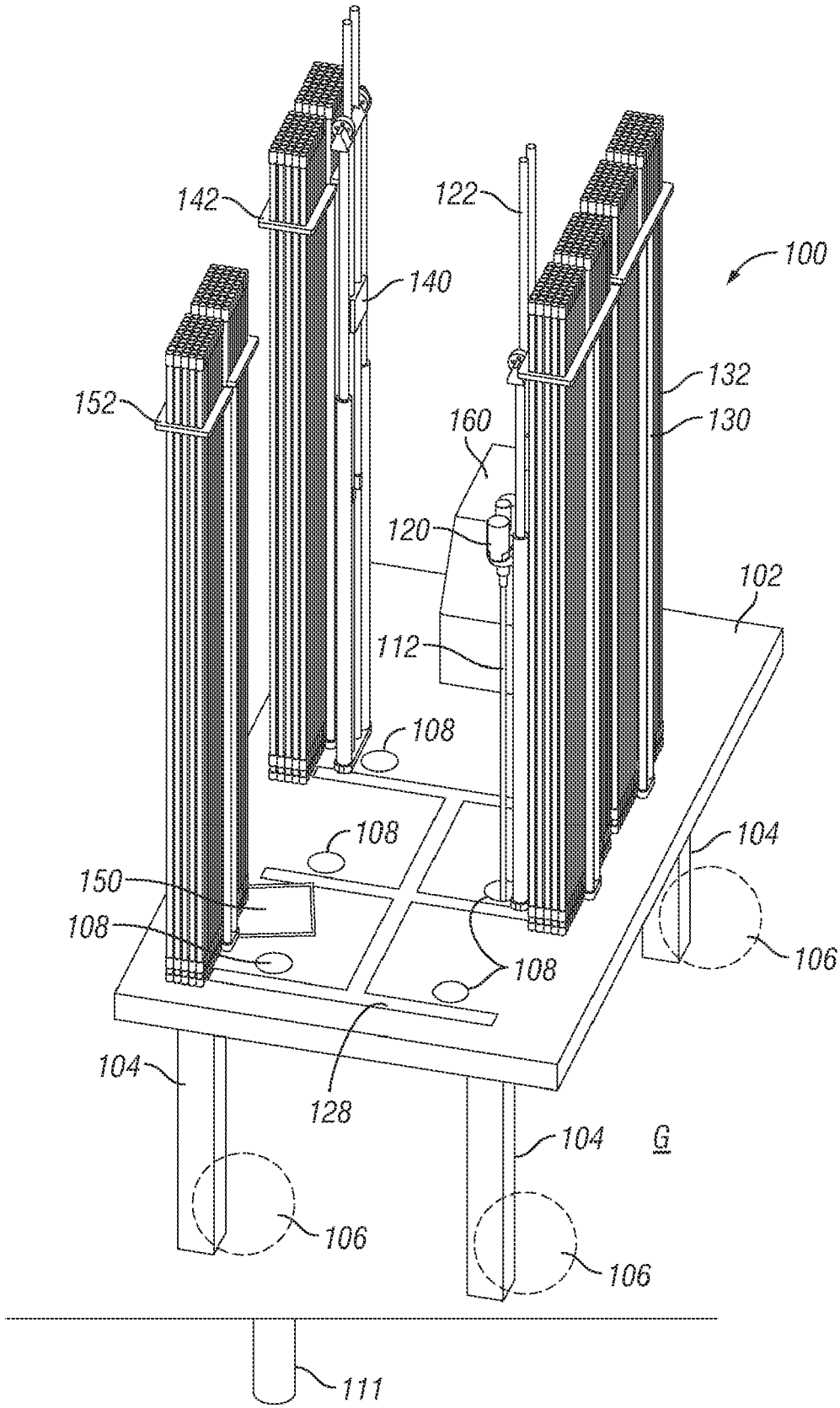
FIG. 5A is a perspective view of an illustrative drilling rig for drilling oil, gas and/or water wells as disclosed herein.
Figure 5B:
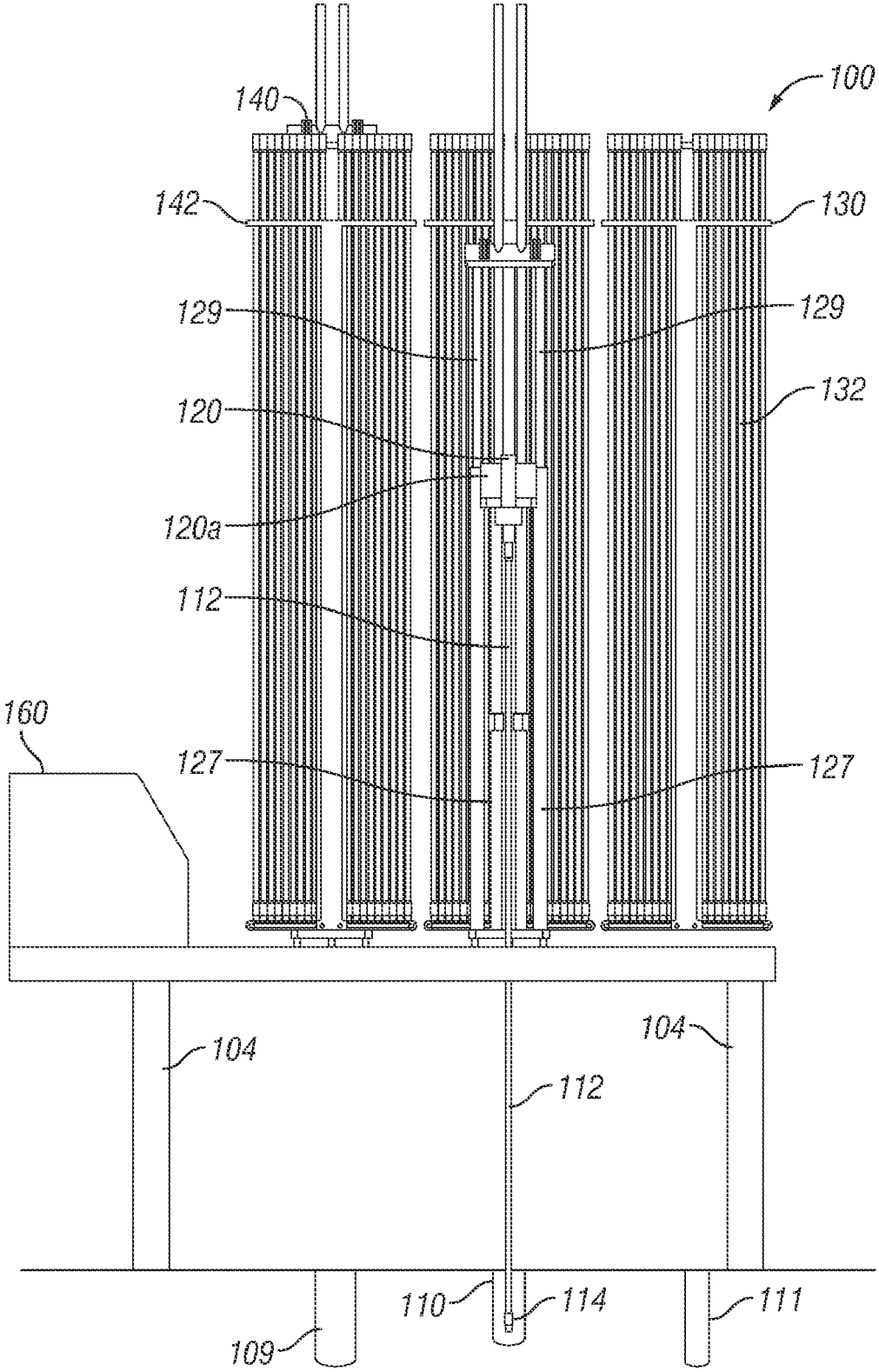
FIG. 5B is a side view of the rig of FIG. 5A.
Figure 5C:
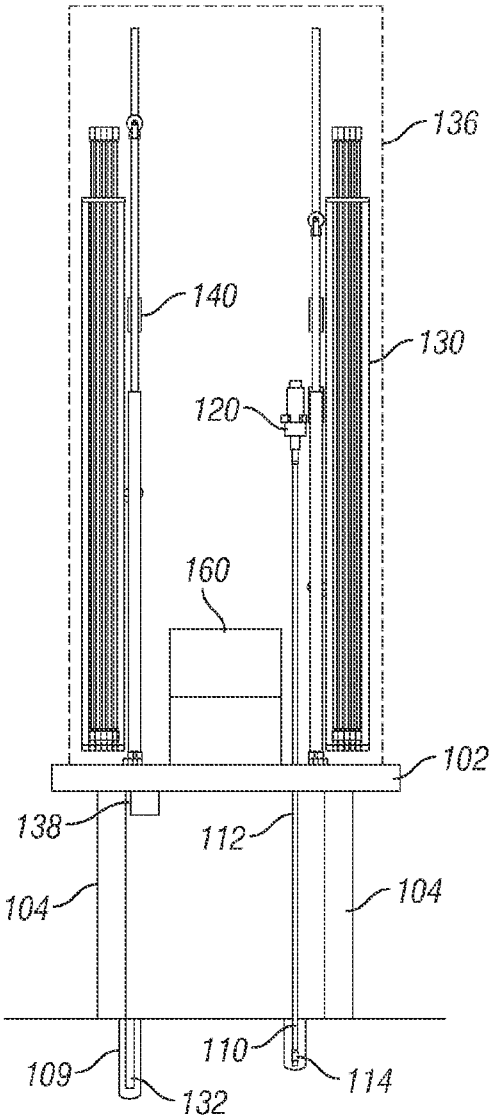
FIG. 5C is an end view of the rig of FIG. 5A.
Figure 5D:
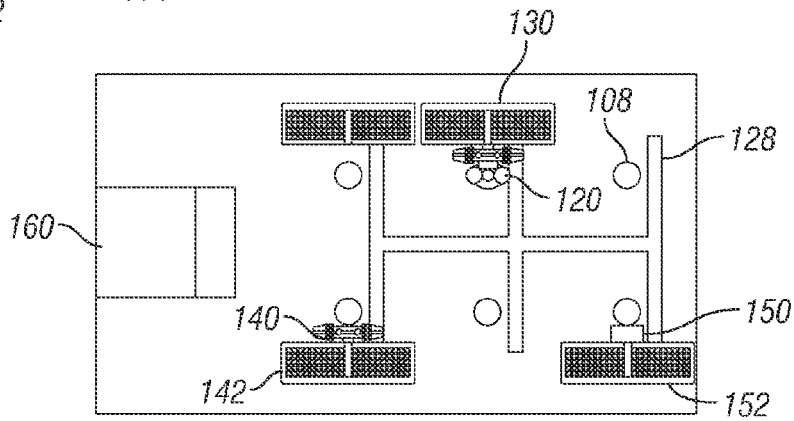
FIG. 5D is a top view of the rig of FIG. 5A.

FIGS. 5A-5D show further illustrative embodiments of the present disclosure. A system 100 comprises a rig floor 102 on four supports 104 (three shown). Optionally, the system 100 may be mobile, and in some such embodiments may be mounted on wheels 106 (shown schematically). In other embodiments, tracks may be used instead of wheels. As shown in FIG. 5D, the rig floor 102 has six holes 108 penetrating therethrough. Each of the six holes 108 is located above a location on the ground G at which it is intended to drill and complete a wellbore. As further shown in FIGS. 5A-5C, a drilling machine 120 is located adjacent one of the holes 108 and is drilling a wellbore 110 with a bit 114 on a drill string 112.

In some illustrative embodiments of the present disclosure, the drilling machine 120 is movable up and down on a track 122. As shown in FIG. 5A, a tubular rack 130 behind of the drilling machine 120 holds tubulars/drill pipe 132 (or, if desired, tubing or casing) for use in the drill string 112. Optionally, as shown in dotted line in FIG. 5C, the system 100 has a harsh weather shroud 136 and an optional air treatment system 138 (shown schematically) to heat or cool air. The drill machine 120 may be a pull-down drilling machine, a cylinder rig or a drawworks-driven machine.

FIG. 5B shows a tripping machine 140 on the rig floor 102 proximate a hole 108 through which a wellbore 109 has been drilled with the drilling machine 120. In a typical rig operation, the tripping machine 140 is adapted to remove the drill pipe/tubulars 132 used by the drilling machine 120 from the wellbore 109. In some embodiments disclosed herein, the tripping machine 140 may hang off the drill pipe on the tool joint upset at the rig floor 102 instead of using slips. In such embodiments, the hoisting mechanism may be positioned on either side of the hang off point (not shown).

In some illustrative embodiments, a separate cementing machine 150 may also be positioned for cementing casing in a wellbore. In the embodiment illustrated in FIG. 5A, the wellbore 111 to be cemented by the cementing machine 150 (shown schematically in FIG. 5A) was previously drilled by the drilling machine 120, and the drill pipe/tubulars were previously removed from the wellbore 111 by the tripping machine 140. In those particular embodiments when casing drilling is used, the casing may have been run by a tripping machine, or optionally by a casing running machine.

A driller's cabin 160 may also be located on the rig floor 102 so that personnel in the driller's cabin can see each hole 108 and each machine located proximate a hole during rig operations.

Each of the machines 120, 140, 150 comprising the system 100 may be adapted to be movable across the rig floor 102. As shown in FIGS. 5A and 5D, pathway 128 indicates movement options for each of the machines 120, 140, 150. Any suitable movement paths may be used and any suitable movement apparatus for moving the machines may also be used.

The tripping machine 140 may comprise a tubular rack system 142 proximate thereto and the cementing machine 150 may comprise a tubular rack system 152 proximate thereto. For example, as shown in FIG. 5B, the tubular rack 130 may be positioned behind the drilling machine 120. This arrangement is the opposite of conventional tubular rack systems, which are positioned in front of a drilling system and in which the hole through which a well is drilled is positioned between a drilling system and a tubular rack system. Locating the tubular rack system behind the drilling machine (or behind another machine) has several advantages, such as saving space and allowing an unobstructed view of multiple operations and/or multiple wells. Placing the tubular rack systems behind the drilling machine also enables auxiliary equipment to be brought up close to the multi-function rig, and further allows other operations to take place in conjunction with the drilling, completions and workover operations. Moreover, in other illustrative embodiments disclosed herein, a hoisting system may be part of a tubular rack system. In still other embodiments, the tubulars/drill pipe may be supported, not by slips, but by two sides of the tool joint. In such embodiments the hoisting mechanism picks up on the other two sides of the tool joint in order to eliminate the need for slips.

In some illustrative embodiments, the systems and methods disclosed herein may employ drilling machines in which a drilling device is moved, forced, or pulled down to facilitate wellbore drilling. In one embodiment, a cylinder-powered drilling apparatus 120*a*, as shown in FIG. 5B, includes one, two or more powered cylinder apparatuses that pull a drilling device down to force it into the earth. Power cylinders 127 have rods 129 connected to a plate 133 that moves on tracks 137. The power cylinders 127 are connected to the drilling apparatus 120*a*. Extension of the rods 129 upwardly results in pushing up of the sheaves that then pull up a top drive or tripping machine. Retracting of the rods 129 results in pulling down on other sheaves that then pull down on the top drive or on the tripping machine. Power cylinders can be advantageous as compared to, for example, a typical top drive rig, in saving space, in ease of control, and in the ability to keep a top drive from colliding with the rig floor or into the crown. In one particular embodiment, the drilling machine 120 may have a 50-to-75 ton top drive or power swivel. In other embodiments, for any system disclosed herein, the drilling machine may be a 50-to-1250 ton top drive system.

In other illustrative embodiments, a road module may be provided adjacent one multi-hole location or extending by a plurality of multi-hole locations. In some embodiments, a crane and/or driller's cabin may be movably positioned on the road module and one or more multi-function multi-hole rigs may be located adjacent the road module and movable with respect to the road module from one multi-hole location to another.

Figure 6A:
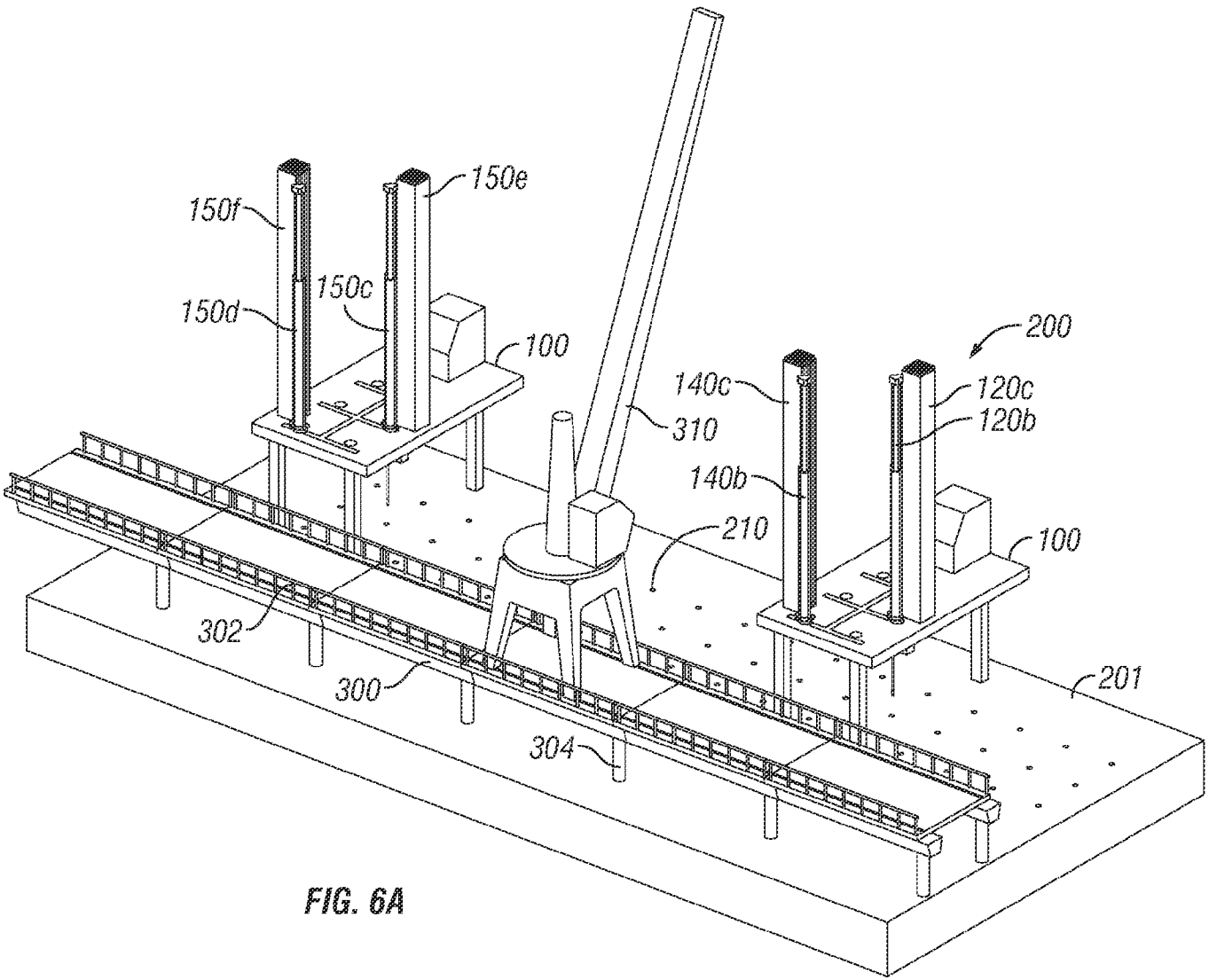
FIG. 6A is a perspective view of an illustrative drilling system for drilling oil, gas and/or water wells as disclosed herein.
Figure 6B:
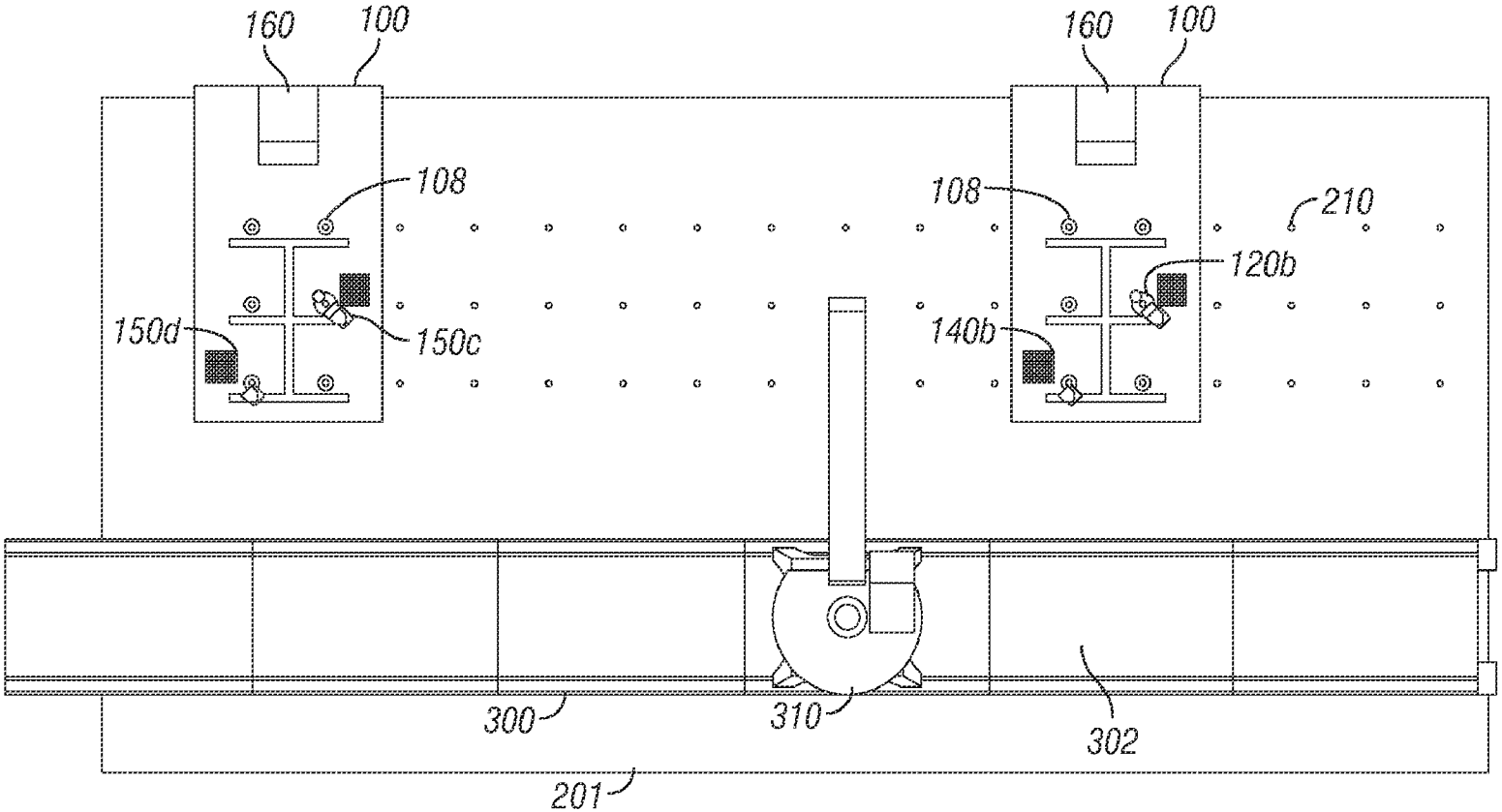
FIG. 6B is a top view of the system of FIG. 6A.

FIGS. 6A and 6B yet another illustrative embodiment, comprising a system 200 which includes multiple systems (generally designated as system 100 in FIG. 6A) proximate a road module 300. Multiple wellbores 210 may be drilled, completed, or worked over by the multiple systems 100. In the embodiment illustrated in FIG. 6A, two systems 100*a* and 100*b* are shown disposed at system location 201, although three or even more systems 100 may be provided as part of system 200.

The road module 300 includes connected road sections 302 supported by a plurality of supports 304. In one embodiment, the supports 304 extend down to bedrock at the system location 201. For example, the supports 304 may extend through any one of a variety of surface materials overlying the bedrock as may typically be found at drilling site locations, such as top soil, tundra, muskeg, peat, sand, unstable soil or other material, ice and the like. Optionally, a crane 310 may be semi-permanently or movably mounted on the road sections 302 for use in operations of any one of the systems 100.

In one embodiment disclosed herein, each system 100 may comprise all of the machines needed to drill, complete, and/or work over multiple wellbores. Moreover, in some embodiments, each system 100 may be adapted to move from one wellbore to another within the system location 201, thereby being able to perform rig operations on multiple wellbores 210. For example, one system 100 may be disposed above a first location of an intended wellbore 210 and thereafter perform typical rig operations, such as drilling the wellbore, tripping out the drill pipe/tubulars, casing the wellbore, cementing the casing in place, and the like. In this embodiment, the wellbore is cased and cemented immediately upon completion of the drilling and tripping operations. After completing all rig operations at the first location, the system 100 may then be moved and disposed above a second location of an intended wellbore 210 and thereafter perform all rig operations as previously performed at the first location. Again, upon completion of rig operations at the second location, the system 100 may again be moved and disposed above multiple additional intended wellbores 210, and thereafter performing and completing the same rig operations at each. Moreover, in some embodiments, multiple systems 100 may be disposed within the system location 201 to simultaneously perform and complete rig operations on multiple wellbores 210.

In other embodiments, each system 100 may only comprise certain specific machines that perform certain specific drilling, completions, and/or workover functions. For example, and not by way of limitation, the system 100*a* depicted in FIG. 6A may be a drilling/tripping system comprising a drilling machine 120*b* with its associated tubular racking system 120*c* and a tripping machine 140*b* with its associated tubular racking system 140*c*. System 100*b*, on the other hand, may be a casing/cementing system comprising a casing machine 150*c* with its rack system 150*e* and a cementing machine 150*d* with its rack system 150*f*. In some particular embodiments of the present disclosure, each of the systems 100*a* and 100*b* may be further adapted to be movable from one wellbore to another wellbore within the system location 201. For example, the drilling/tripping system 100*a* may be disposed above a first location of an intended wellbore 210, at which location the system 100*a* may then drill the wellbore and trip out the drill pipe/tubulars. After completion of the drilling and tripping operations, the drilling/tripping system 100*a* may then be moved and disposed above a second location of an intended wellbore 210 while the casing/cementing system 100*b* may be moved and disposed above the first location previously drilled by system 100*a*. The casing/cementing system 100*b* may then case the wellbore at the first location and cement the casing in place, and the drilling/tripping system 100*a* may perform rig operations at the second location. It should be noted that, while not essential to the overall operation of system 200, the operations by system 100*b* at the first location and system 100*a* at the second location may be performed simultaneously. Moreover, as rig operations are completed by drilling/tripping system 100*a* at the second location, system 100*a* may be moved to third and fourth intended wellbore locations, and so on, and as rig operations are completed by casing/cementing system 100*b*, system 100*b* may be moved to the second and third locations previously drilled by system 100*a*, and so on.

In yet another illustrative embodiment, each of the systems 100 may be adapted to perform all of the operations necessary to complete only a single specific section of the wellbore. For example, system 100*a* may comprise all machines and systems required to drill trip, case, and cement the first section of the wellbore. System 100*b*, on the other hand, may comprise all machines and systems required to drill, trip, case, and cement the second section of the wellbore. Additional systems 100 may also be provided for performing similar rig operations on other sections of the wellbore, as might be necessary for the specific application. As with the previously described embodiment, each of the systems 100 may be adapted to be movable from one wellbore to another wellbore within the system location 201, where the operations necessary to complete the wellbore section for which each system 100 may be specifically adapted might be sequentially performed.

Finally, it should be noted that for each of the various embodiments of system 200 as illustrated by FIGS. 6A and 6B and described above, any or all of the systems 100 may also comprise a heater installation machine adapted to install heaters in a wellbore.

Figure 7A:
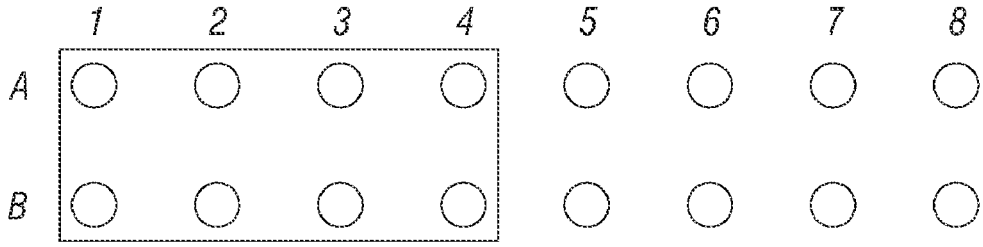
FIG. 7A is a top schematic view showing various steps in an illustrative method using a rig as disclosed herein.
Figure 7B:
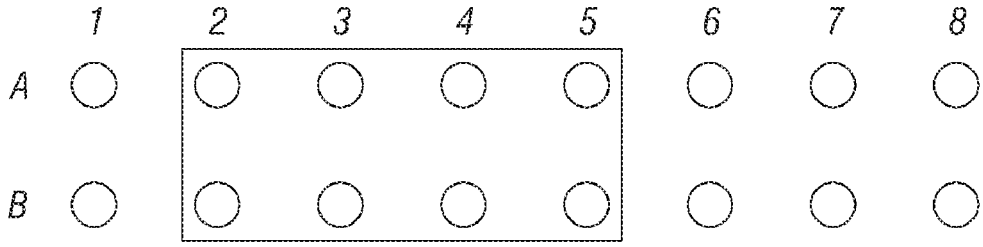
FIG. 7B is a top schematic view showing a step in the illustrative method of FIG. 7A as disclosed herein.

FIGS. 7A and 7B illustrate an embodiment of a drilling system for performing progressive work on multiple wells. As shown in FIG. 7A, there are sixteen wells to be drilled (1-8 in line A and 1-8 in line B). As illustrated in FIG. 7A, a system 100 drills all the wells below holes 1-4, line A and 1-4, line B, and completes (or trips pipe/tubulars out of) hole 1A and 1B (or only some of them). In one embodiment, the system 100 completes wells on lines 1-3 and partially completes wells on line 4. Then, the system 100 is moved so that it is above wellbore locations 4-7, line A and 4-7, line B. Thus, while various machines may be working on the already-drilled holes, the drilling machine can drill the wellbores at locations 5 of lines A and B, and so on for all sixteen wellbores.

Figure 8A:
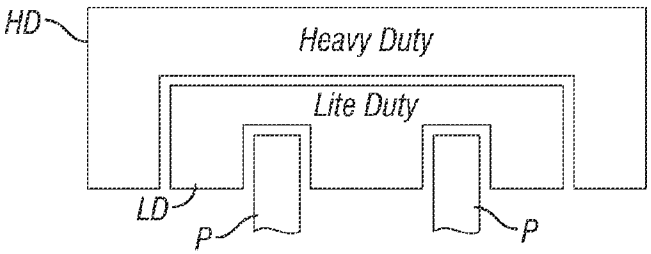
FIG. 8A is a cross-section view of the top of an illustrative road module as disclosed herein.
Figure 8:
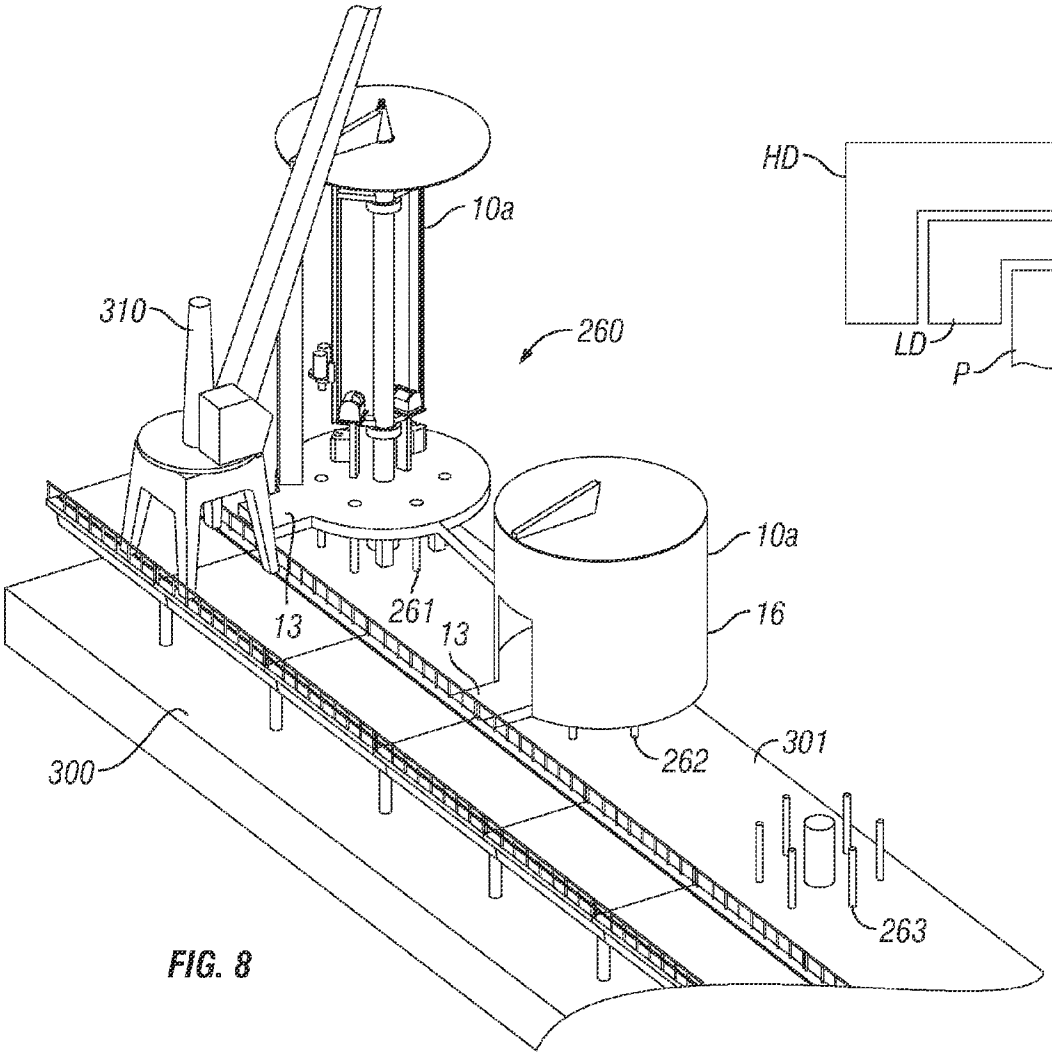
FIG. 8 is a perspective view of an illustrative system as disclosed herein.

FIG. 8 shows yet another illustrative embodiment, comprising a system 260 with systems 10*a* and a road module system 300. The systems 10*a* move down a system location 301 (left-to-right in FIG. 8) drilling and completing multiple wellbores corresponding to a plurality of sets of multiple holes at hole locations 261, 262, 263, etc. As with the embodiments illustrated in FIGS. 3 and 4, each set of multiple holes illustrated in FIG. 8 comprises six holes at each hole location 261, 262, 263, etc. However, particular embodiments may include as many holes as might be appropriate for the specific application, including, but not limited to, two holes, three holes, four holes, five holes, seven holes, eight holes or even more. As FIG. 8 shows, a system 10*a* can be of any height necessary to achieve wellbores of the required depth.

FIG. 8A shows a further embodiment wherein a road module is supported by pillars P. The cross-section view shown in FIG. 8A illustrates a lite duty road top LD supported directly by the pillars P. The lite duty road top LD may, in some embodiments, support an optional heavy duty road top HD, which may comprise selectively removable sections. In still other embodiments, the lite duty road top LD may comprise selectively removable sections, or, in cases when the heavy duty road top HD is present, may be eliminated entirely.

In certain embodiments as disclosed herein, a rig is provided on which one or more certain machines may be movable around the periphery of the rig, and one which one or more other machines may be movable across a portion of a rig. For example, in a rig according to one illustrative embodiment, a drilling machine and a cementing machine may be movable around the periphery of a rig, whereas a tripping machine may be movable across the rig from one hole location to another hole location. In yet another embodiment, machines other than a drilling machine may be movable around the periphery of a rig, and a drilling machine may be movable across the rig from one hole location to another hole location.

In other embodiments of the present disclosure, multiple machines and multiple wellbore locations may be located so that, from a single driller's cabin on the rig, all machines and all wellbore locations can be viewed and monitored during the various stages of drilling, tripping, cementing, completions, and/or workover operations performed on multiple holes. In one particular embodiment, a cabin system may be provided in which the driller's cabin is movable to multiple positions on the rig either across the rig or on its periphery. In another embodiment, one or more of the multiple machines may be movable on the rig, either across the rig or on its periphery. In any of the various embodiments of the systems disclosed herein, the driller may also move or be moved in a chair around a driller's cabin, and, in one aspect, he may be located in the center of the floor and the chair rotates to view each wellbore.

Figure 9A:
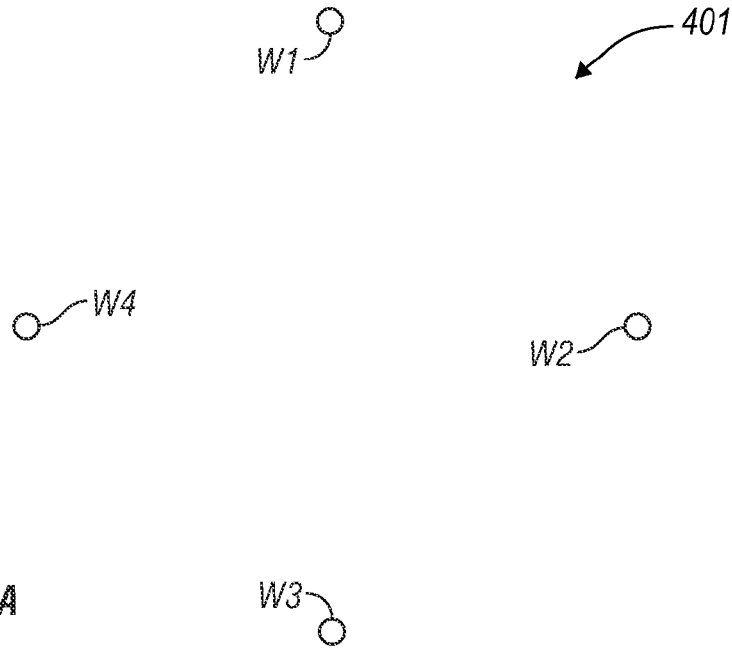
FIG. 9A is a top schematic view showing locations for multiple wellbores to be drilled and completed.

FIG. 9A shows a particular embodiment comprising a site location 401 with multiple wellbore sites W1, W2, W3, and W4. In other embodiments, the number of wellbore sites at a given site location may be varied as necessary to meet the specific requirements of a particular application, for example, two, fifty, two hundred, etc. In many embodiments the spacing between wellbore sites W1, W2, W3, etc., will be approximately 10 feet, however both smaller and larger wellbore site spacings are within the scope of the present disclosure.

Figure 9B:
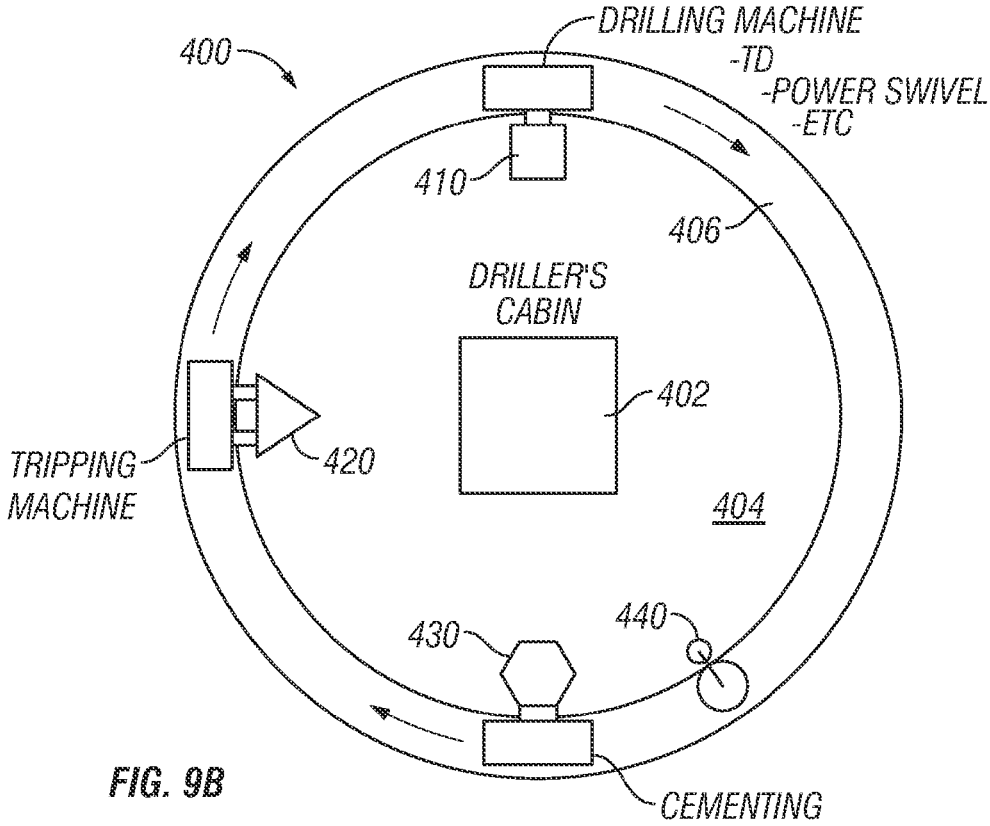
FIG. 9B is a top schematic view of an illustrative drilling system as disclosed herein for drilling at the locations shown in FIG. 9A.

FIG. 9B shows a system 400 according to yet another embodiment that comprises a driller's cabin 402 on a base 404 from which operations personnel may at all times be able to view multiple machines comprising the system 400 and located at the system's periphery. The multiple machines illustrated in FIG. 9B may include, but would not be limited to, a drilling machine 410, a tripping machine 420 and a cementing machine 430. In some illustrative embodiments, the cementing machine 430 may also perform casing functions, and in other embodiments, a separate casing machine (not shown) may be provided. Each machine may be mounted for movement along a pathway 406, such as a track, groove, rail system, and the like. In some embodiments, the base 404 may have the pathway 406 rotatably mounted therearound, and the entire pathway 406 may rotate with respect to the base 404. Optionally, the multiple machines may be mounted on and supported by the rotatably mounted pathway 406. In other embodiments, the pathway 406 may be fixedly mounted on the base 404, and the base 404 may rotate. In yet another embodiment as disclosed herein, a driller chair may be adapted rotate, such that operations performed by any one of the multiple machines 410, 420, 430, etc., at any one of the multiple wellbore locations W1, W2, W3, etc., can be directly viewed by the driller.

In another embodiment of the present disclosure, the multiple machines comprising the system 400 may include a heater running machine 440 adapted for installing a heater function in or near any wellbore drilled with the system 400.

Figure 9C:
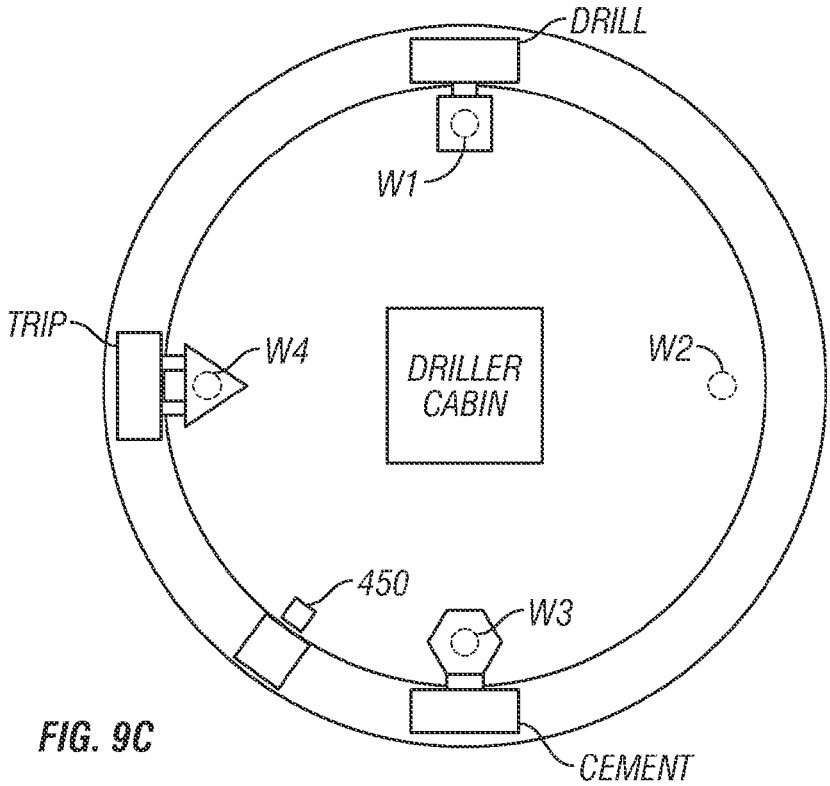
FIG. 9C is a top schematic view showing illustrative steps in drilling and completing wells at the locations of FIG. 9A as disclosed herein.

FIG. 9C illustrates one embodiment of the system 400 during a typical rig operation. In this illustrative embodiment, the drilling machine 410 may be positioned proximate to and above wellbore W1, the tripping machine 420 may be positioned proximate to and above wellbore W4, and the cementing machine 430 may be positioned proximate to and above wellbore W3. During operation shown, the drilling machine 410 may be drilling wellbore W1 and the tripping machine 420 may be tripping tubulars from wellbore W4, which had previously been drilled by drilling machine 410. Furthermore, the cementing machine 430 may be cementing the casing in place in wellbore W3, which was previously drilled by drilling machine 410, and from which the tubulars were previously tripped by tripping machine 420. In some embodiments, the casing that is being cemented in wellbore W3 by the cementing machine 430 was previously installed in wellbore W3 by the cementing machine 430, which in this embodiment may comprise a casing installation apparatus adapted to install casing in a drilled wellbore. In other embodiments, the casing that is being cemented in wellbore W3 was previously installed in wellbore W3 by an optional separate casing apparatus 450. As the rig operations illustrated in FIG. 9C continue, the next wellbore to be drilled by drilling machine 410 will be wellbore W2, which may occur after each of the machines comprising system 400 are rotatably moved along pathway 460 in a clockwise direction.

Figure 10:
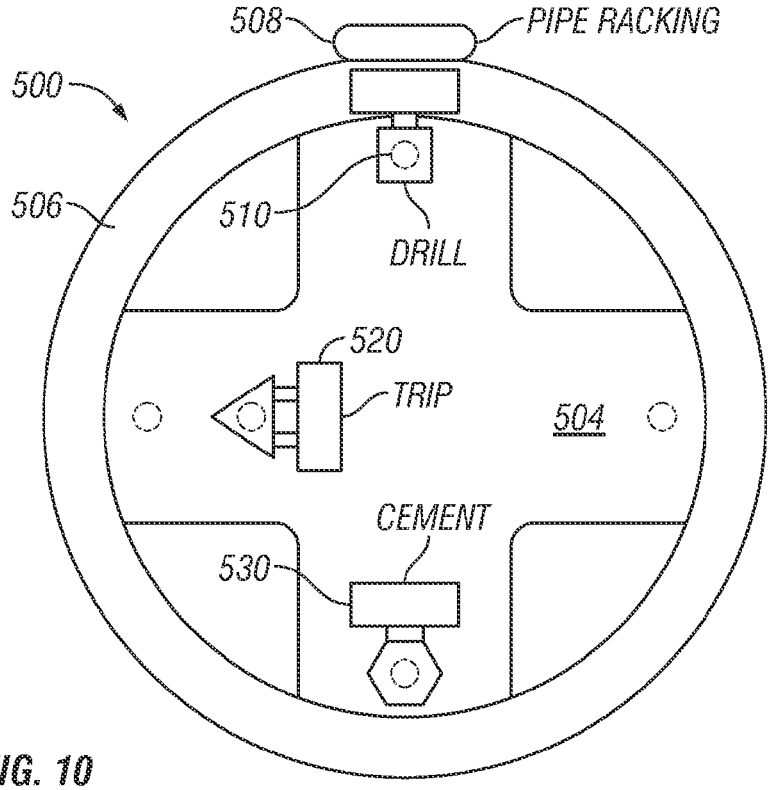
FIG. 10 is a top schematic view of an illustrative drilling system as disclosed herein.

In another embodiment illustrated in FIG. 10, a system 500 may comprise a drilling machine 510 disposed on a pathway 506, similar to the pathway 406 of system 400. A tripping machine 520 and a cementing machine 530 are disposed on and adapted to move across a base 504, similar to the base 404 of system 400. In some embodiments, a heater installer may also be disposed on and adapted to move across the base 504. Optionally, the heater installer may be disposed on the pathway 506. A tubular racking system 508 may be provided behind of the drilling machine 510, and may either be disposed on the pathway 506 or mounted to another adjacent structure. In other embodiments, the system 500 may also comprise a crane or hoist (not shown) adapted for lifting and moving systems, machines and equipment during rig operations.

Figure 11:
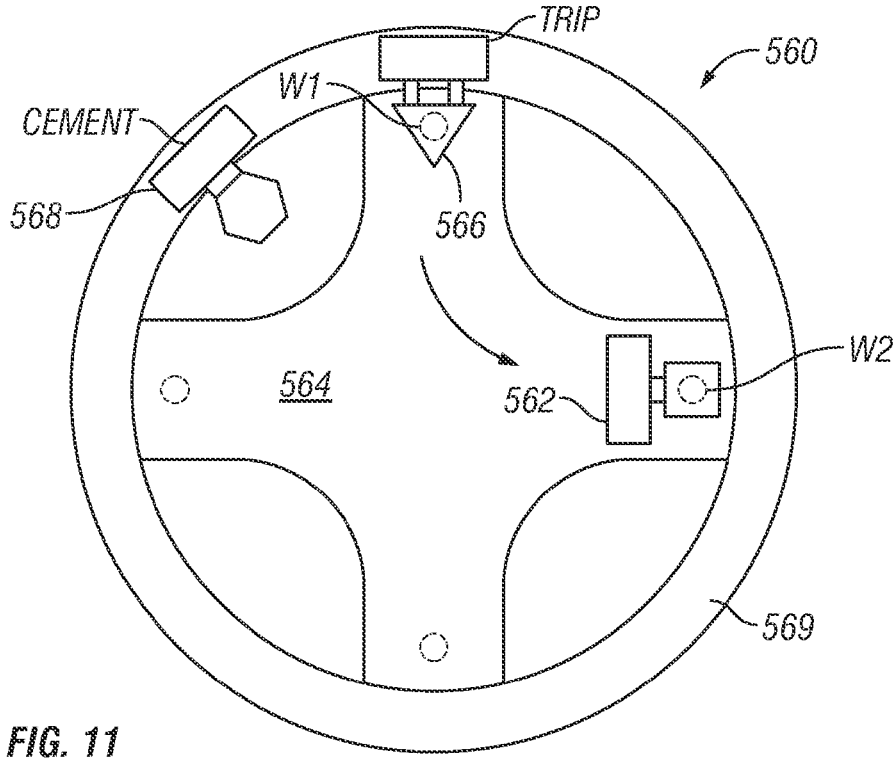
FIG. 11 is a top schematic view of an illustrative drilling system as disclosed herein.

FIG. 11 illustrates a system 560, which is an optional embodiment of system 500 according to the present disclosure. System 560 may comprise a drilling machine 562 that is disposed on and movable across a base 564, similar to the base 504 of system 500. System 560 further comprises a tripping machine 566 and a cementing machine 568 disposed on a pathway 569, similar to the pathway 506 of system 500. In some embodiments, system 560 may also comprise a casing machine (not shown), which may be disposed on the pathway 569, or optionally disposed on and adapted to move across the base 564.

Figure 12:
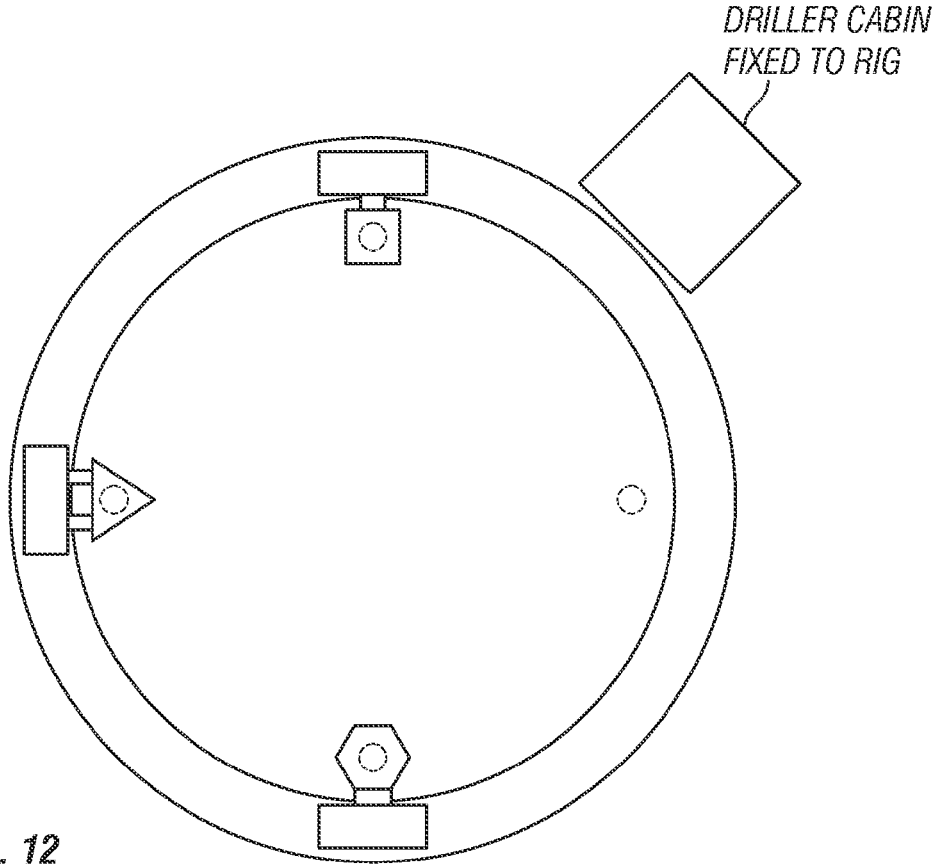
FIG. 12 is a top schematic view of an illustrative drilling system as disclosed herein.

According to the embodiment shown in FIG. 12, a driller's cabin may be in a fixed position connected to a base of a system, or alternatively to some other structure proximate thereto. In some embodiments, the driller's cabin may be located so personnel therein can view all operating machines and/or all well locations simultaneously. In other embodiments, viewing may be possible via direct line of sight, camera(s) and/or rotating a drill chair to a desired position for viewing.

Figure 13:
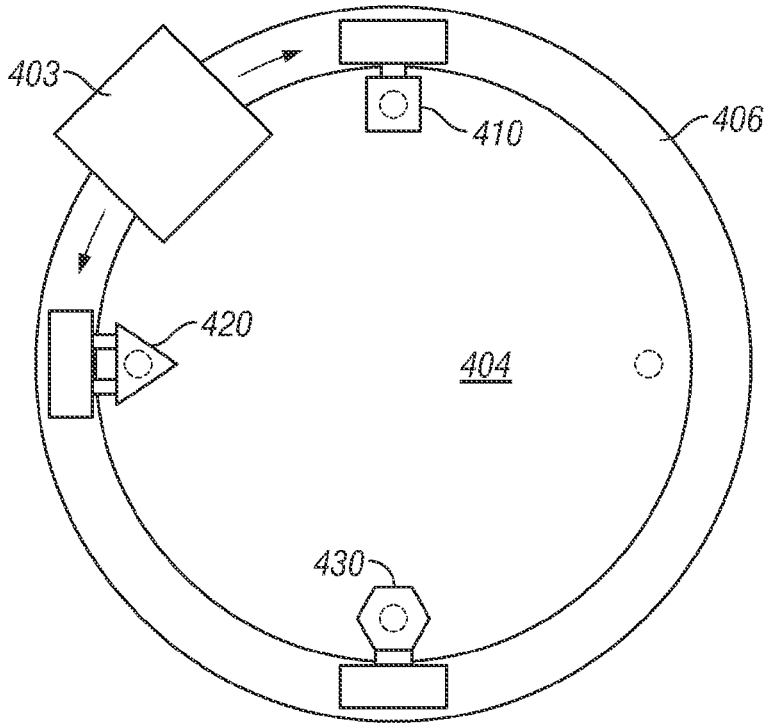
FIG. 13 is a top schematic view of an illustrative drilling system as disclosed herein.
Figure 14:
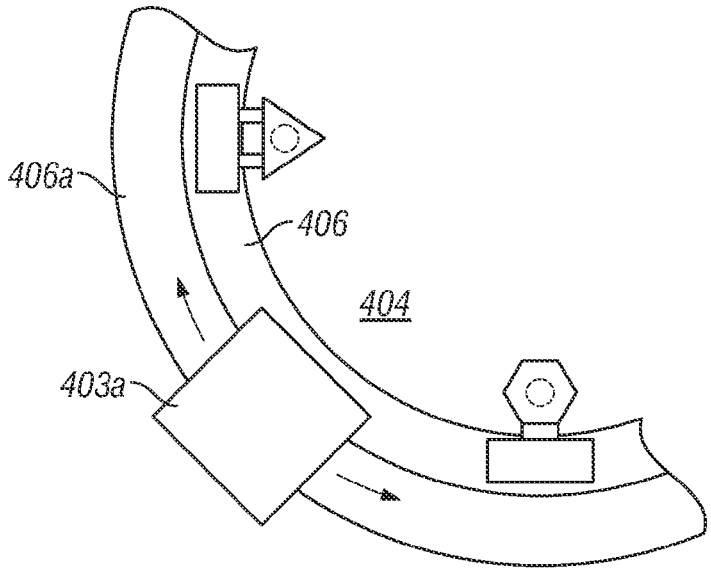
FIG. 14 is a top schematic view of an illustrative drilling system as disclosed herein.

FIG. 13 shows an optional disposition of a driller's cabin 403. The driller's cabin 403 is disposed on the pathway 406 and, as with any or all the machines 410, 420, 430, may be adapted to be movable with respect to the base 404. As illustrated in FIG. 13, the driller's cabin 403 is located on the pathway 406 between machines 410 and 420, however a crane or other movement apparatus may move the driller's cabin 403 to any desired location on the pathway 406. For example, the driller's cabin 403 may be located between machines 420 and 430, or optionally between machines 430 and 410. In the illustrative embodiment shown in FIG. 14, a driller's cabin 403*a* may have its own dedicated pathway 406*a* which, in one embodiment may be adapted to move around both a pathway 406 and a base 404.

In some embodiments disclosed herein, multiple rig operations, such as, for example, drilling, tripping, casing, cementing and the like, may simultaneously (or at least near-simultaneously) performed by a multi-function rig on multiple wellbores without moving the rig. In operation, a drilling machine disposed on the multi-function rig may be moved to a new position on the rig to commence drilling a new wellbore. In the interim, a tripping machine also disposed on the rig may be moved into place over a drilled wellbore to commence tripping out drill pipe/tubulars and the drill bit that were previously used by the drilling machine to drill the wellbore. In another embodiment of the present disclosure, one in which two wellbores have been thus drilled by the drilling machine, a cementing machine also disposed on the rig may be moved over the first drilled wellbore to commence a cementing operation to cement in place casing that was previously installed by the tripping machine. Alternatively, the casing at the first drilled wellbore may have been installed by a separate casing running machine moved to that wellbore after completion of the tripping operation by the tripping machine. In the interim, the tripping machine may be moved over a second-drilled wellbore to trip out drilling pipe/tubulars and drill bit from the second wellbore as the drilling machine is moved to a third wellbore and commences drilling operations there. Disposable and/or abandonable bits may be used in systems and methods according to some illustrative embodiments, and in particular embodiments part of a wellbore may be drilled using a drill bit on drill pipe/tubulars, and part may be drilled using a casing drilling method.

In one particular embodiment disclosed herein, the drilling machine may comprise a casing drilling machine, wherein a tripping machine may not be required. In certain other embodiments disclosed herein, multiple casing drilling machines may be disposed on one rig for simultaneously performing rig operations on multiple wellbores.

Figure 15:
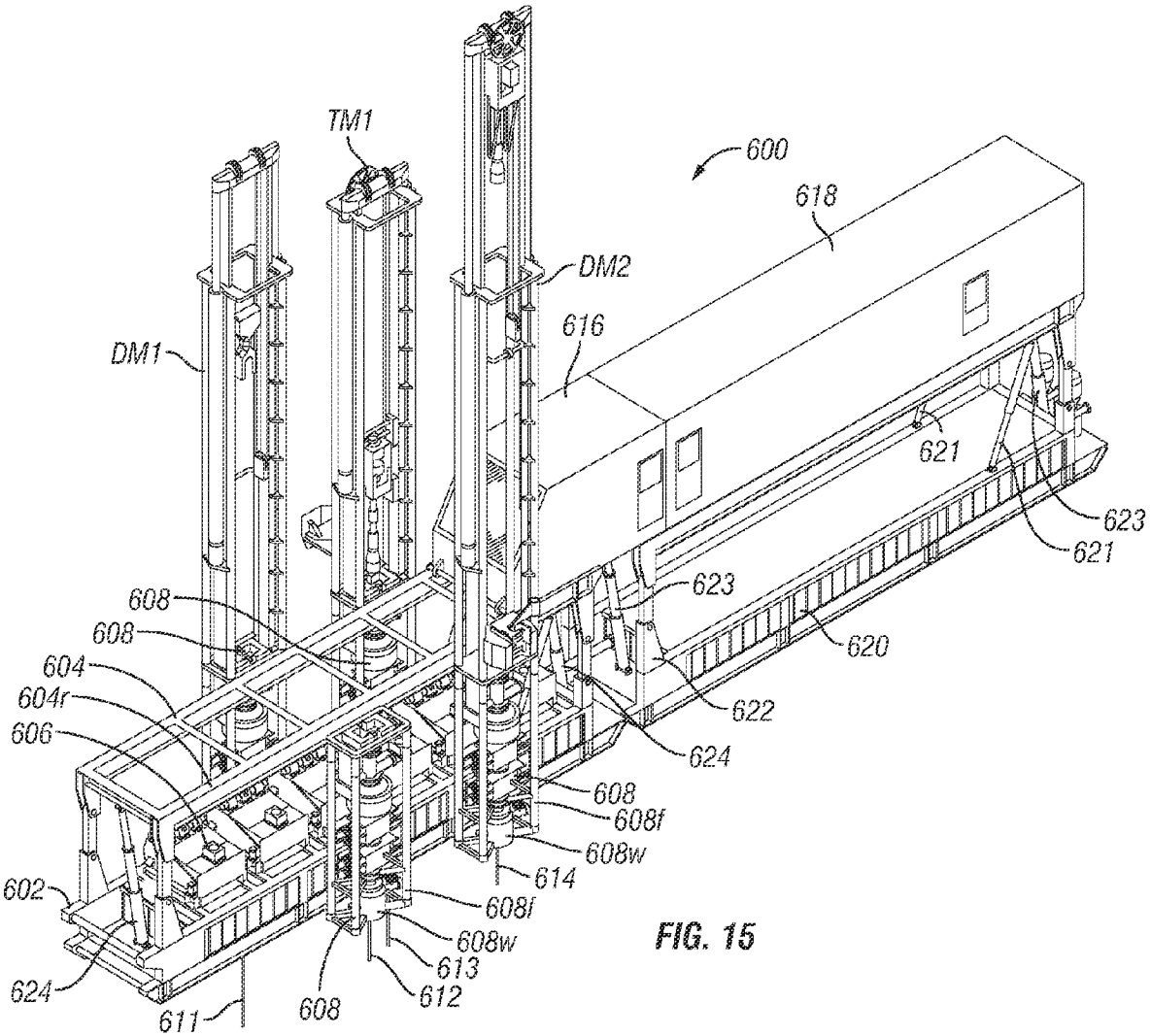
FIG. 15 is a perspective view of an illustrative system as disclosed herein.
Figure 15A:
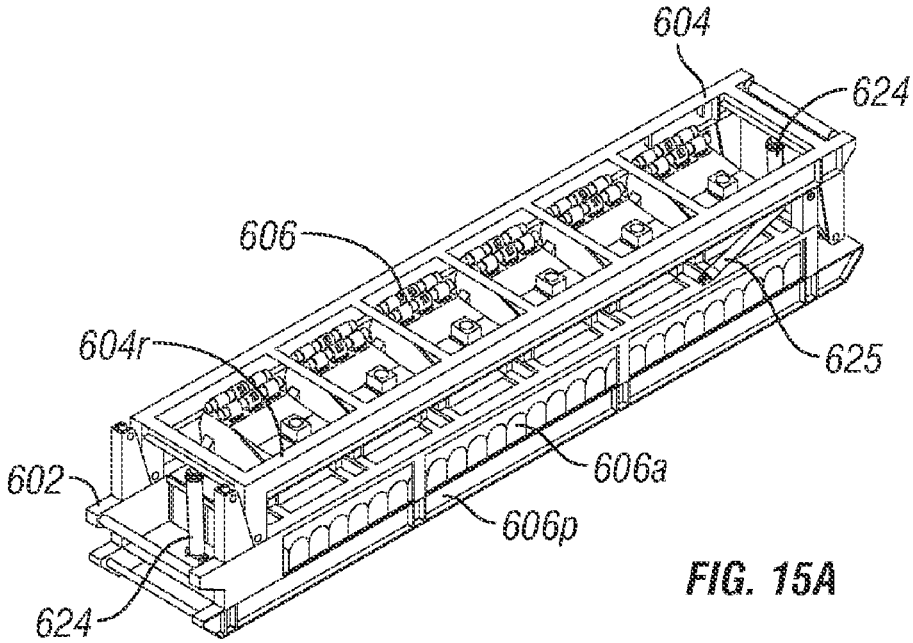
FIG. 15A is a perspective view of an illustrative rig floor and shaker pit of the system of FIG. 15 as disclosed herein.

FIG. 15 shows one illustrative embodiment of the present disclosure comprising a system 600 which includes an erectable rig structure 602 with a floor 604. In some embodiments, as shown in FIG. 15A, an active rig mud system 620, comprising a plurality of shale shakers 606 (supported by the rig structure 602) and a mud pit 606*p* may be disposed under the floor 604. In one particular embodiment, the active rig mud system 620 may also comprise an auger apparatus 606*a* for moving material in and from the mud pit 606*p*. The shakers 606 and the mud pit 606*p* may be located between the wellbore locations 611-614, and may also be adapted to be movable thereinto and therefrom as may be dictated by the specific application. FIG. 15D illustrates one embodiment of the active rig mud system 620 and its relationship to the rig structure 602 with the rig structure 602 in the fully erected position.

In some embodiments, pressure control equipment (generally indicated as 608) may be disposed proximate one or more of the wellbore locations 611-614, and may include such equipment as a flowline; a blowout preventer apparatus, a diverter apparatus, wellhead 608*w* and the like. As shown in FIG. 15, multiple blowout preventer stacks 608 may be located over each of the wellbore locations 611-614. In other embodiments disclosed herein, wells to be drilled at wellbore locations 611-614 may be spaced as close as eight feet or a far as twenty five feet from wellbore to wellbore, but it should be noted that any wellbore spacing may be used depending on the specific application. In one particular embodiment, the wellbores are spaced approximately fifteen feet apart.

A variety of machines may be used with the system 600 including, but not limited to, any machine used in any embodiment of any system disclosed herein. In one particular embodiment, two drilling machines DM1, DM2 and a tripping machine TM1 may each be connected to or disposed proximate to the rig structure 602. Any of the machines DM1, DM2, TM1 may be adapted to be movable to a position proximate any of the wellbore locations 611-614.

In some embodiments, one or more of the machines DM1, DM2, TM1 may be supported by the pressure control equipment 608. In such cases, the pressure control equipment 608 may be adapted to directly support drilling loads generated during drilling operations, such as the loads of the drilling machine DM1, DM2, a tubular string connected to the drilling machine, equipment connected to the tubular string, and the like. In yet other embodiments of the present disclosure, any one or all of the machines DM1, DM2, TM1 may be supported by a separate frame 608*f* disposed adjacent to or around the pressure control equipment 608, in which case the drilling loads generated during drilling operations as noted previously would be supported directly by the frame 608F.

As shown in FIG. 15, a driller's cabin 616 may also be disposed on the rig structure 602 and another cabin 618 (or an extension of the driller's cabin 616) may be disposed on an erection structure 622 above the active rig mud system 620. The erection structure 622 may comprise position locking apparatuses 621, and may further comprise powered erection apparatuses 623, 624 such as, for example, power cylinder apparatuses, lead screw apparatuses, motorized apparatuses and the like. In some embodiments, the driller's cabin 616 and/or cabin 618 may be adapted to be movable from one end of the rig structure 602 to the other. In those embodiments of the present disclosure wherein the machines DM1, DM2, TM1 are directly supported by the pressure control equipment 608, or alternatively by the frame 608*f*, the machines DM1, DM2, TM1 may advantageously be out of the way of a driller's cabin 616 as it moves on the rig structure 602. See, for example, FIG. 17N, described below.

Figure 15B:
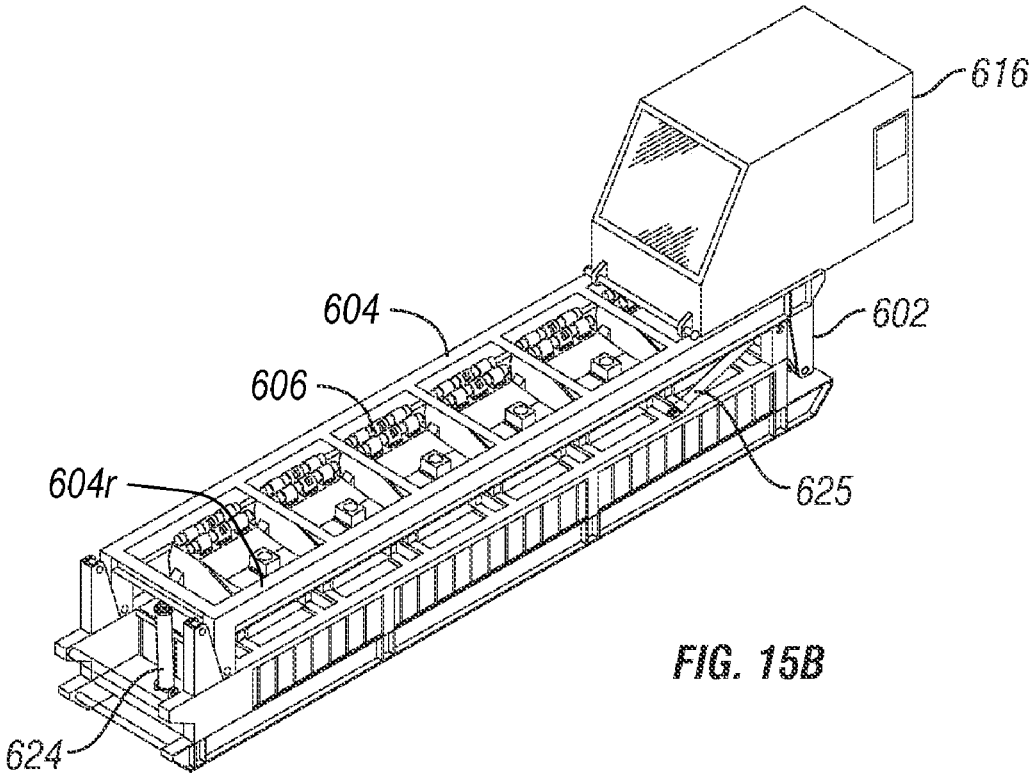
FIG. 15B a perspective view of driller's cabin on the rig floor of FIG. 15A as disclosed herein.
Figure 15C:
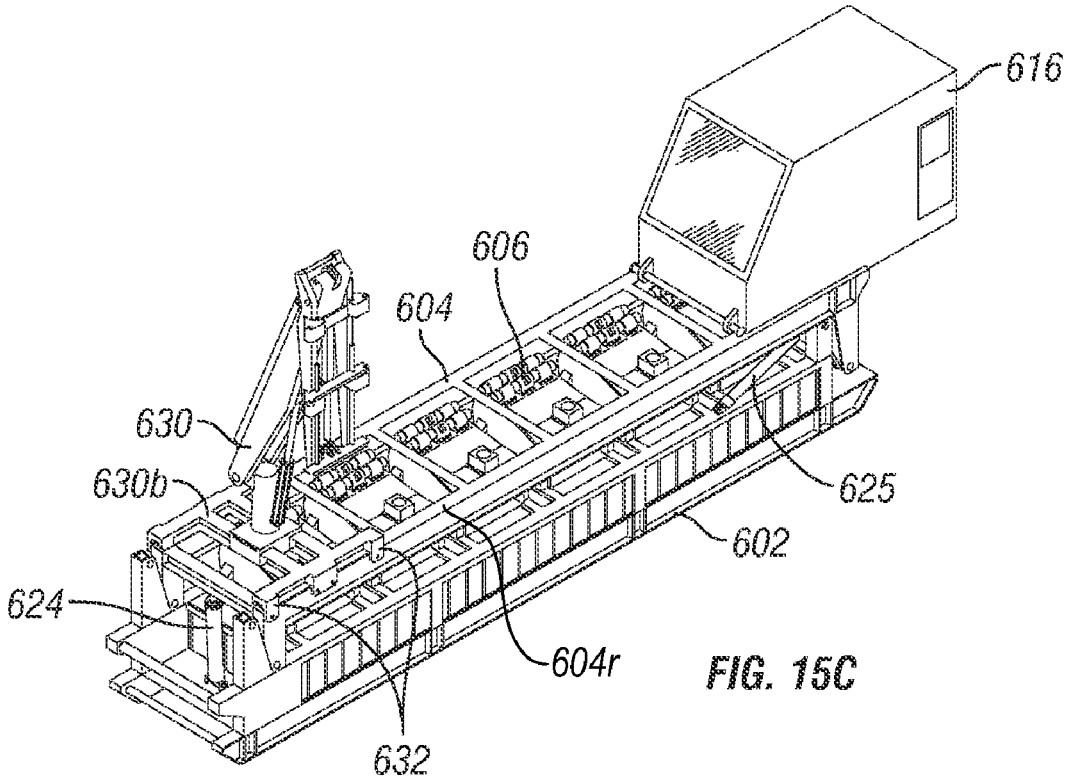
FIG. 15C is a perspective view of an illustrative crane on the rig floor of FIG. 15A as disclosed herein.
Figure 15D:
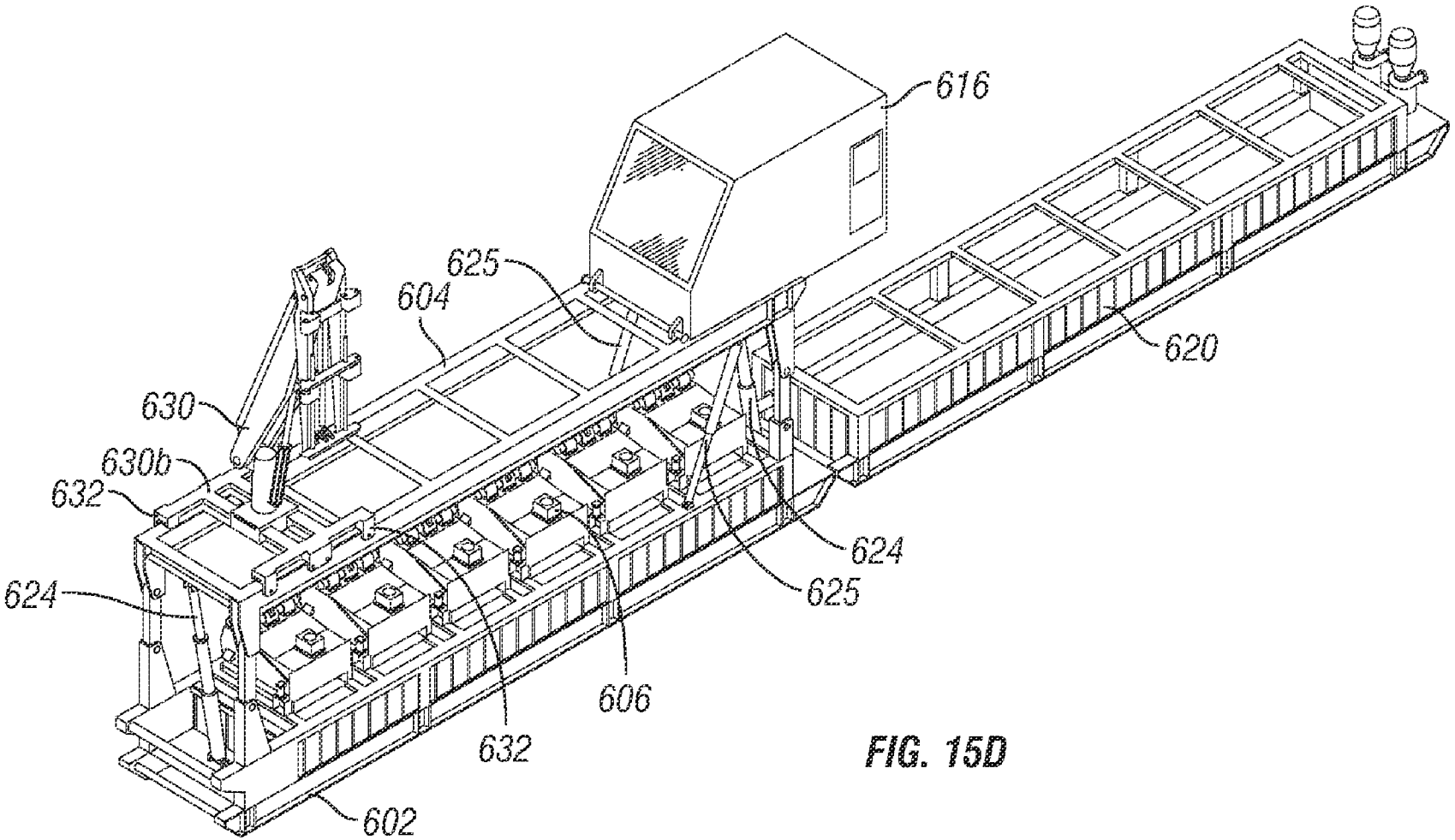
FIG. 15D is a perspective view of the illustrative system parts of FIG. 15B with an active mud system as disclosed herein.

As illustrated in FIG. 15B, the driller's cabin 616 may be disposed on the floor 604 of the rig structure 602. Additionally, in particular embodiments as shown in FIG. 15A, the rig floor 604 may comprise rails 604*r* adapted to facilitate the movement of equipment and other apparatus along the length of the rig structure 602. FIG. 15C illustrates one embodiment wherein a crane 630 may be disposed on the rails 604*r* of the floor 604, and in specific embodiments, the crane 630 may comprise a base 630*b* and roller apparatuses 632 adapted to engage with and move on the rails 604*r*.

Figure 16A:
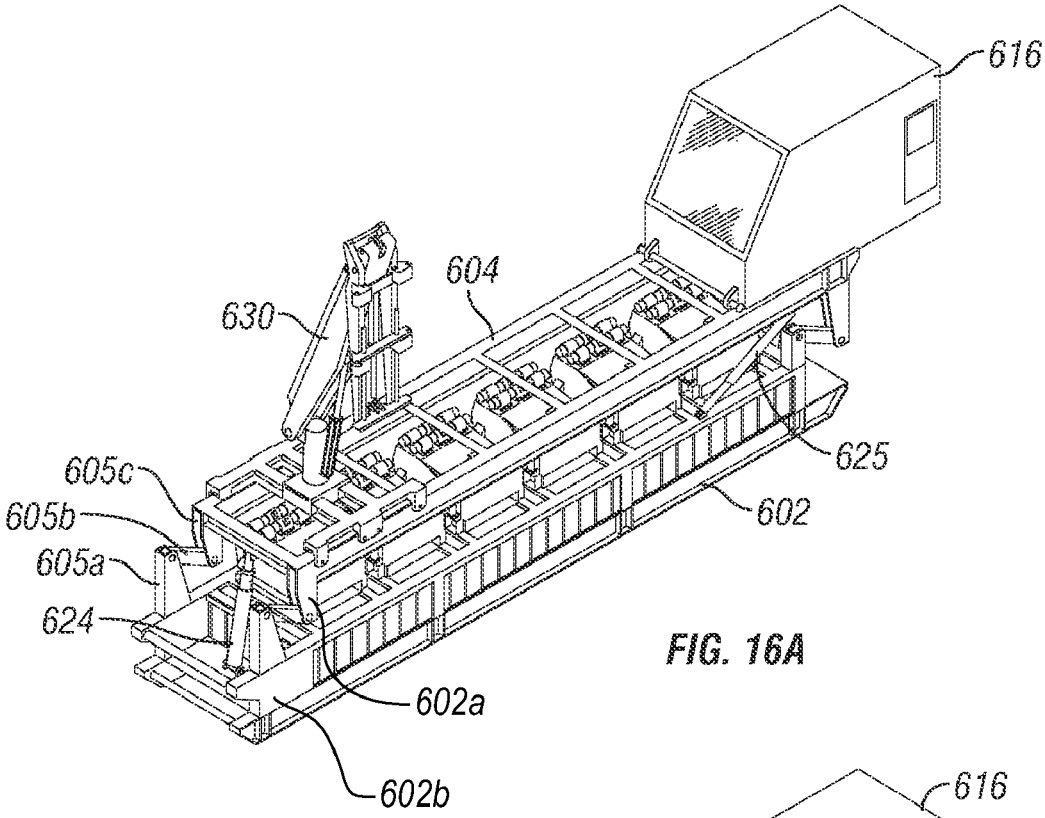
FIG. 16A is a perspective view showing an illustrative step in the erection of the rig floor of FIG. 15A as disclosed herein.
Figure 16B:
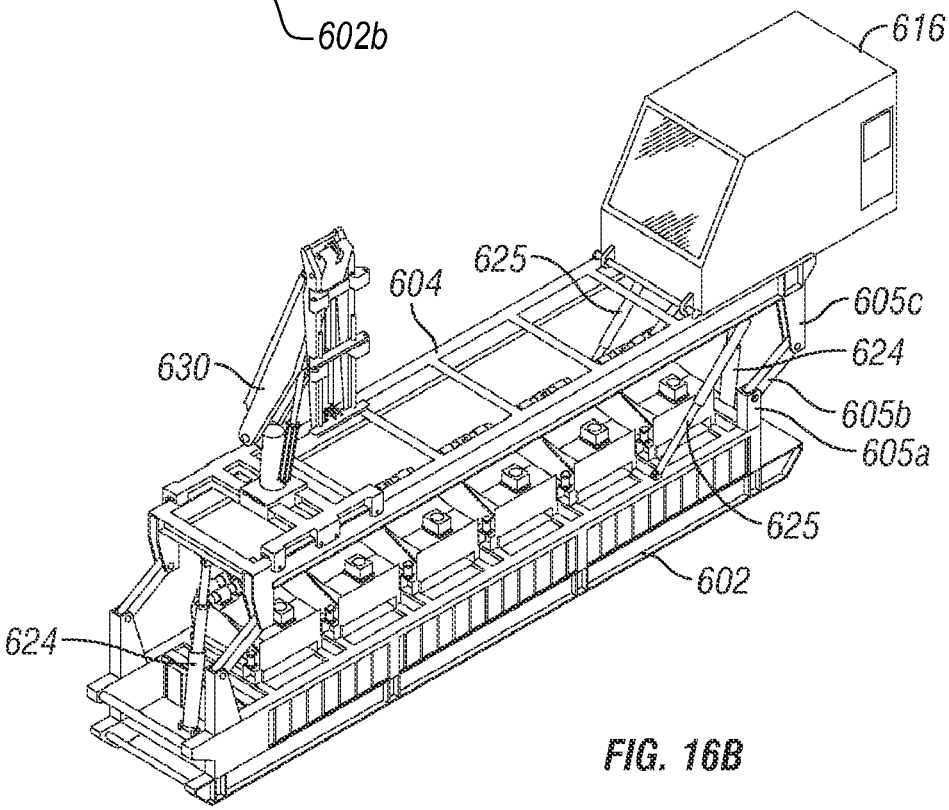
FIG. 16B is a perspective view showing an illustrative step in the erection of the rig floor of FIG. 15A as disclosed herein.
Figure 16C:
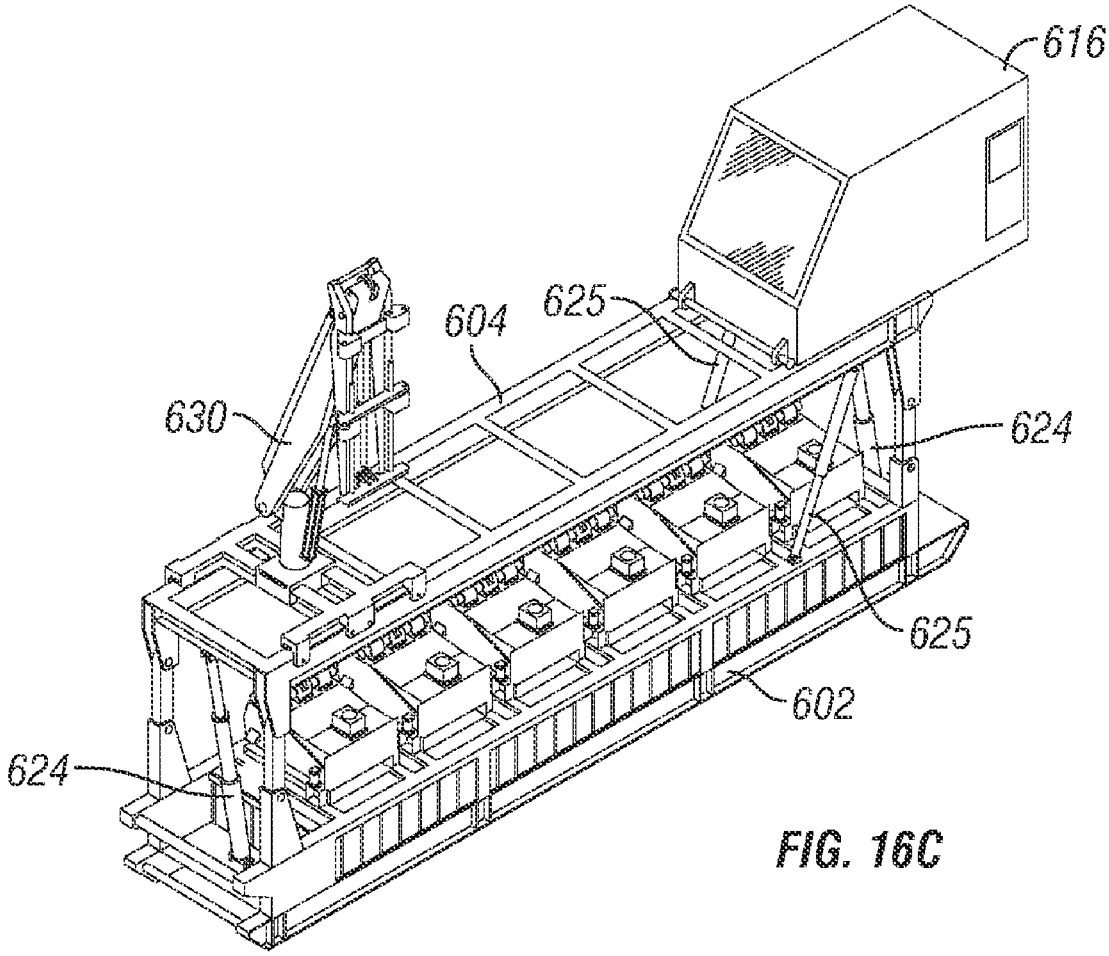
FIG. 16C is a perspective view showing an illustrative step in the erection of the rig floor of FIG. 15A as disclosed herein.

FIGS. 16A-16C illustrate various steps in the erection of the rig structure 602. Powered cylinder apparatuses 624 adapted to erect the rig structure 602 are connected between a top 602*a* and a bottom 602*b* of the rig structure 602. In operation, the powered cylinder apparatuses 624 are energized and the rig structure 602 begins to rise. FIGS. 16A 16B shows two illustrative positions of the rig structure 602 as it continues to rise. FIG. 16C further shows the rig structure 602 after it has reached its full height and is locked in place with locking apparatuses 625. As shown in FIGS. 16A and 16B, the rig structure 602 comprises four multi-part legs (generally indicated as 605), each multi-part leg comprising a base 605*a*, a pivotably connected mid-section 605*b* and an upper part 605*c*.

Figure 17A:
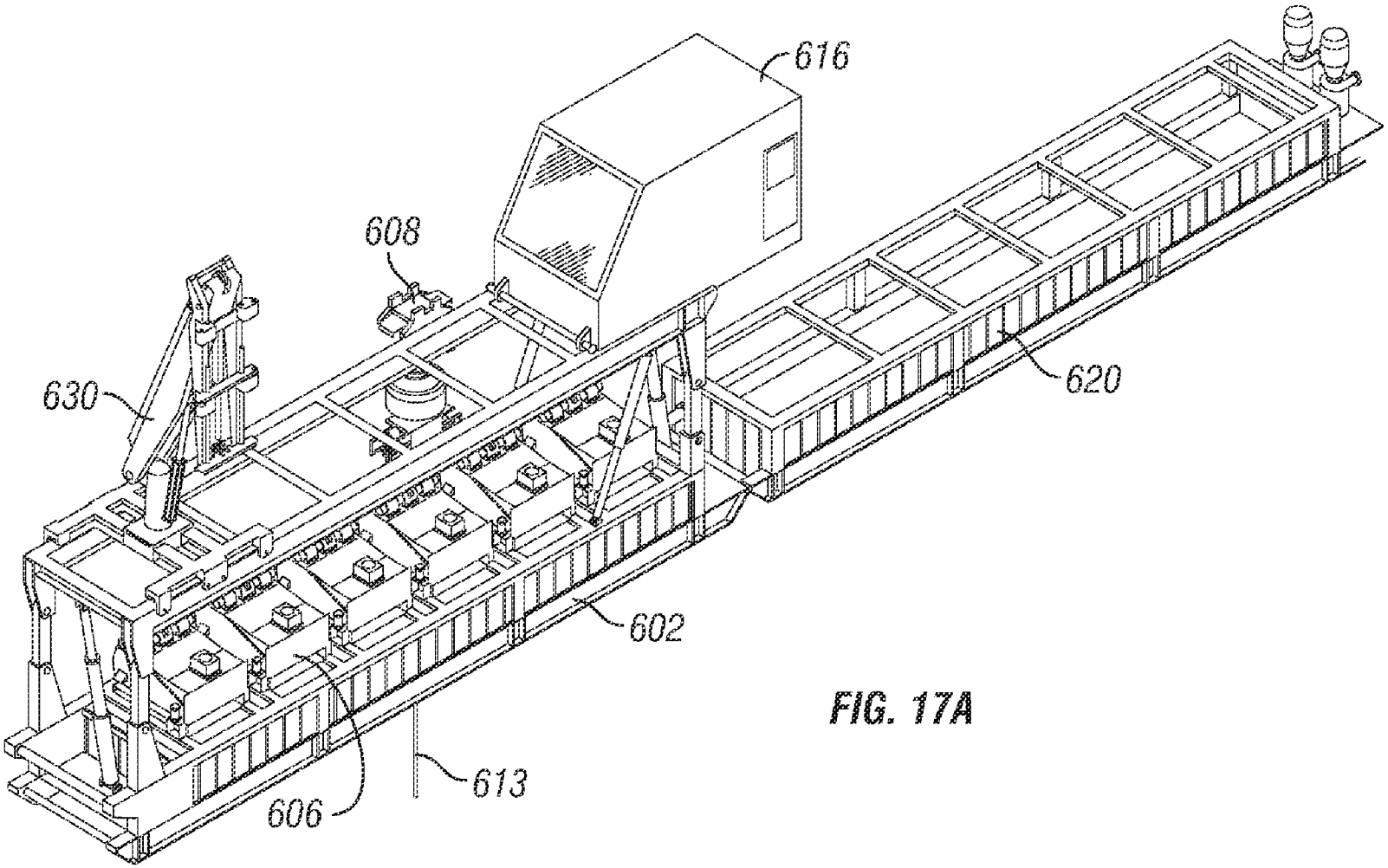
FIG. 17A is a perspective view showing a step in the illustrative method using the system of FIG. 15 as disclosed herein.
Figure 17B:
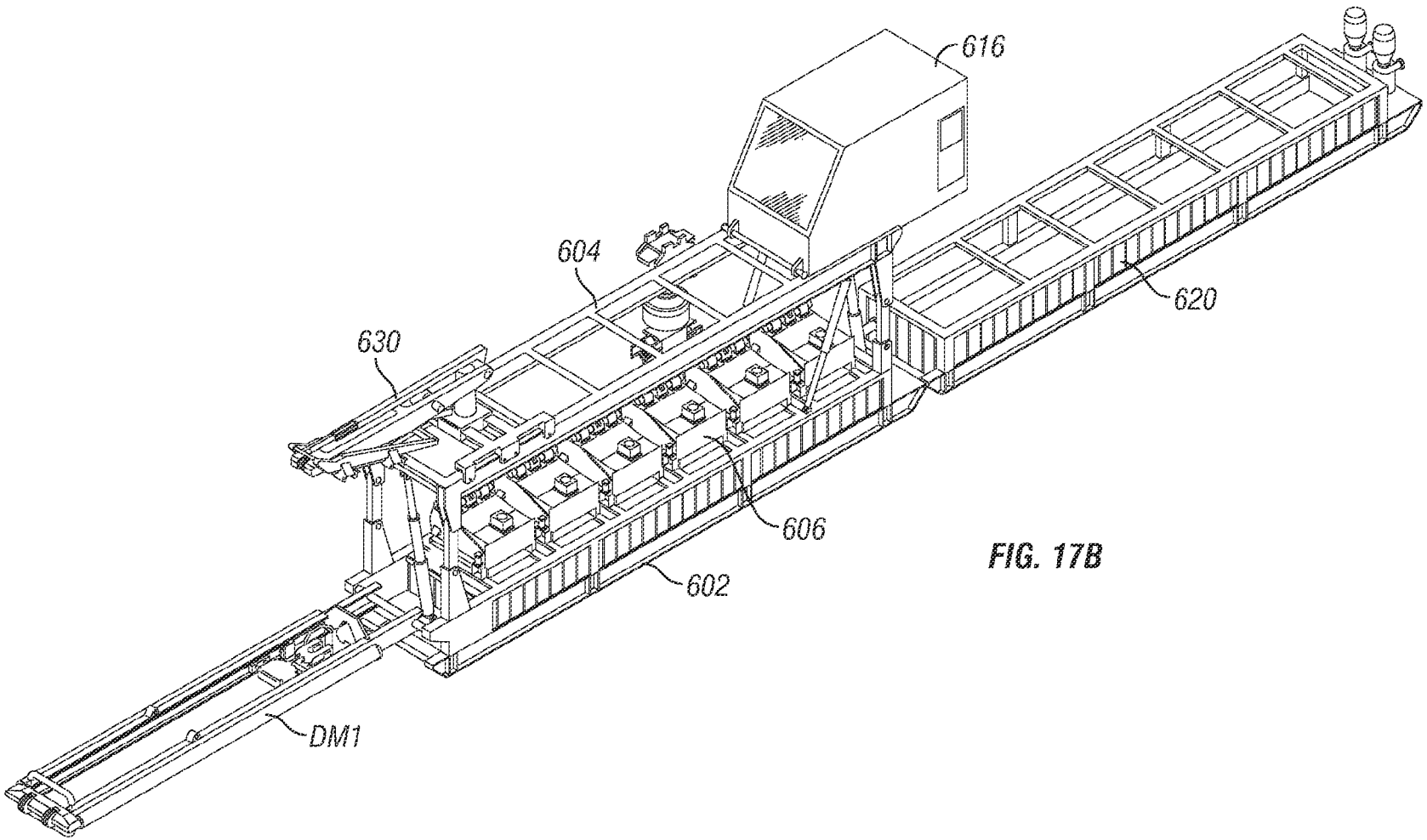
FIG. 17B is a perspective view showing a step in the illustrative method using the system of FIG. 15 as disclosed herein.
Figure 17C:
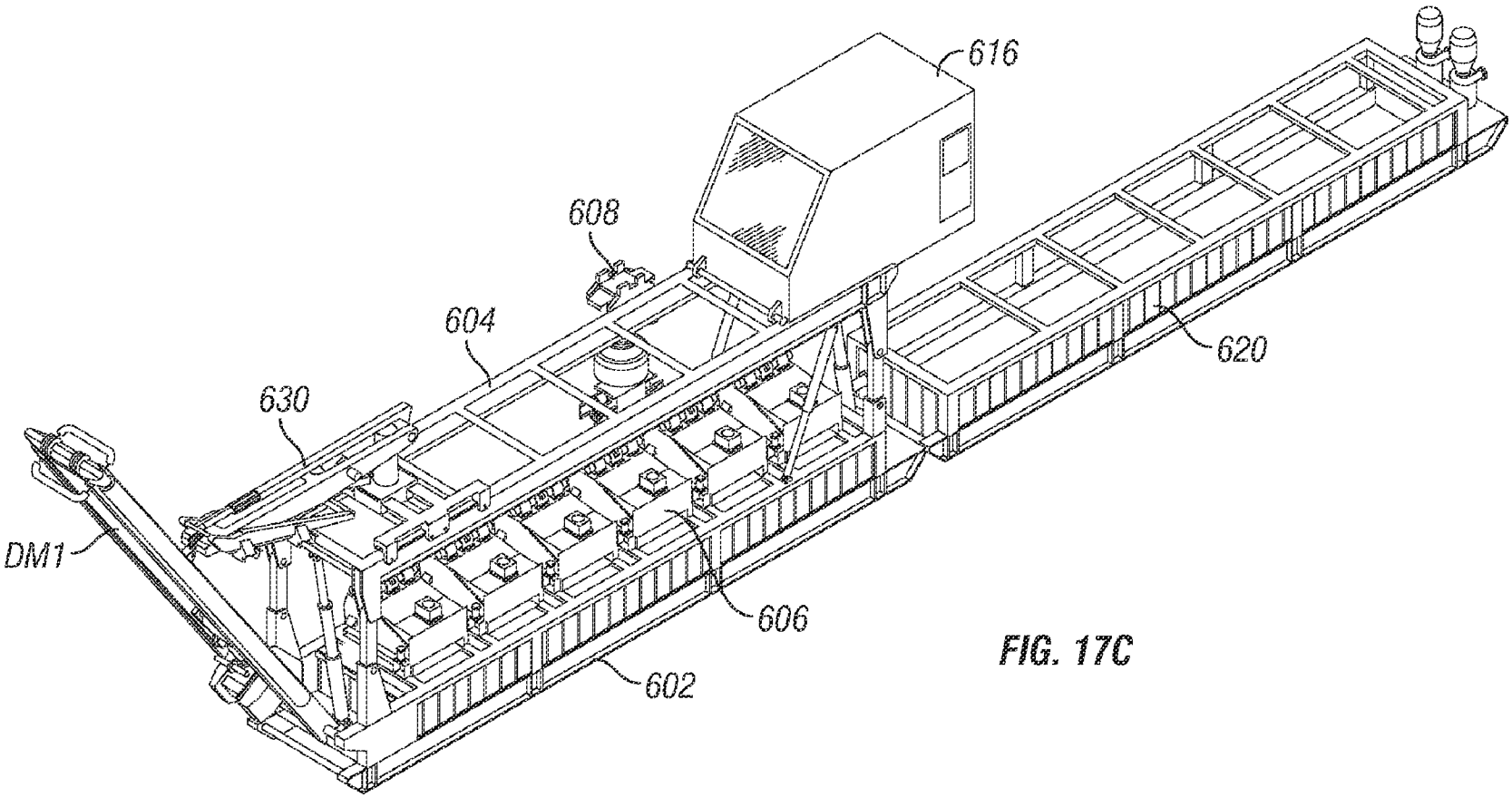
FIG. 17C is a perspective view showing a step in the illustrative method using the system of FIG. 15 as disclosed herein.
Figure 17D:
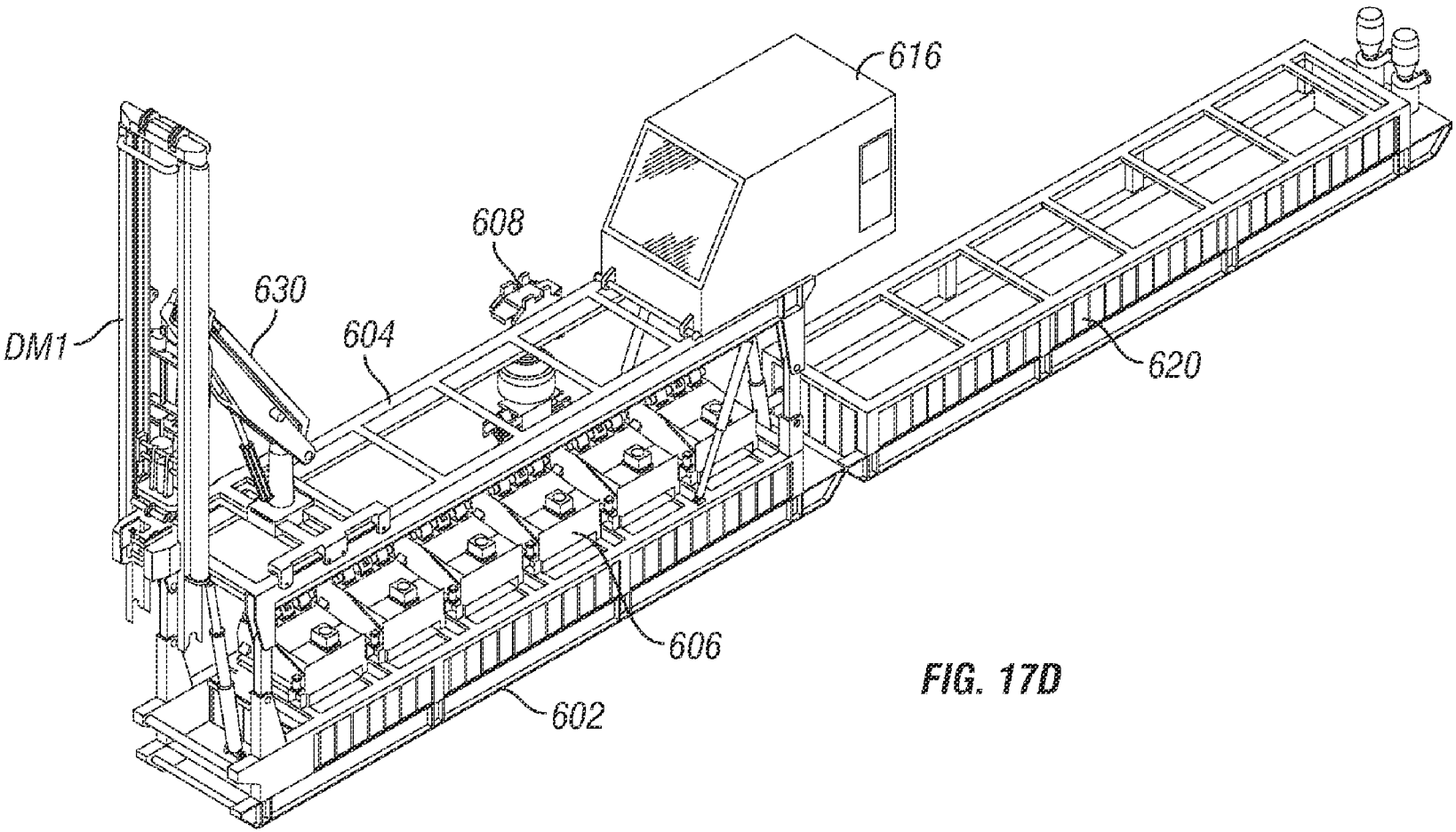
FIG. 17D is a perspective view showing a step in the illustrative method using the system of FIG. 15 as disclosed herein.
Figure 17E:
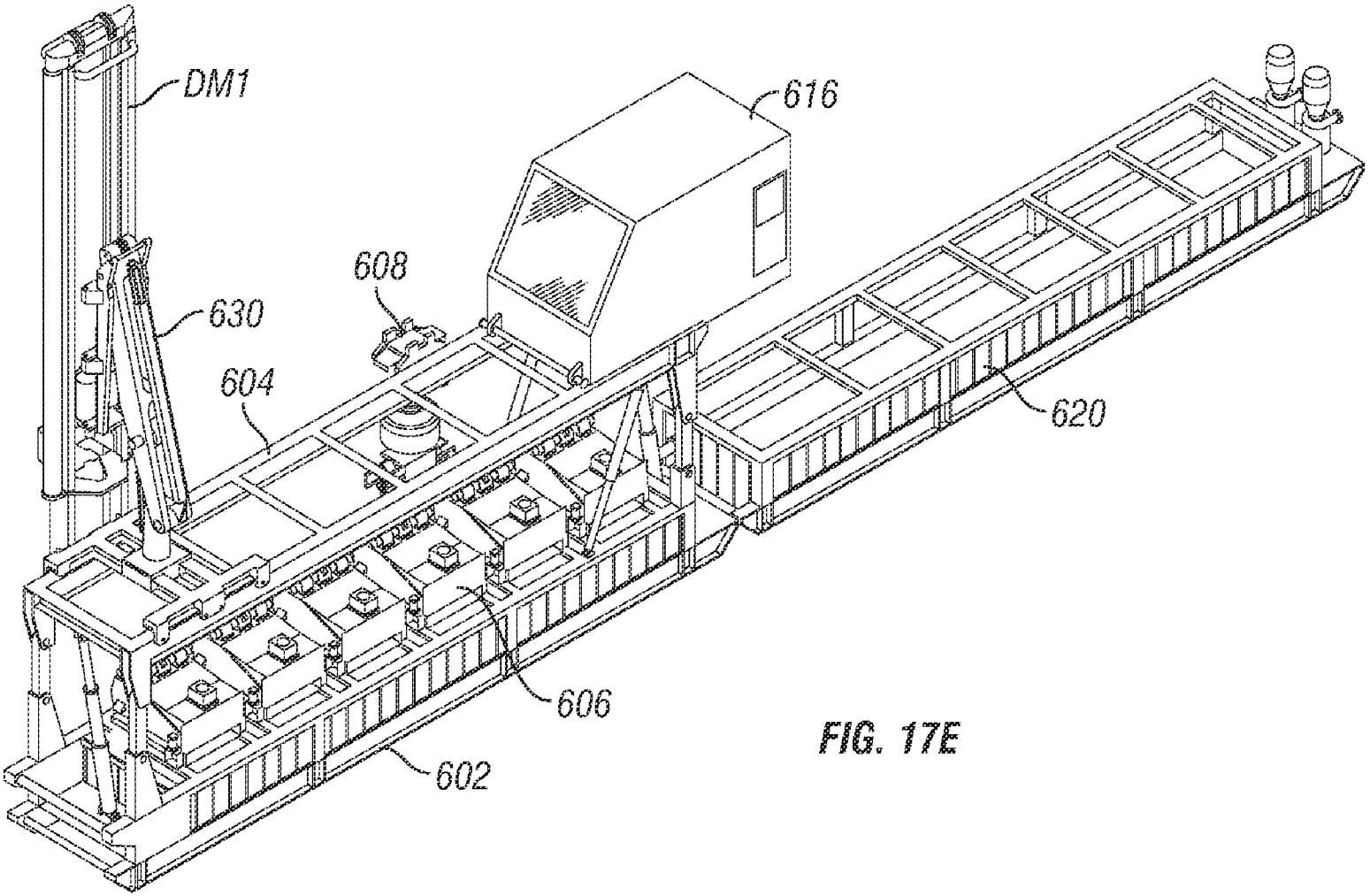
FIG. 17E is a perspective view showing a step in the illustrative method using the system of FIG. 15 as disclosed herein.
Figure 17F:
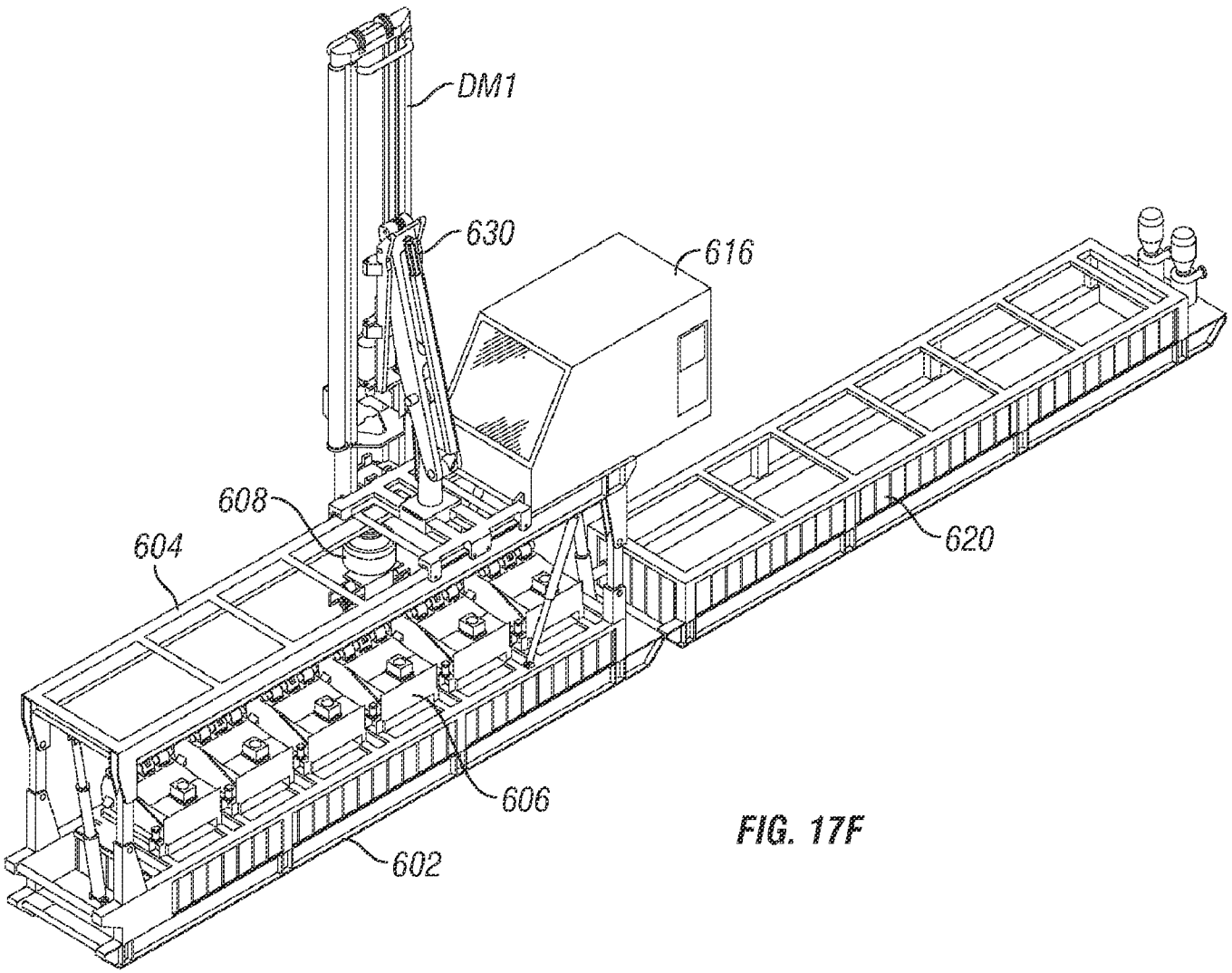
FIG. 17F is a perspective view showing a step in the illustrative method using the system of FIG. 15 as disclosed herein.
Figure 17G:
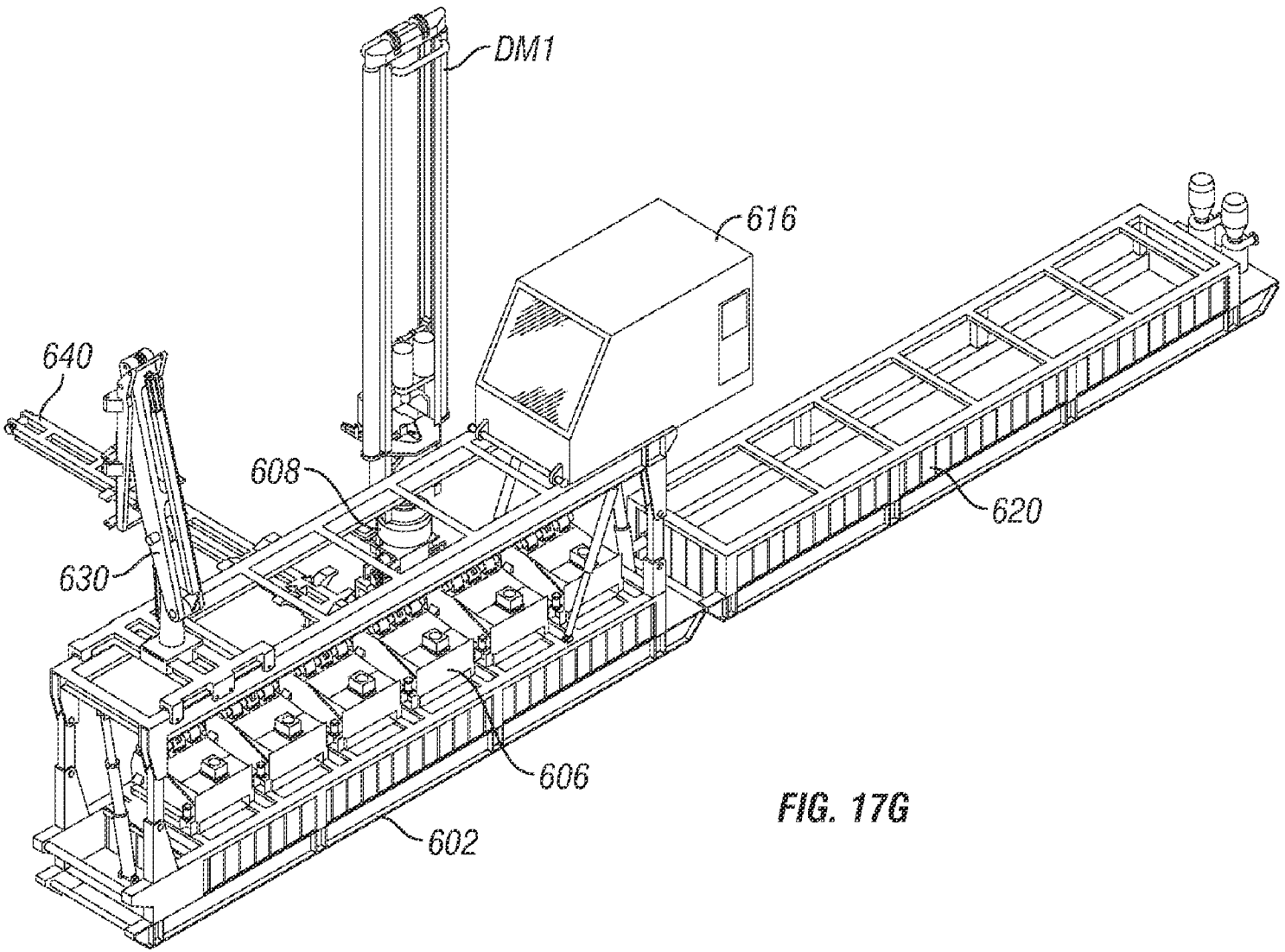
FIG. 17G is a perspective view showing a step in the illustrative method using the system of FIG. 15 as disclosed herein.
Figure 17H:
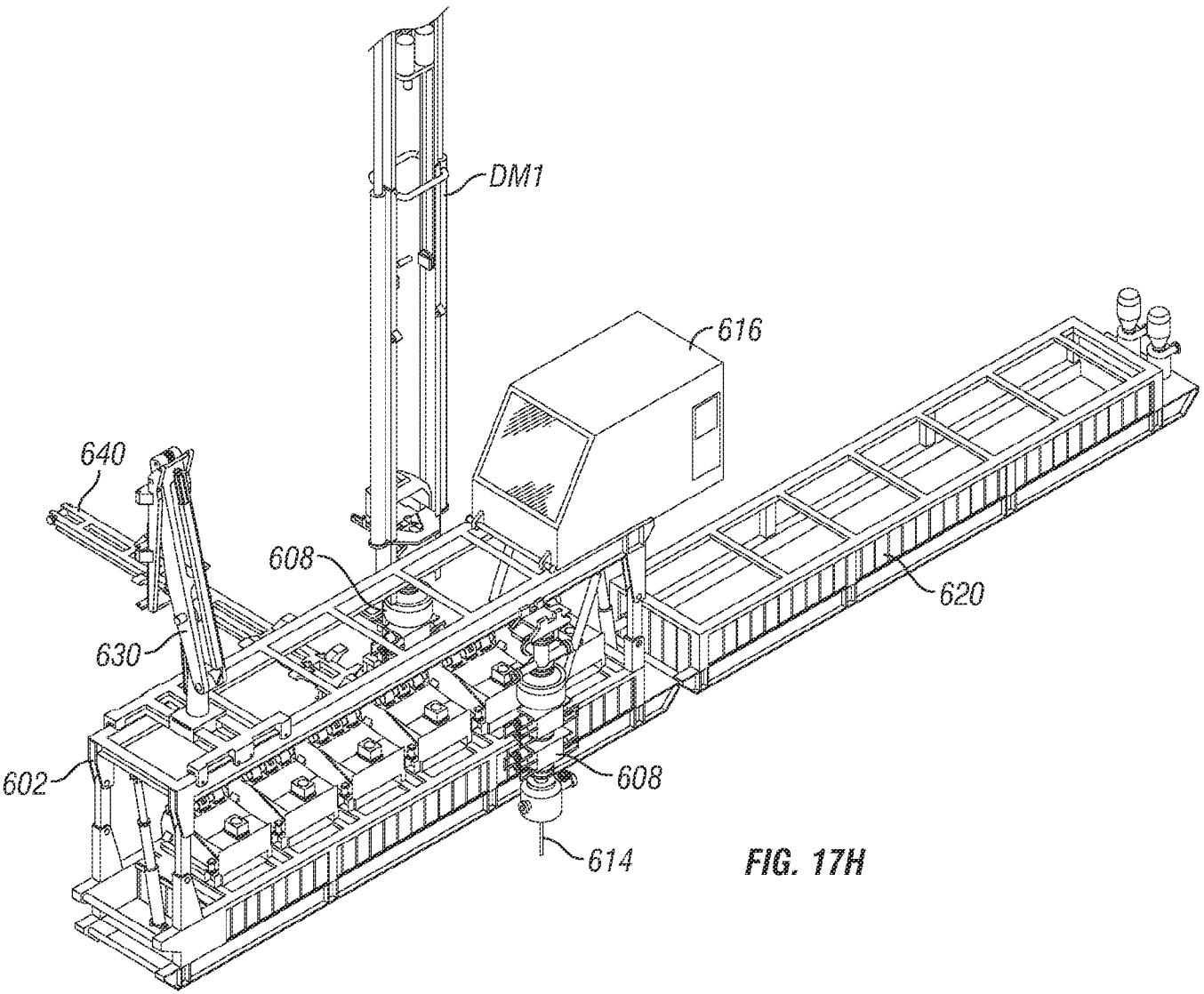
FIG. 17H is a perspective view showing a step in the illustrative method using the system of FIG. 15 as disclosed herein.
Figure 17I:
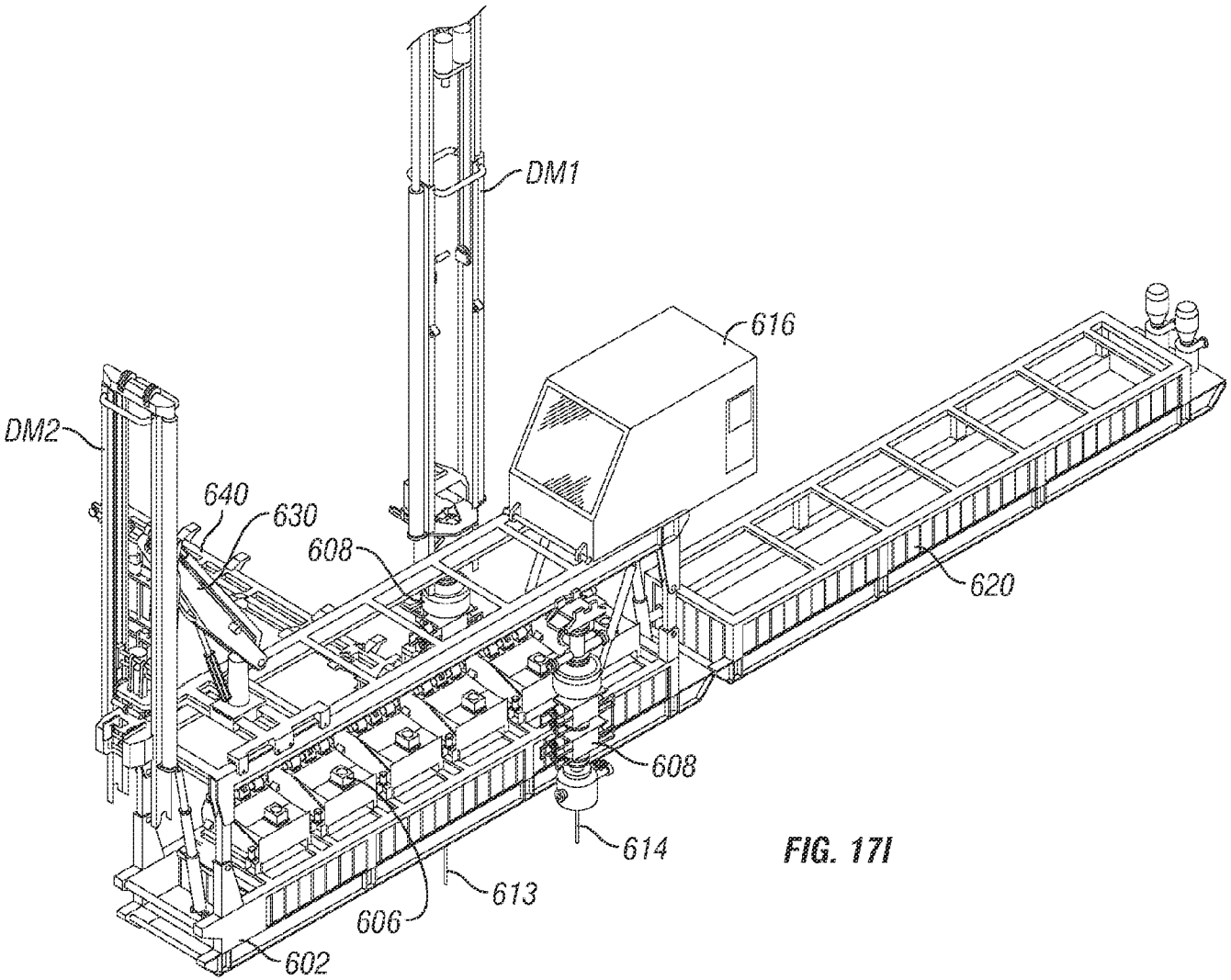
FIG. 17I is a perspective view showing a step in the illustrative method using the system of FIG. 15 as disclosed herein.
Figure 17J:
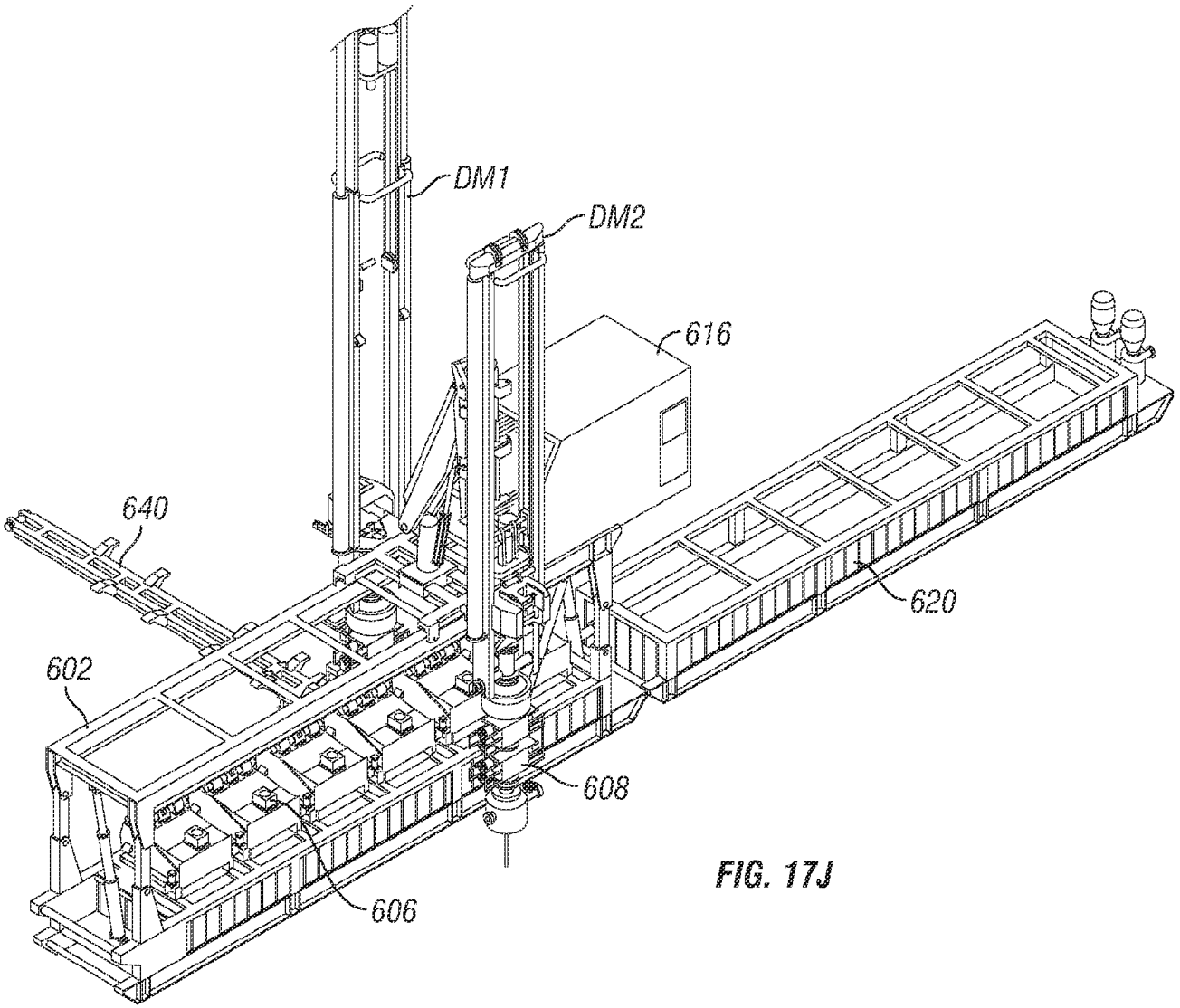
FIG. 17J is a perspective view showing a step in the illustrative method using the system of FIG. 15 as disclosed herein.
Figure 17K:
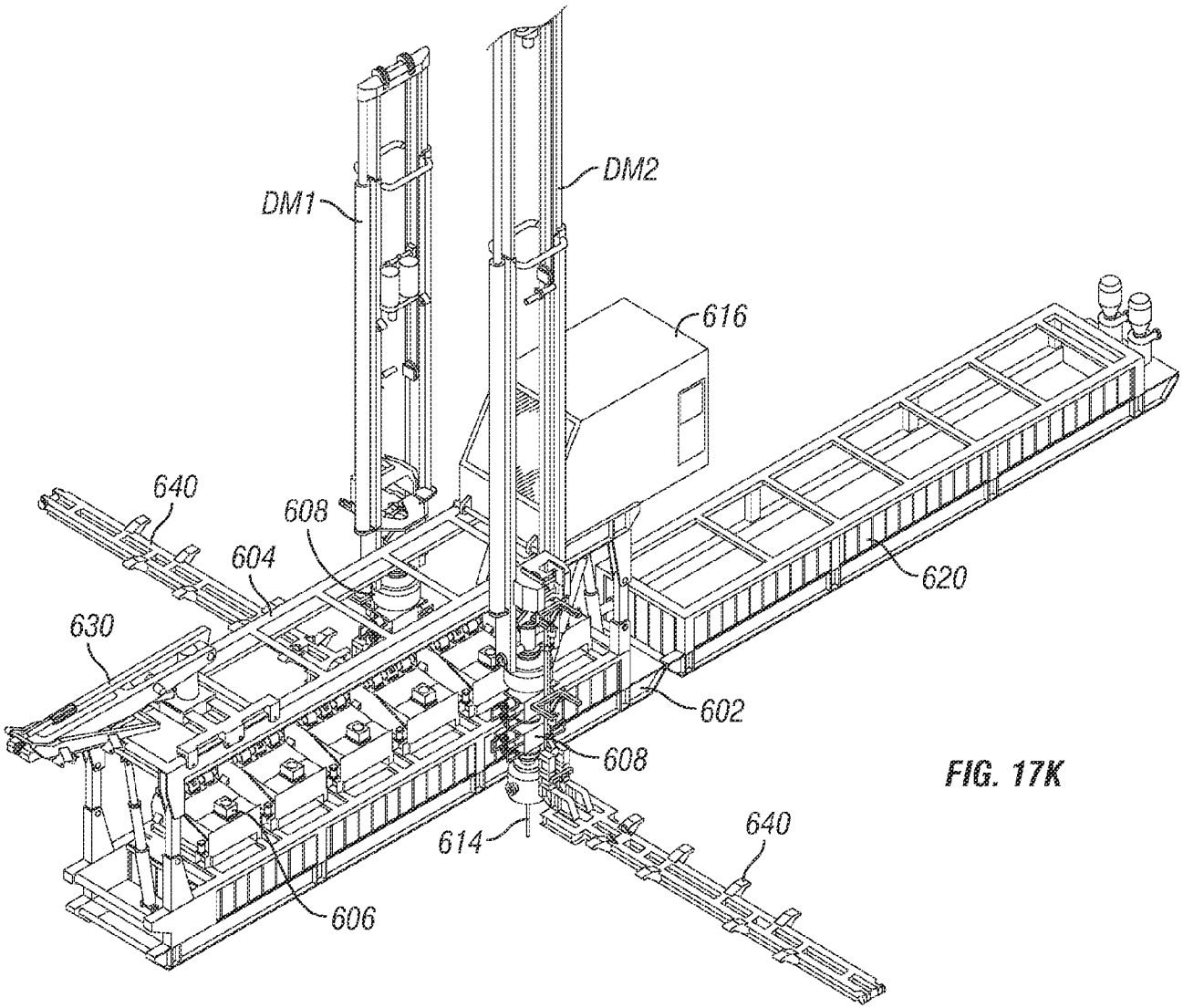
FIG. 17K is a perspective view showing a step in the illustrative method using the system of FIG. 15 as disclosed herein.
Figure 17L:
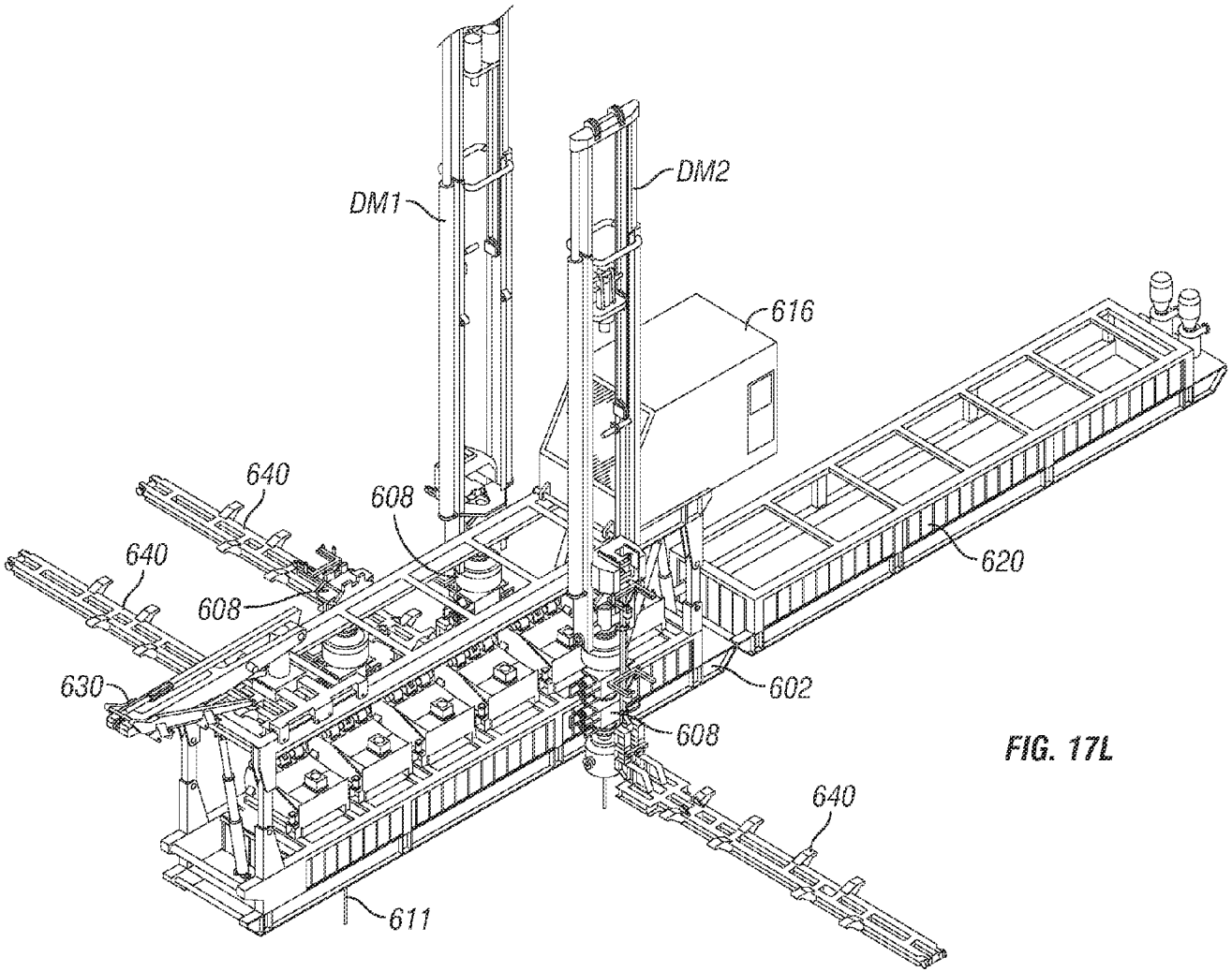
FIG. 17L is a perspective view showing a step in the illustrative method using the system of FIG. 15 as disclosed herein.
Figure 17M:
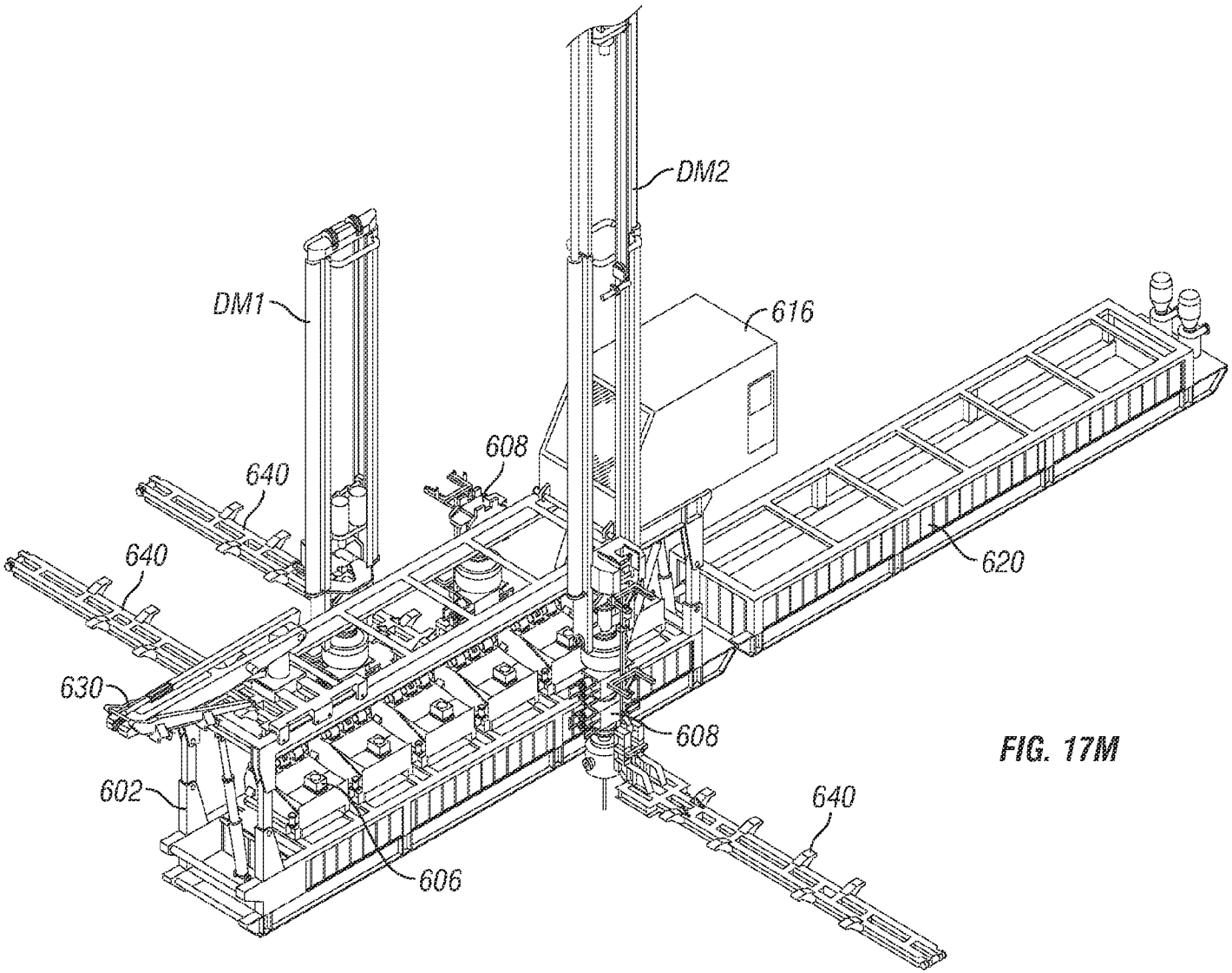
FIG. 17M is a perspective view showing a step in the illustrative method using the system of FIG. 15 as disclosed herein.
Figure 17N:
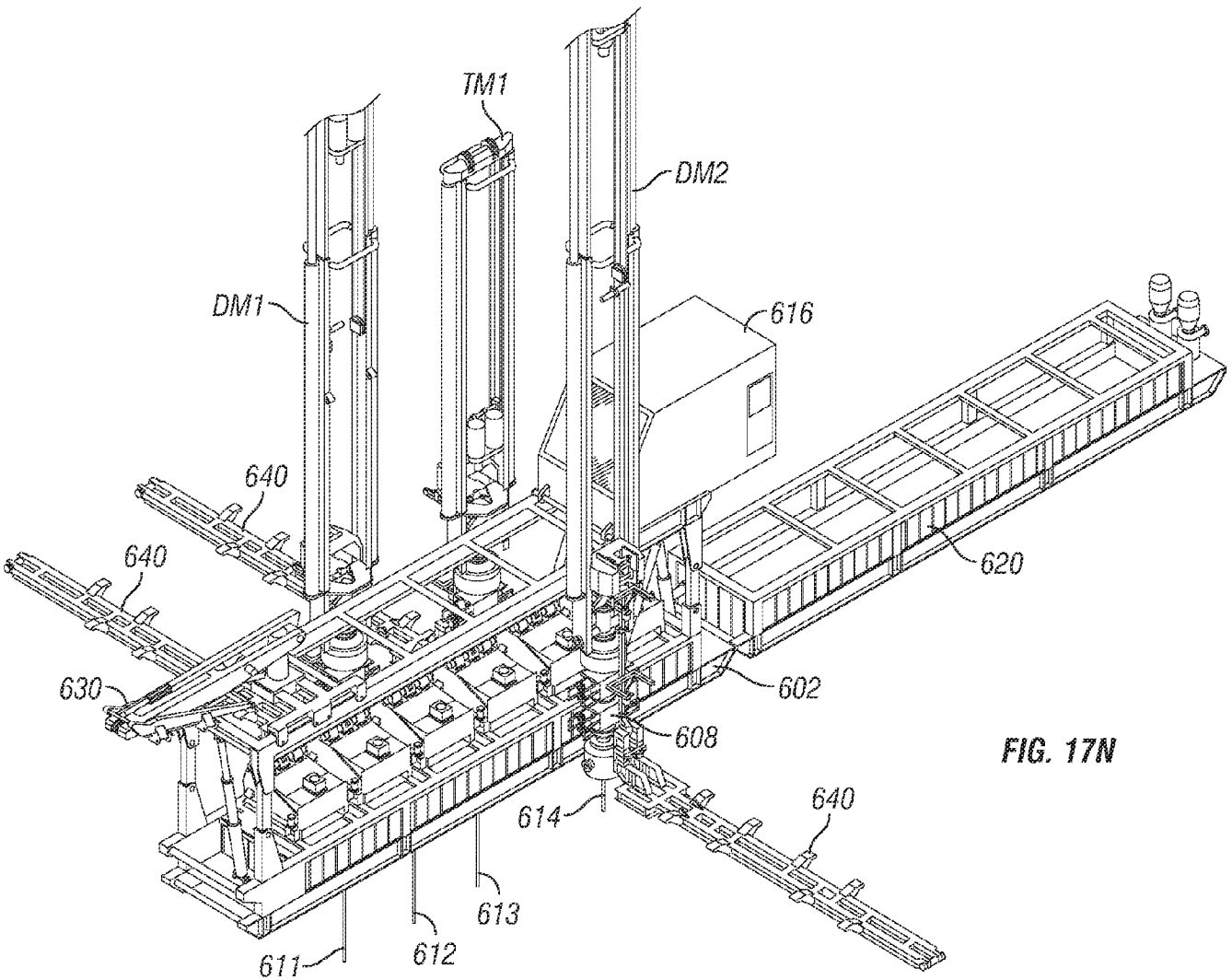
FIG. 17N is a perspective view showing a step in the illustrative method using the system of FIG. 15 as disclosed herein.
Figure 170:
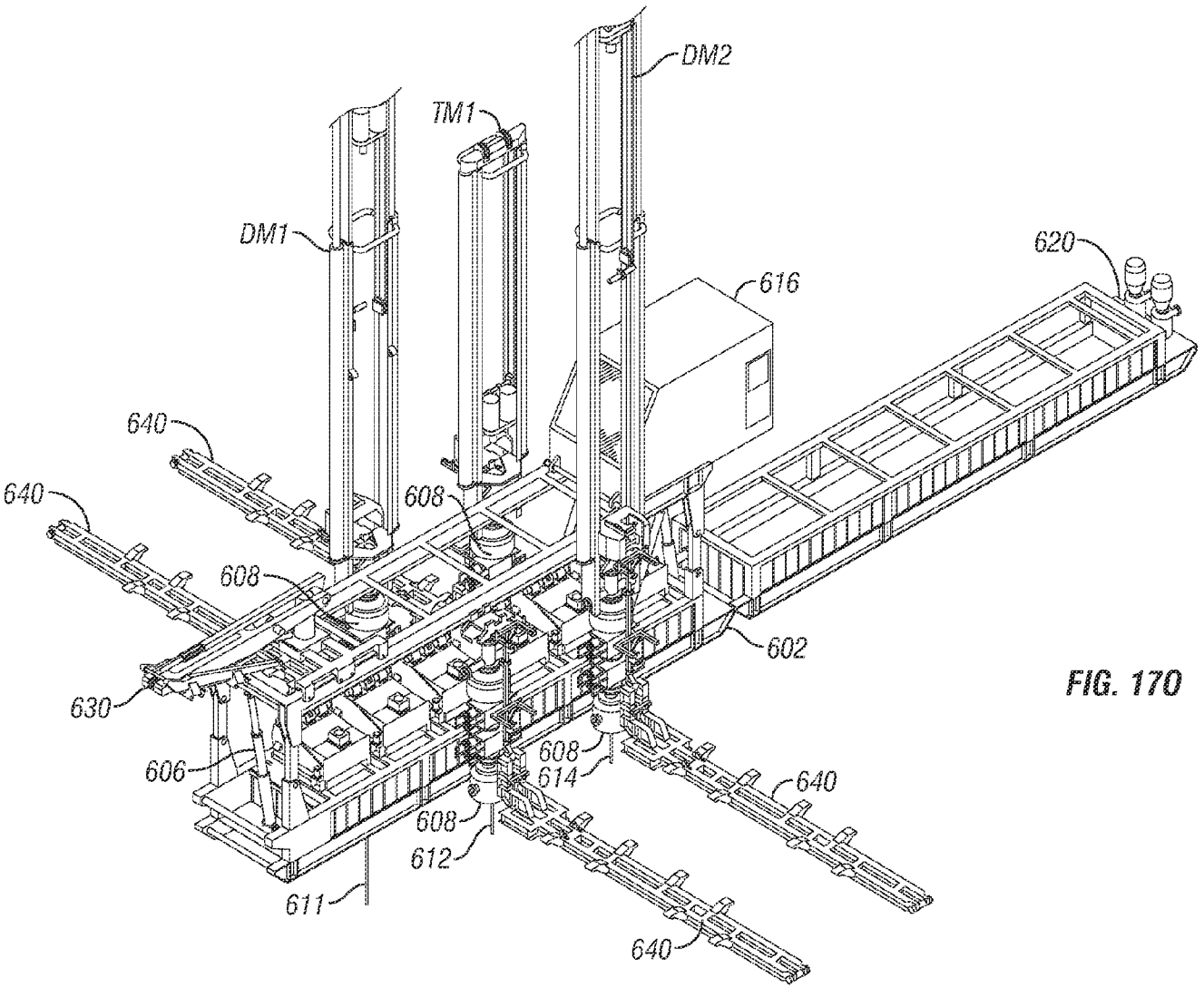
Figure 17P:
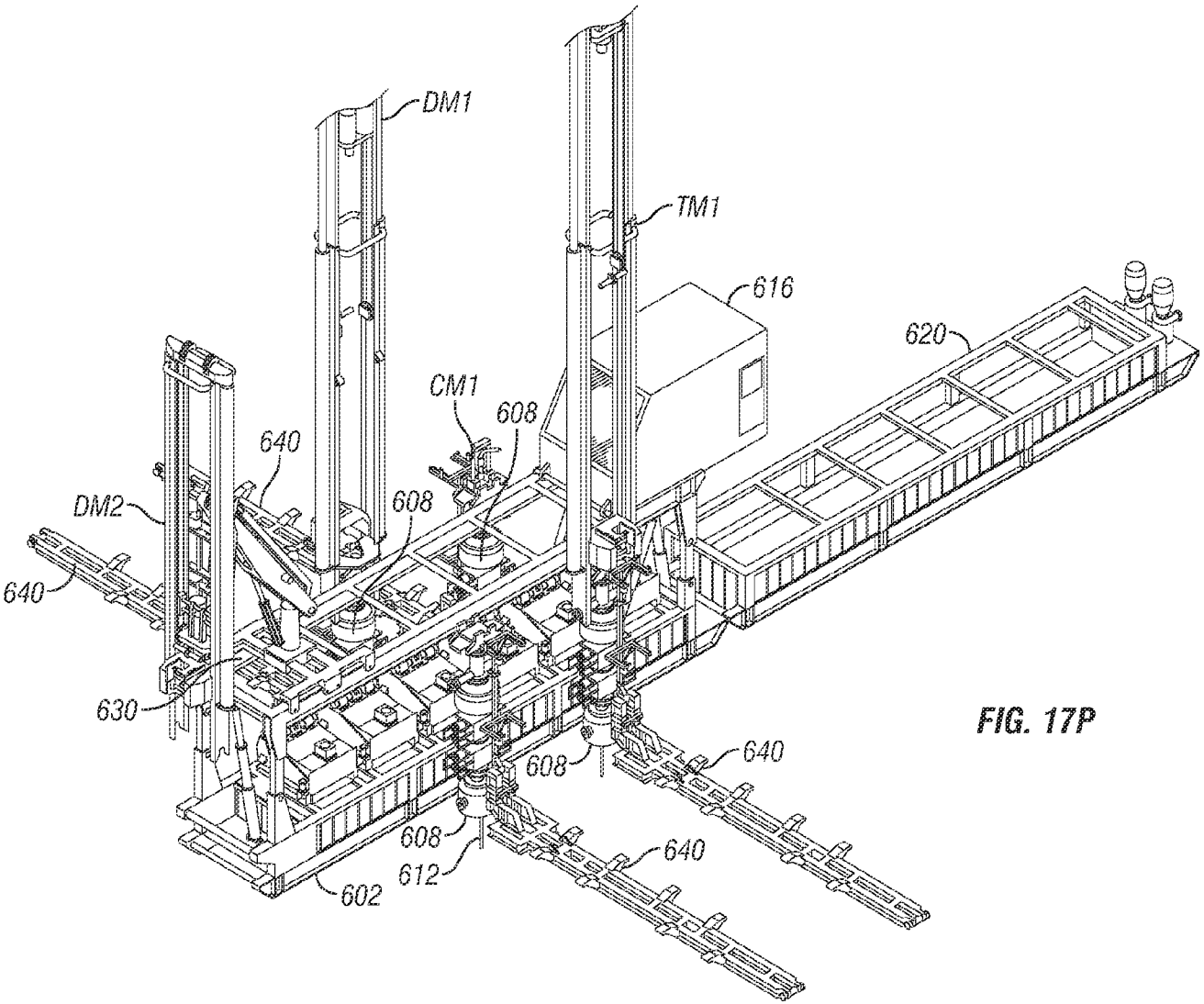
FIG. 17P is a perspective view showing a step in the illustrative method using the system of FIG. 15 as disclosed herein.
Figure 17Q:
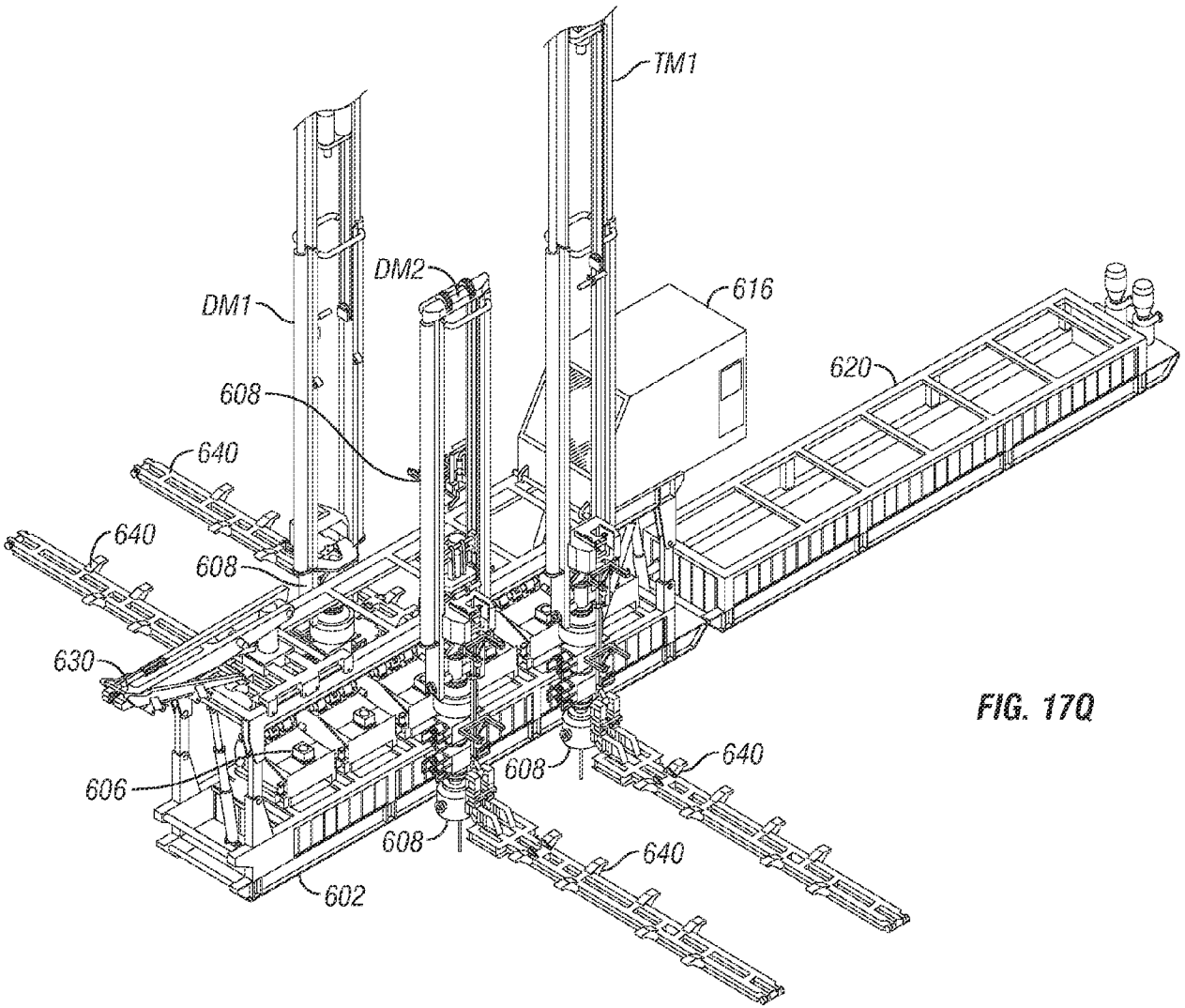
FIG. 17Q is a perspective view showing a step in the illustrative method using the system of FIG. 15 as disclosed herein.
Figure 17R:
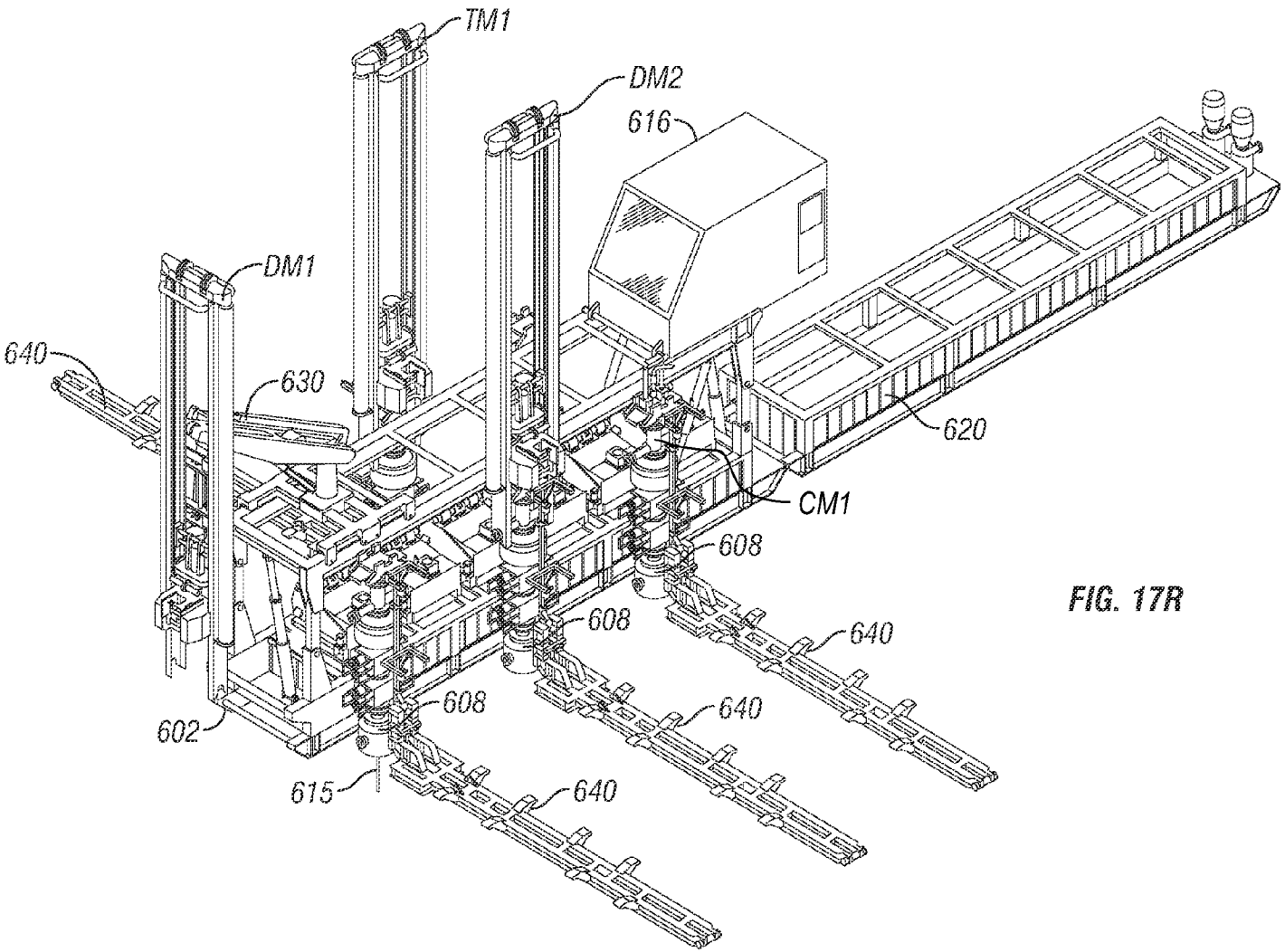
FIG. 17R is a perspective view showing a step in the illustrative method using the system of FIG. 15 as disclosed herein.
Figure 17S:
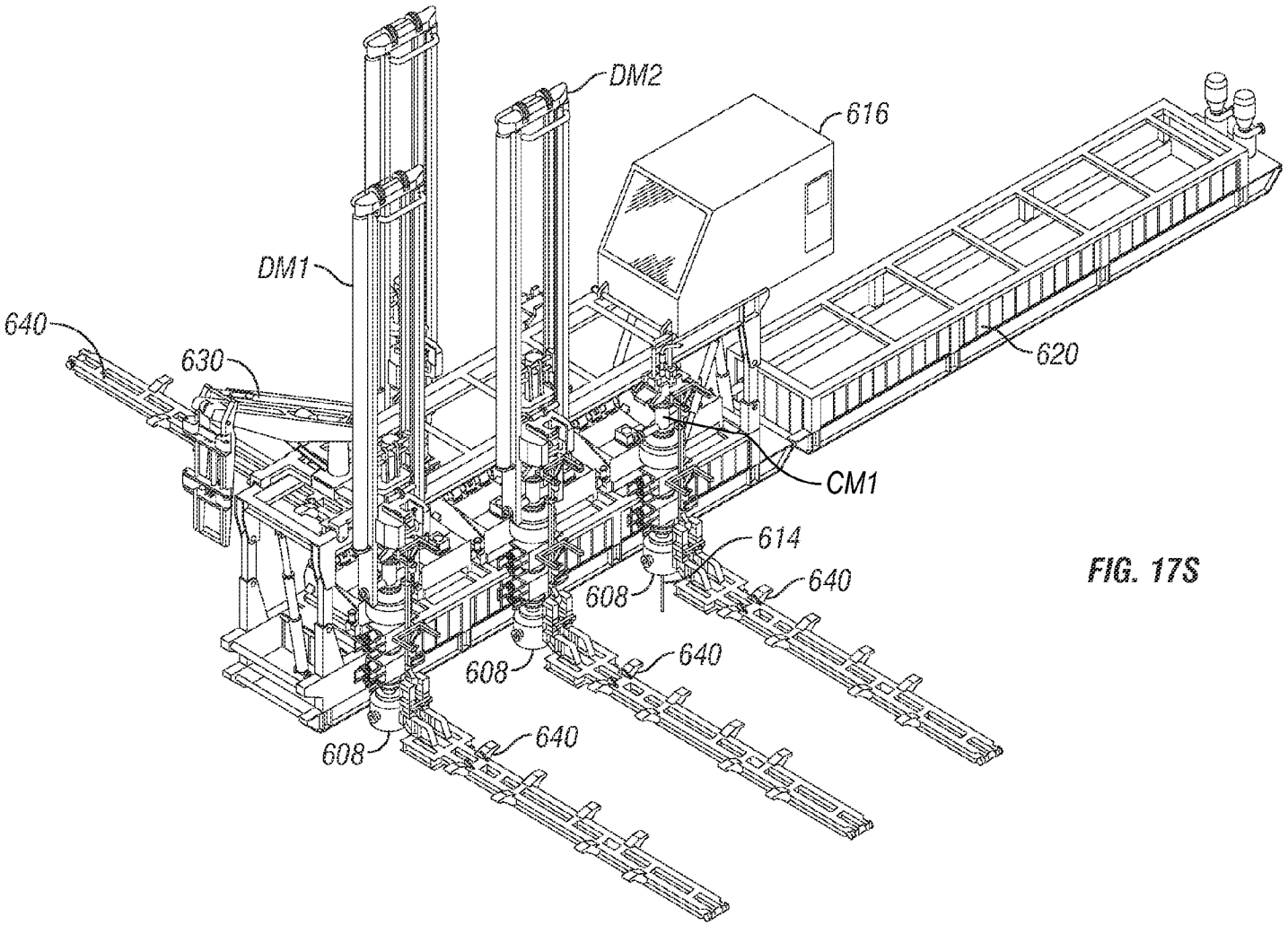
FIG. 17S is a perspective view showing a step in the illustrative method using the system of FIG. 15 as disclosed herein.

FIGS. 17A-17S show various steps that may be employed in one method of operating a multi-function rig using the system 600 according to one illustrative embodiment of the present disclosure. The following description of the various embodiments illustrated in FIGS. 17A-17S should only be considered as representative of the method or methods described herein, as many of the steps may be performed in a different sequence, may include additional steps not described, or may be eliminated altogether without materially affecting the subject matter disclosed herein.

As shown in FIG. 17A, a blowout preventer stack 608 may be lifted by lifting apparatus, such as, for example, a crane 630 and the like, and placed in position over wellbore location 613. Thereafter, as illustrated in FIG. 17B, a drilling machine DM1 may be moved proximate one end of the rig structure 602 opposite the end with the driller's cabin 616. The crane 630 may then proceed to begin lifting the drilling machine DM1. FIG. 17C shows one illustrative position of the drilling machine DM1 as it is being lifted by the crane 630, and FIG. 17D illustrates the crane 630 holding the drilling machine DM1 upright at the end of the rig structure 602. FIG. 17E further shows the drilling machine DM1 after it has been rotated by the crane 630 to the back side of the rig structure 602 in advance of moving the crane 630 along the rails 604*r* of the floor 604 into position above wellbore 613 while supporting the drilling machine DM1. FIG. 17F shows the drilling machine DM1 in position above the stack 608 while the drilling machine DM1 is still supported by the crane 630. As shown in FIG. 17G, a tubular erector apparatus 640 with tubulars for performing tripping operations has been moved proximate the well location 613. Tubular erector apparatus 640 may be adapted to supply, for example, tubulars for drilling operations performed by the drilling machine DM1, casing for tripping operations performed by a tripping machine or casing machine, and the like.

FIG. 17H illustrates a further step in a method of operating the multi-function rig, after the crane 630 has placed another blowout preventer stack 608 in position over wellbore location 614. As further shown in FIG. 17I, the crane 630 may connect to and raise a second drilling machine DM2 at the end of the rig structure 602 opposite the driller's cabin 616. Thereafter, the second drilling machine DM2 may be moved into place above wellbore location 614, as illustrated in FIG. 17J, using steps similar to those previously outlined for moving drilling machine DM1. In the interim, the drilling machine DM1 may commence drilling operations at wellbore location 613.

As shown in FIG. 17K, a second tubular erector apparatus 640 has been disposed proximate wellbore location 614 to supply tubulars for drilling operations to be performed by the second drilling machine DM2. Also shown in FIG. 17K, the crane 630 has moved back to the end of the rig floor 604 opposite the end with the driller's cabin 616.

In one embodiment of operating the multi-function rig, FIG. 17L illustrates a next step wherein the crane 630 has positioned another blowout preventer stack 608 above wellbore location 611, and another tubular erector apparatus 640 has been positioned proximate the well location 611. Meanwhile, in some embodiments drilling may commence with the second drilling machine DM2 at wellbore location 614, and drilling may continue with drilling machine DM1 at wellbore location 613.

After the wellbore has been drilled at wellbore location 613, the drilling machine DM1 may be moved by the crane 630 from the stack 608 at wellbore location 613 and positioned above the stack 608 located at wellbore location 611 for drilling operations thereat. FIG. 17M illustrates one embodiment wherein drilling machine DM1 is positioned above wellbore 611 while drilling operations continue with the second drilling machine DM2 at wellbore location 614.

In a further illustrative embodiment disclosed herein, FIG. 17N shows a tripping machine TM1 that has been moved by the crane 630 into place at wellbore location 613. In some embodiments, the tripping machine commences a tripping operation at wellbore location 613, such as, for example, tripping out tubulars/drill pipe and bit, tripping in casing, and the like, while drilling may commence with the drilling machine DM1 at wellbore location 611 and drilling may continue with the second drilling machine DM2 at wellbore location 614.

As shown in FIG. 17O, the crane 630 has moved another blowout preventer stack 608 (or other such pressure control equipment, if it is used) into position at wellbore location 612. FIG. 16O further shows that another tubular erector apparatus 640 has also been positioned proximate wellbore location 612. In some illustrative embodiments, the machines DM1, DM2 and TM1 may continue their operations in the interim at wellbore locations 611, 614 and 613, respectively.

In yet another embodiment of the present disclosure, FIG. 17P illustrates the tripping machine TM1 positioned above wellbore location 614, to which it has been moved by the crane 630 after completion of tripping operations at wellbore location 613. Thereafter, a cementing machine adapted to perform casing cementing operations may be positioned by the crane 630 above the cased wellbore location 613. In some illustrative embodiments, the drilling machine DM1 may continue drilling operations at wellbore location 611, the tripping machine TM1 may commence tripping operations at wellbore location 614, and the cementing machine CM1 may commence cementing the casing in place in wellbore 613. FIG. 17P also shows the crane 630 supporting the second drilling machine DM2, which was removed from above wellbore location 614 after completion of drilling operations thereat, and in advance of positioning it above wellbore location 612. FIG. 17Q further illustrates the drilling machine DM2 positioned above wellbore location 612. In certain embodiments disclosed herein, drilling at wellbore location 612 may commence with drilling machine DM2, while the machines DM1, CM1 and TM1 continue operations.

In yet another embodiment, FIG. 17R shows the tripping machine TM1 positioned above wellbore location 611, to which it has been moved by the crane 630 after completion of tripping operations at wellbore location 614. The cementing machine CM1 is now positioned above wellbore location 614, to which it was moved by the crane 630 after completing cementing operations at wellbore location 611. In some embodiments of the present disclosure, the tripping machine TM1 commences with a tripping operation at wellbore location 611, while the drilling machine DM2 continues drilling operations at wellbore location 612 and the cementing machine CM1 commences cementing casing in the wellbore 614. FIG. 17R also shows an additional embodiment wherein the crane 630 is supporting the drilling machine DM1, which was removed from above wellbore location 611 after completion of drilling operations thereat, and in advance of positioning it above a new wellbore location 615. As seen in FIG. 17R, another stack 608 has been positioned above wellbore location 615, and an additional tubular erector apparatus 640 has been positioned proximate thereto.

According the embodiment illustrated in FIG. 17S, the drilling machine DM1 may commence drilling operations at wellbore location 615, while in the interim the second drilling machine DM2 completes a drilling operation at wellbore location 612 and the cementing machine CM1 completes the cementing operations at wellbore 614.

As would readily be appreciated from the forgoing description of the various methods, machines, and embodiments illustrated in FIGS. 17A-17S, similar operations involving machines DM1, DM2, TM1 and CM1 may continue until all such operations have been performed at each and every wellbore location proximate both sides of rig structure 602. It should be noted that the order of operations as shown in FIGS. 17A-17S may be changed, reduced, added to, modified and the like, so as to best suit specific rig operations and plans. The number of wellbores drilled, cased, completed and worked on, and the order in which the operations are performed may also be changed as required for the specific application.

Figure 18:
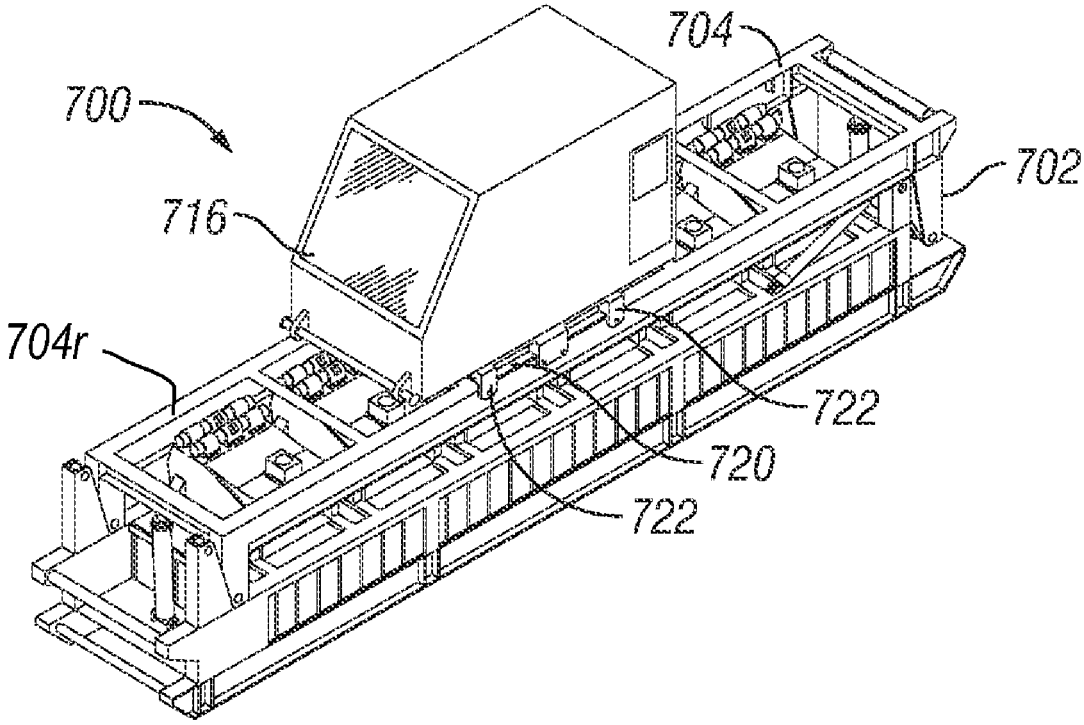
FIG. 18 is a perspective view of an illustrative system as disclosed herein.

FIG. 18 shows a system 700 according to one illustrative embodiment disclosed herein, comprising a rig structure 702 (like the rig structure 602) wherein a driller's cabin 716 (like the driller's cabin 616) has been adapted to move along the length of the rig structure 702. In one particular embodiment, the floor 704 comprises rails 704*r* (like the rails 604*r*), and the driller's cabin 716 may be mounted on a base 720 comprising a plurality of roller apparatuses 722. Each of the roller apparatuses 722 may be adapted to engage with the rails 704*r* and facilitate movement of the base 720 on the floor 704. It should be appreciated that any of the systems disclosed herein may comprise a movable driller's cabin so configured as that of the system 700 as herein described and illustrated in FIG. 18.

Figure 19:
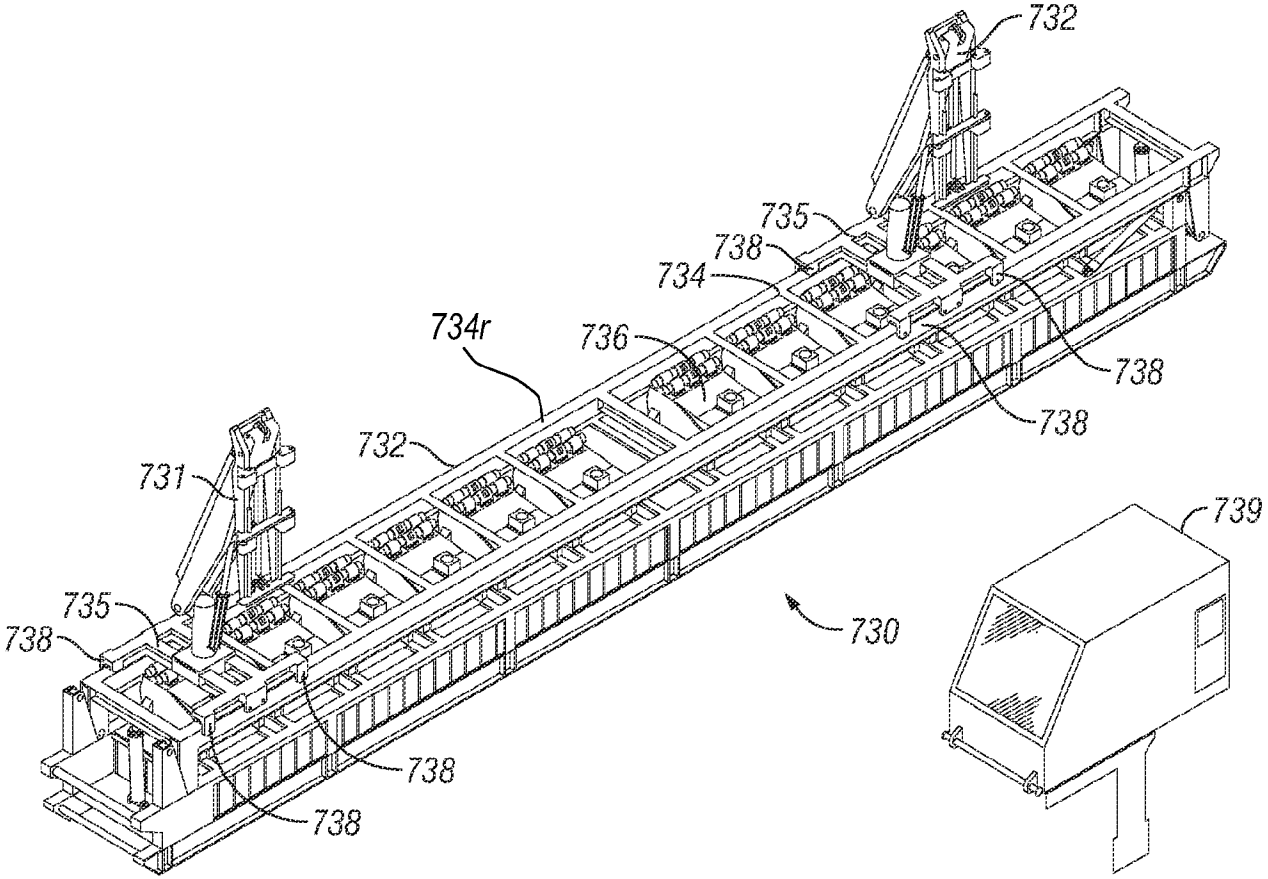
FIG. 19 is a perspective view of an illustrative system as disclosed herein.

FIG. 19 illustrates yet another embodiment of the present disclosure, wherein a system 730 comprises a rig structure 732 (like the rig structures 602 or 702) and a floor 734. In some embodiments, an active rig mud system comprising a series of shale shakers 736 may be disposed under the floor 734. Particular embodiments may comprise two cranes 731, 733, each of which may be movably mounted on the floor 734. Each crane 731, 733 may comprises a base 735 and a plurality of roller apparatuses 738 adapted to engage a rail 734*r* comprising the floor 734, thereby facilitating movement of the cranes 731, 733 along the length of the rig structure 732.

The system 730 may further comprise a driller's cabin as in any system disclosed herein. By way of example but not limitation, in some embodiments the system 730 may comprise the driller's cabin 616 of system 600 as illustrated in FIG. 15A, or alternatively the system 730 may comprise the driller's cabin 716 of system 700 as illustrated in FIG. 18. In other illustrative embodiments, the system 730 may comprise a driller's cabin 739 as shown in FIG. 19. The driller's cabin 739 may be spaced apart from the rig structure 732, but positioned for viewing of the entire rig structure 732 and operations conducted therewith. It should be appreciated that any of the systems according to the present disclosure may comprise embodiments wherein a driller's cabin 739 may be spaced apart from the rig structure. Moreover, it should also be appreciated that any of the systems disclosed herein may comprise multiple movable cranes such as the cranes 731, 733 comprising the system 730.

Figure 20A:
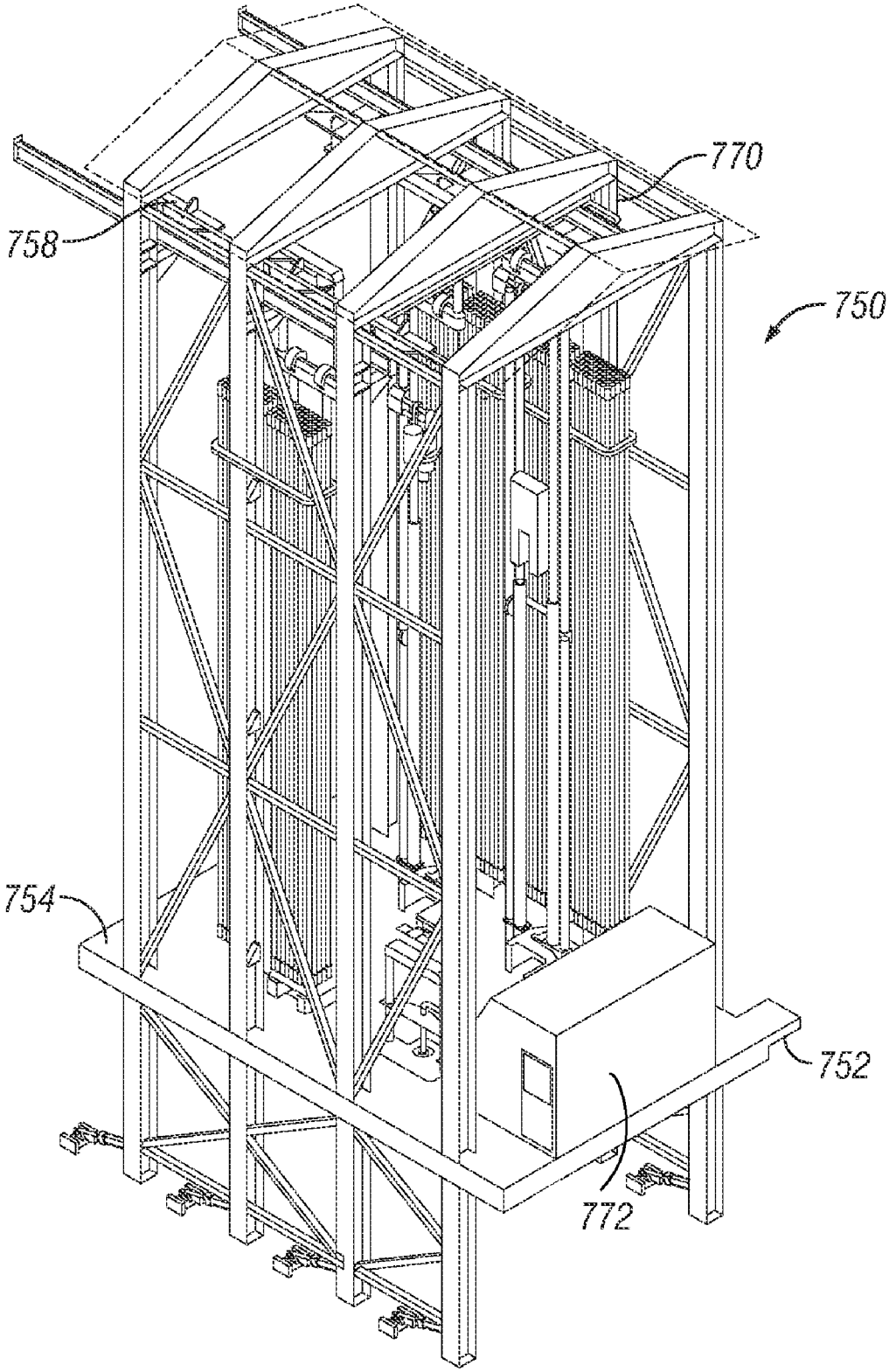
FIG. 20A is a perspective view of an illustrative system as disclosed herein.
Figure 20B:
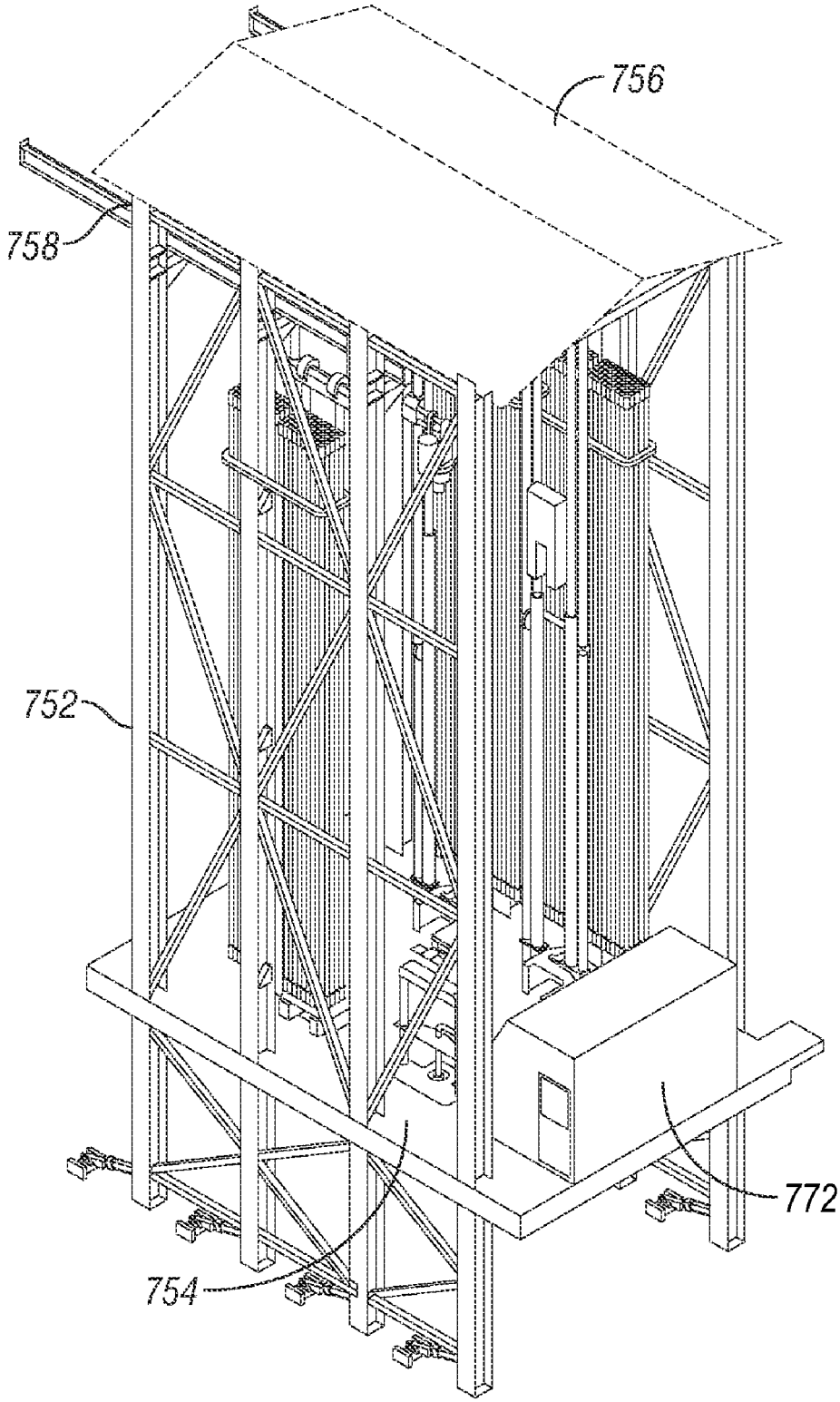
FIG. 20B is a perspective view of the system of FIG. 20A.
Figure 20C:
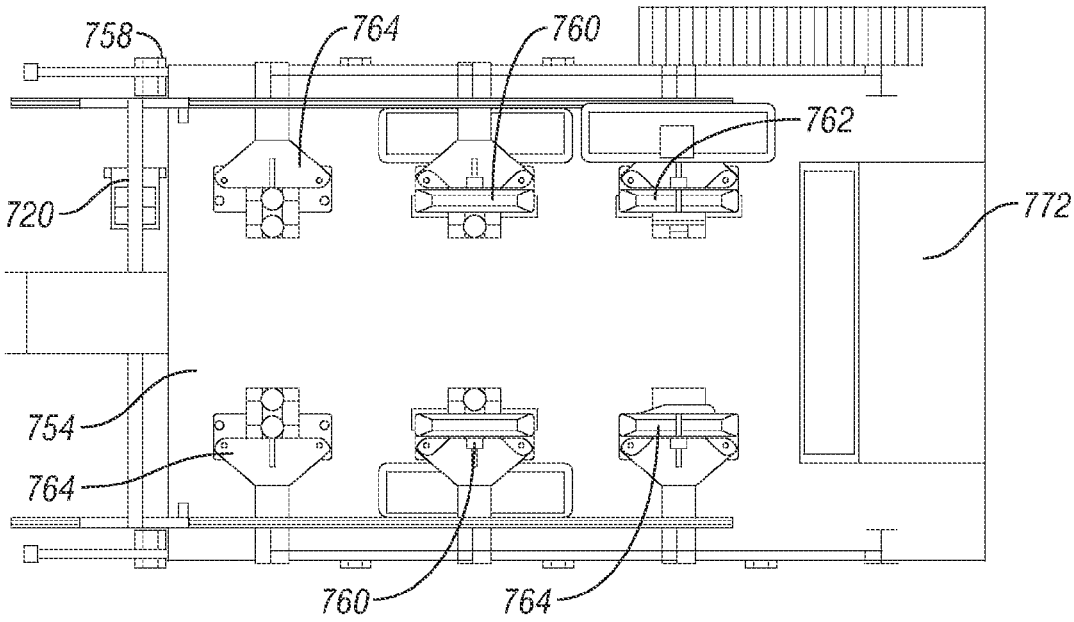
FIG. 20C is a top view of the system of FIG. 20A.

FIGS. 20A-20C disclose yet another embodiment according to the present disclosure. FIG. 20A shows a system 750 comprising a rig structure 752, a floor 754, and an optional roof 756. In some embodiments, the system 750 may be completely enclosed as described for the various systems disclosed herein. Multiple machines for performing rig operations may be movably mounted on the structure 752, including any machine or machines associated with one or more of the systems and embodiments described herein, including, for example, drilling machines, tripping machines, casing machines, cementing machines and the like. According to the embodiment shown in FIG. 20C, the system 750 may comprise a plurality of drilling machines 760, a tripping machine 762, and a plurality of cementing machines 764. In some embodiments, a superstructure 758 may support a movable crane 770, which is adapted to move any of the machines 760, 762, 764 to any location within the system 750. The system 750 may be located over multiple wellbore locations, one wellbore location corresponding to each of the six machines as shown in FIG. 20C. The system 750 may also comprise a driller's cabin 772, wherein the driller's cabin may be configured like any driller's cabin described for any of the systems and embodiments disclosed herein. In one particular embodiment, the driller's cabin 772 may be adapted to be movable down the length of the floor 754 during phases of rig operations when the machines are moved out of the way.

Another embodiment disclosed herein comprises a multi-function rig with a rig structure, wherein the multiple machines that perform rig operations, such as drilling, completion and/or workover applications and the like, may be located at the rig structure side that includes the wellbore locations. In some such embodiments, the tubular holders and tubular movement apparatus may be positioned at the side of the rig structure opposite the wellbore locations. In other such embodiments, in which the rig structure as seen from above may be of a rectangular shape, the tubular holders and tubular movement apparatus may be located on either of the ends, or lateral sides, of the rig structure. In some embodiments, the tubular movement apparatus enable tubulars to be moved from one side of the rig structure to the side of the rig structure that includes the wellbore locations. According to some embodiments, the tubulars may be passed by the tubular movement apparatus from within the rig structure, and in other embodiments the tubulars may be passed over the rig structure. In yet other embodiments, the tubulars may be passed from the side or sides of the rig structure.

In some embodiments disclosed herein, the tubular holders may wing (that is, be placed to the side of) the catwalk and trough of a tubular movement apparatus. In other embodiments, a frame may be disposed around the tubular holder, and the catwalk and trough of the tubular movement apparatus may be positioned on the frame and above the tubular holder.

Figure 21:
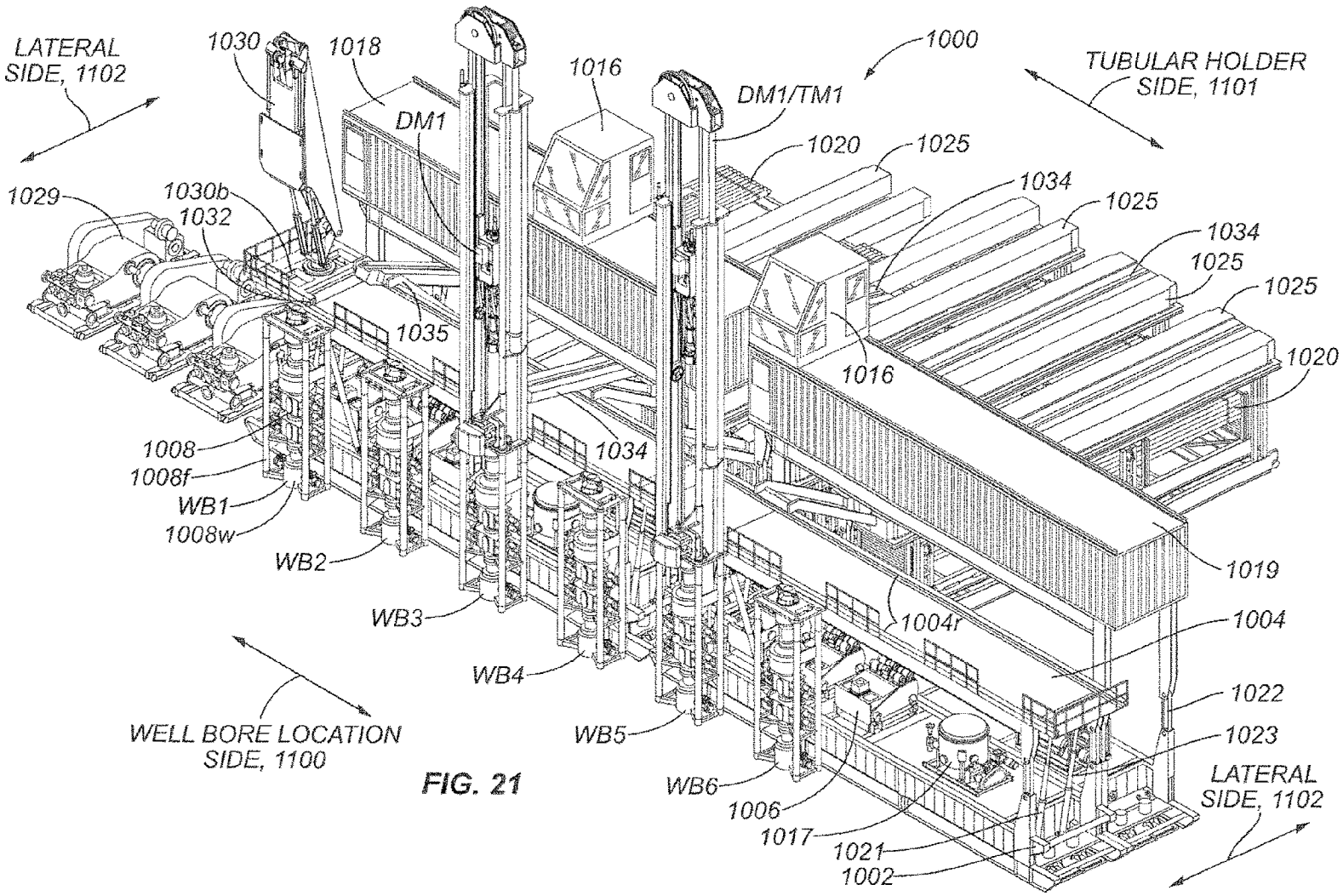
FIG. 21 is a perspective view of an illustrative system as disclosed herein.

FIG. 21 shows one illustrative embodiment of the present disclosure comprising a multi-function rig system 1000 that is a variation of the multi-function rig system 600 illustrated in FIGS. 15-17S, and the further embodiments illustrated in FIGS. 18 and 19. In one embodiment, the system 1000 may be configured such that the wellbore locations WB1-WB6 are located on one side, that is, the wellbore side 1100, of the rig structure 1002, and tubular holders 1020 and tubular movement apparatus 1010 are located on the opposite side, that is the tubular holder side 1101, of the wellbore location side 1100. This configuration provides ample space on the wellbore location side 1100 for the placement of completion and production equipment, such as, for example, production tubing, heating pipes, and the like.

Figure 21A:
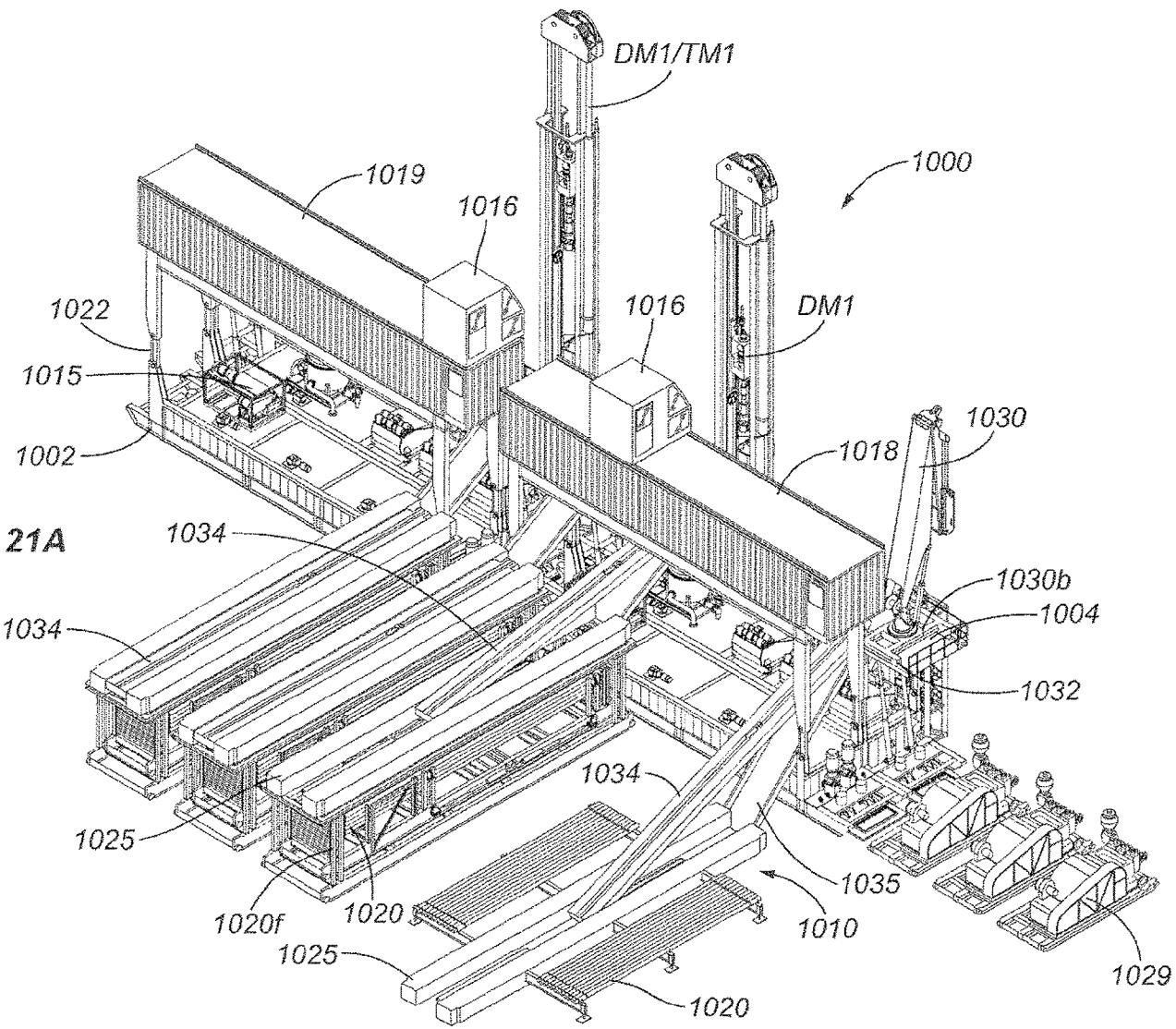
FIG. 21A is a perspective view from the opposite side of the system of FIG. 21.
Figure 21B:
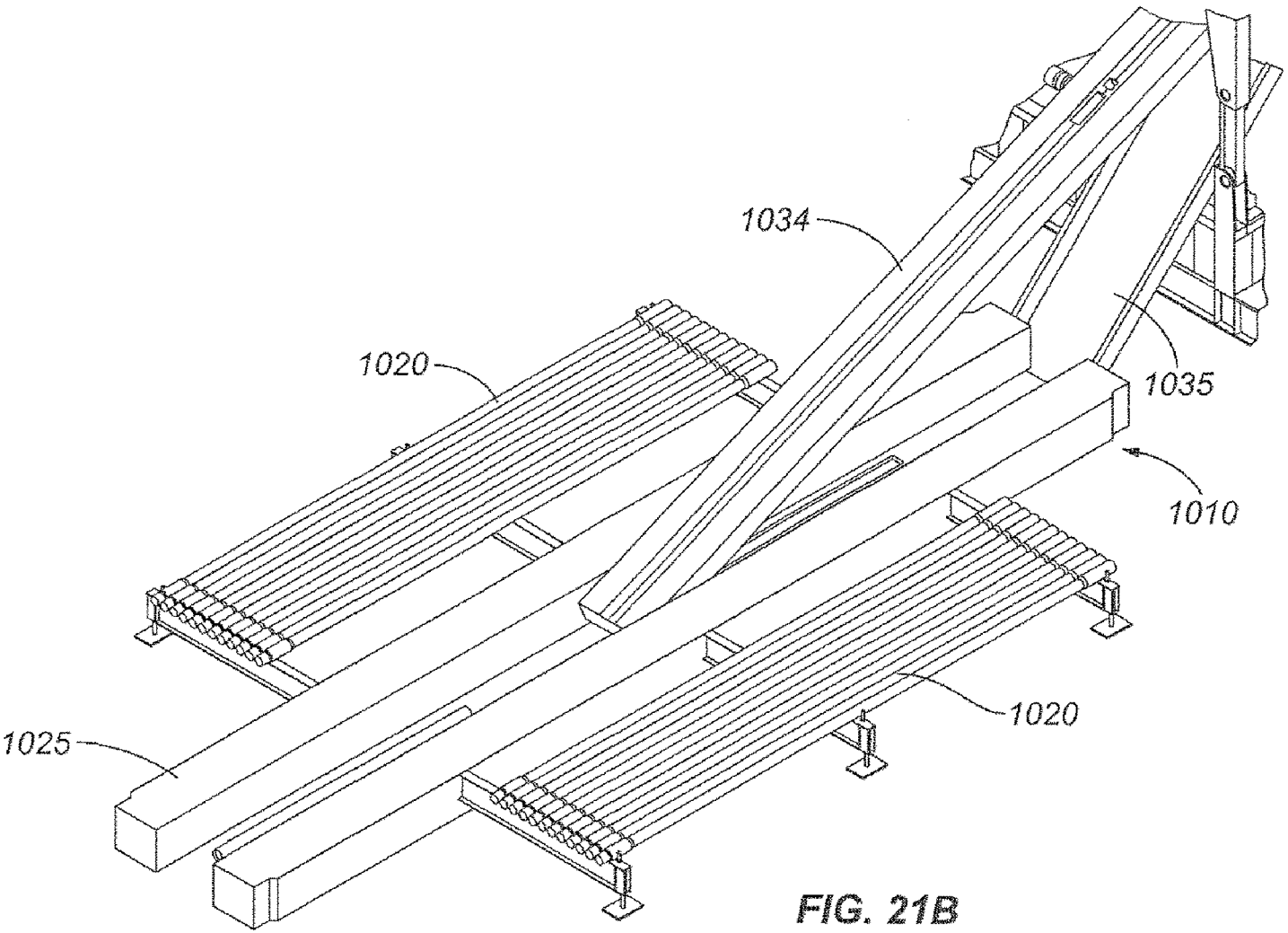
FIG. 21B is a perspective view of an illustrative embodiment of the tubular holder of the system of FIG. 21A.
Figure 21C:
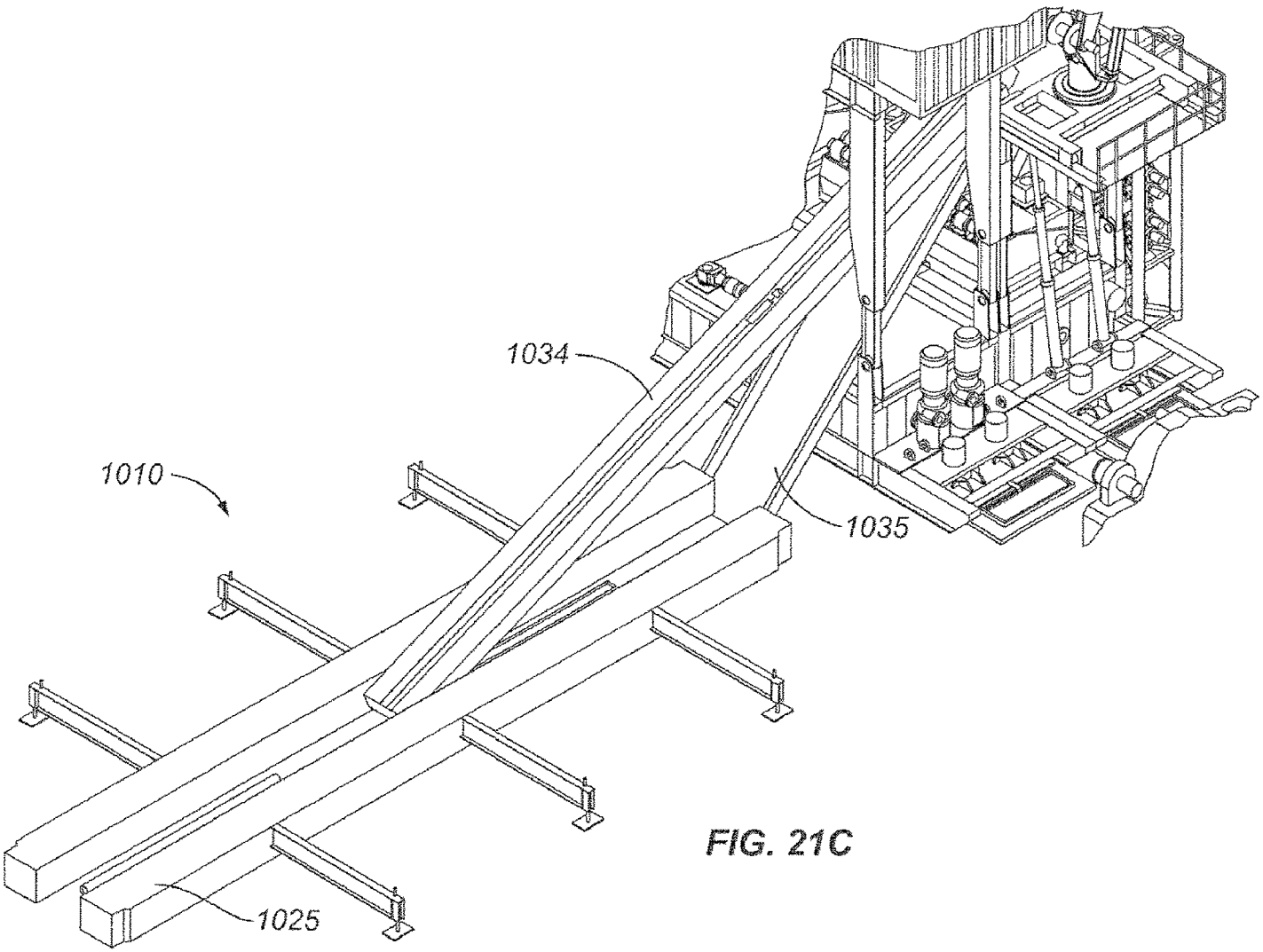
FIG. 21C is a perspective view of the tubular movement apparatus of the system of FIG. 21A.

Similar to the system 600, the multi-function rig system 1000 consists of an erectable rig structure 1002 comprising an elevated floor 1004. In some embodiments, an active rig mud system comprising a plurality of shale shakers 1006 with mud pit(s) may be disposed under the elevated floor 1004. As with the system shown in FIG. 15A, some embodiments of the system 1000 may further comprise an auger apparatus for moving material in and from the mud pit. The shale shakers 1006 and the mud pit may be located within the rig structure 1002 and behind the wellbore locations WB1-WB6. In particular embodiments, additional equipment comprising the active rig mud system may also be located within the erectable rig structure 1002, such as, for example, a de-sander, a de-silter, a de-gasser 1017, and the like. In certain embodiments, an optional centrifuge 1015 may be used in lieu of the de-sander and de-silter. In some embodiments, the shale shakers 1006, the mud pit(s), the de-gasser 1017, the centrifuge 1015 and any other equipment associated with the active rig mud system may each be adapted to be selectively movable out from within the rig structure 1002 independent of the wellbore locations WB1-WB6. In a particular embodiment, mud pumps 1029 may be located at one end—i.e., the lateral side 1102—of the rig structure 1002 as illustrated in FIGS. 21 and 21A.

Also similar to the system 600, the multi-function rig system 1000 may comprise an erection structure 1022. In one embodiment, the erection structure 1002 may comprise position locking apparatuses 1021, and may further comprise powered erection apparatuses 1023, such as, for example, power cylinder apparatuses, lead screw apparatuses, motorized apparatuses, and the like.

The multi-function rig system 1000 may in some embodiments further comprise a hydraulic power unit 1018 and/or electric power unit 1019 disposed on the rig structure 1002 and supported by the erection structure 1022. In one embodiment, a driller's cabin 1016 may be disposed on the hydraulic power unit 1018 or the electric power unit 1019. The driller's cabin 1016 may be approximately centrally located on the rig structure 1002, whereas in other illustrative embodiments, it may be adapted to be movable from side to side. In certain embodiments, the driller's cabin 1016 may be movable on the rig's periphery, or movable across the rig floor, or movable across a module of the rig, such as along the length of the hydraulic power unit 1018 or the electric power unit 1019.

In some embodiments of the system 1000, pressure control equipment (generally indicated as 1008) may be disposed proximate one or more of the wellbore location WB1-WB6, and may comprise such equipment as a flowline, a blowout preventer apparatus, diverter apparatus, wellhead 608*w* and the like. As shown for the embodiment illustrated in FIG. 21, blowout preventer stacks 1008 may be located over each of the wellbore locations WB1-WB6.

As described with respect to system 600, a variety of machines commonly used for performing rig operations may be used with the system 1000, including, but not limited to, any machine used in any embodiment of any system disclosed herein. In some embodiments, the multiple machines associated with the rig operations comprise, for example, a drilling machine DM1, a tripping machine TM1, a workover machine, a coil tubing unit, a casing drilling machine, a casing machine, a workover machine, a cementing machine, a heater installation apparatus, an auxiliary drilling unit, and the like. In one embodiment disclosed herein, each of the multiple machines are preferably disposed on the side of the drilling structure 1002 that includes each of the wellbore locations WB1-WB6—i.e., the wellbore location side 1100. Moreover, the various machines associated with the drilling operations may be placed proximate at least one of the wellbore locations WB1-WB6, and further may be adapted to be movable relative to the rig structure 1002.

In some embodiments of the system 1000, one or more of the multiple machines used for performing rig operations may be supported by the pressure control equipment 1008. In such cases, the pressure control equipment 1008 may be adapted to directly support drilling loads generated during drilling operations, such as the loads of the drilling machine DM1, a tubular string connected to the drilling machine, equipment connected to the tubular string, and the like. In other embodiments of the present disclosure, any one or all of the multiple machines used for performing rig operations may be supported by a separate frame 1008*f* disposed adjacent to or around the pressure control equipment 1008, in which case the drilling loads generated during drilling operations as noted previously would be supported directly by the frame 1008F.

In one embodiment disclosed herein, the system 1000 may comprise one or more tubular holders 1020 for staging the tubulars during rig operations, and a one or more tubular movement apparatuses 1010. In some embodiments, the tubular movement apparatus 1010 may include a catwalk 1025, trough 1034, v-door 1035, and other linkages that aid in the function of the tubular movement apparatus 1010. As shown in FIG. 21A, in some embodiments the tubular holders 1020 may be winged, that may be, placed to either side of the catwalk 1025 and trough 1034. In other embodiments, the tubular holders may be located within a frame structure 1020*f* to save space.

The catwalk 1025 assists with the staging of the tubulars when manual intervention is required. In operation, once the tubulars are positioned within the trough 1034, the trough 1034 transports the tubulars from the tubular holder side 1101 to the wellbore location side 1100 of the rig structure 1102 with the assistance of the v-door 1035 and associated linkages. The v-door 1035 assists in guiding and providing structural support for the movement of the trough 1034. The movement of the trough 1034) is enabled with systems such as, for example, hydraulic pistons, other alternatives in the form of pneumatic pistons, linkages, gears, chains, and the like. With the trough 1034 located within the rig floor 1004 working area, it is more convenient to pick up and move the tubulars from the trough 1034 to the rig floor 1004 and vice-versa. In some illustrative embodiments, the arms from the drilling machine DM1 or the tripping machine TM1 may be used to facilitate transport of the tubulars.

Figure 21D:
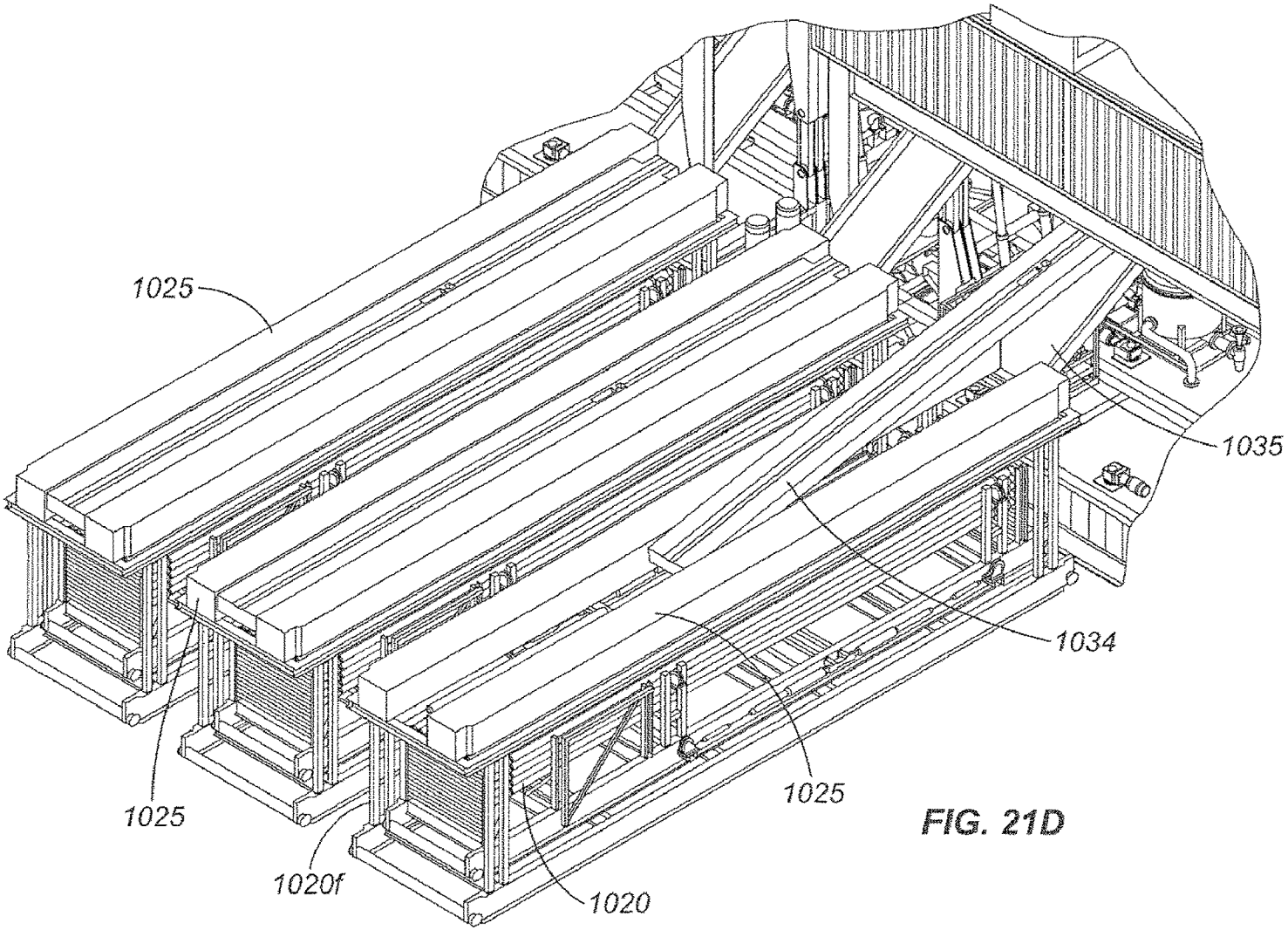
FIG. 21D is a perspective view of another illustrative embodiment of the tubular holder of the system of FIG. 21A.

FIG. 21D illustrates yet another illustrative embodiment of the present disclosure. In order to conserve valuable space on the tubular holder side 1101 of the rig structure 1002, the catwalk 1025 may be disposed above the tubular holder 1020 on the frame 1020*f* that is disposed around the tubular holder 1020. It should be appreciated that other variations of the tubular movement apparatus may also be used. In this embodiment, the tubulars may be loaded from the tubular holder 1020 onto the trough 1034 by a suitable tubular dispensing mechanism, as is well known in the art.

In some applications of rig operations, a need exists to conserve space and reduce the footprint of the rig periphery when viewed from above. Accordingly, in certain embodiments disclosed herein, the hydraulic power unit 1018 may be elevated by a considerable distance above the base of the rig structure 1002. In this embodiment, the trough 1034 may be adapted to pass from within the rig structure 1002 and under the hydraulic power unit 1018. It may be appreciated that additional variations for tubular transportation may be used, such as lowering the hydraulic power unit 1018 and transporting the tubulars over the hydraulic power unit (1018). It may further be appreciated that, in certain other embodiments, the tubulars may similarly be passed from either under or over the electric power unit 1019 instead of the hydraulic power unit 1018.

Similar to the embodiments of system 600 as shown in FIGS. 15 and 15D, the multi-function rig system 1000 may be configured with a crane 1030 disposed on the floor 1004. In some illustrative embodiments, the rig floor 604 may comprise rail 1004*r* (like the rails 604*r* of system 600) adapted to facilitate the movement of equipment and other apparatus along the length of the rig structure 1002. In certain embodiments the crane 1030 may be disposed on the rails 1004*r*, and may comprise a base 1030*b* with roller apparatuses 1032 adapted to engage with and move on the rails 1004*r*.

The particular embodiments disclosed above are illustrative only, as the invention may be modified and practiced in different but equivalent manners readily apparent to those skilled in the art and having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A multi-function rig for performing rig operations on a plurality of spaced-apart wellbore locations at a single wellbore location site, said multi-function rig configured to be movable between multiple wellbore location sites, the multi-function rig comprising:

a rig structure configured to be positioned over said plurality of spaced-apart wellbore locations at said single wellbore location site;

at least one tubular movement apparatus disposed proximate said rig structure;

a plurality of machines operatively coupled to said rig structure and configured to perform at least one of said rig operations on at least one of said plurality of spaced-apart wellbore locations, wherein each of said plurality of machines comprises a support attachment having a same attachment configuration that is adapted to be supported by removably coupling said support attachment to a separate machine support at each of said plurality of spaced-apart wellbore locations while performing said at least one of said rig operations, wherein each of said separate machine supports comprises a same support configuration that is adapted to matingly engage said same attachment configuration of each of said support attachments of each of said plurality of machines, and wherein at least one of said plurality of machines is configured to be movable relative to said rig structure to positions proximate at least one of said plurality of spaced-apart wellbore locations without moving said multi-function rig from said single wellbore location site;

at least one pressure-retaining device disposed proximate each of said plurality of spaced-apart wellbore locations, wherein said at least one pressure-retaining device comprises said separate machine support and at least one of a wellhead and pressure control equipment; and at least one of said plurality of machines being configured as a drilling machine to perform a drilling operation, and configured to be movable relative to said rig structure to positions proximate at least one of said plurality of spaced-apart wellbore locations.

2. The multi-function rig of claim 1, wherein said rig structure comprises a rig floor, a base, a framework and a support structure.

3. The multi-function rig of claim 1, wherein said rig operations comprise at least one of a drilling operation, a completions operation, or a workover operation.

4. The multi-function rig of claim 1, further comprising a movement apparatus disposed proximate said rig structure, said movement apparatus being configured to move at least one of said plurality of machines relative to said rig structure.

5. The multi-function rig of claim 4, wherein said movement apparatus is further configured to position said at least one of said plurality of machines above at least one of said separate machine supports.

6. The multi-function rig of claim 1, wherein said multi-function rig is configured for onshore applications.

7. The multi-function rig of claim 1, wherein said multi-function rig is configured for offshore applications.

8. The multi-function rig of claim 1, wherein said rig structure comprises a rectangular base.

9. The multi-function rig of claim 1, wherein said rig structure comprises a non-rectangular base.

10. The multi-function rig of claim 1, further comprising at least one tubular holder configured to support tubulars during said rig operations.

11. The multi-function rig of claim 10, wherein said at least one tubular holder is further configured to be modular.

12. The multi-function rig of claim 10, wherein said at least one tubular holder is further configured to be moveable relative to said rig structure.

13. The multi-function rig of claim 10, wherein said rig structure comprises a rig floor working area, and said at least one tubular movement apparatus is configured to move tubulars between said tubular holder and said rig floor working area.

14. The multi-function rig of claim 10, wherein said rig structure comprises a rectangular base, wherein each of said plurality of spaced-apart wellbore locations are located adjacent to and on a first side of said rig structure and said at least one tubular holder is disposed adjacent to and on a second side of said rig structure other than said first side of said rig structure.

15. The multi-function rig of claim 14, wherein said second side of said rig structure is opposite of said first side of said rig structure.

16. The multi-function rig of claim 14, wherein said second side of said rig structure is adjacent to said first side of said rig structure.

17. The multi-function rig of claim 1, wherein said at least one tubular movement apparatus comprises a catwalk, trough and v-door.

18. The multi-function rig of claim 17, further comprising at least one tubular holder and at least one tubular dispensing mechanism, wherein said tubular dispensing mechanism is configured to dispense tubulars from said at least one tubular holder onto said trough.

19. The multi-function rig of claim 17, further comprising at least one tubular holder configured to stage tubulars during said rig operations and a frame disposed proximate said at least one tubular holder, wherein said catwalk is disposed above said frame.

20. The multi-purpose rig of claim 1, further comprising at least one of a hydraulic power unit and an electric power unit disposed proximate said rig structure.

21. The multi-function rig of claim 1, further comprising a driller cabin.

22. The multi-function rig of claim 21, wherein said driller cabin is configured to be movable.

23. The multi-function rig of claim 1, wherein each of said plurality of machines is configured to perform said rig operations simultaneously at a plurality of said spaced-apart wellbore locations.

24. The multi-function rig of claim 1, wherein said plurality of machines comprises at least one of a tripping machine, a heater installation machine, a casing drilling machine, a casing machine, a cementing machine, a workover machine, a coil tubing unit, or an auxiliary drilling unit.

25. The multi-function rig of claim 1, further comprising at least one of a degasser or a centrifuge disposed proximate said rig structure.

26. The multi-function rig of claim 1, further comprising a frame structure disposed proximate said at least one pressure-retaining device.

27. The multi-function rig of claim 26, wherein said frame structure disposed proximate said at least one pressure-retaining device comprises said separate machine support.

28. The multi-function rig of claim 1, wherein said pressure control equipment comprises at least one of a blowout preventer apparatus, a flowline apparatus, or a diverter apparatus.

29. A method for performing rig operations on a plurality of spaced-apart wellbore locations at a single wellbore location site, said method comprising:

providing a single multi-function rig comprising a rig structure, at least one tubular movement apparatus proximate said rig structure, and a plurality of machines operatively coupled to said rig structure to perform said rig operations, wherein at least one of said rig operations comprises a drilling operation and said multi-function rig is configured to be movable between multiple wellbore location sites;

configuring each of said plurality of machines to perform at least one of said rig operations on each of said plurality of spaced-apart wellbore locations;

configuring each of said plurality of machines to have a same attachment configuration that is adapted to be supported by a separate machine support at each of said plurality of spaced-apart wellbore locations while performing said at least one of said rig operations, wherein each of said separate machine supports is configured to have a same support configuration that is adapted to matingly engage said same attachment configuration of each of said plurality of machines;

positioning at least one pressure-retaining device proximate each of said plurality of spaced-apart wellbore locations, and configuring said at least one pressure-retaining device to comprise one of said separate machine supports;

configuring at least one of said plurality of machines to be movable relative to said rig structure to positions proximate at least one of said plurality of spaced apart wellbore locations without moving said multi-function rig from said wellbore locations site, wherein at least a first one of said plurality of machines configured to be movable relative to said rig structure is further configured as a drilling machine to perform said drilling operation;

positioning said multi-function rig adjacent to said plurality of spaced-apart wellbore locations at said single wellbore location site;

moving said first one of said plurality of machines proximate at least one of said plurality of spaced-apart wellbore locations and removably coupling said first one of said plurality of machines to one of said separate machine supports; and performing a drilling operation on said at least one of said plurality of spaced-apart wellbore locations using said first one of said plurality of machines.

30. The method of claim 29, wherein performing said rig operations comprises performing one at least one of a drilling operation, a completions operation, or a workover operation.

31. The method of claim 29, wherein said rig operations are performed onshore.

32. The method of claim 29, wherein said rig operations are performed offshore.

33. The method of claim 29, said method further comprising performing a plurality of said rig operations simultaneously at a plurality of said spaced-apart wellbore locations.

34. The method of claim 33, wherein performing a plurality of said rig operations simultaneously comprises supporting each of said plurality of machines performing at least one of said plurality of said rig operations by removably coupling each of said plurality of machines to a respective one of said separate machine supports.

35. The method of claim 29, said method further comprising supporting tubulars using at least one tubular holder, wherein said tubular holder is configured to support said tubulars during said rig operations.

36. The method of claim 35, wherein said at least one tubular holder is further configured to be modular.

37. The method of claim 35, wherein said at least one tubular holder is further configured to be moveable relative to said rig structure.

38. The method of claim 35, said method further comprising moving said tubulars between said at least one tubular holder and a rig floor working area of said rig structure using said at least one tubular movement apparatus configured to move said tubulars between said at least one tubular holder and said rig floor working area.

39. The method of claim 35, wherein said rig structure comprises a rectangular base and each of said plurality of space-apart wellbore locations are located adjacent to and on a first side of said rig structure.

40. The method of claim 39, said method further comprising disposing said at least one tubular holder adjacent to and on a second side of said rig structure other than said first side of said rig structure.

41. The method of claim 40, wherein said second side of said rig structure is opposite of said first side of said rig structure.

42. The method of claim 40, wherein said second side of said rig structure is adjacent to said first side of said rig structure.

43. The method of claim 29, further comprising dispensing tubulars onto a trough from at least one tubular holder using at least one tubulars dispensing mechanism configured to dispense tubulars from said at least one tubular holder onto said trough.

44. The method of claim 29, further comprising staging tubulars using at least one tubular holder configured to stage said tubulars during said rig operations, said at least one tubular holder comprising a frame disposed proximate thereto and a catwalk disposed above said frame.

45. The method of claim 29, wherein each of said plurality of machines is configured to perform said rig operations simultaneously at a plurality of said spaced-apart wellbore locations.

46. The method of claim 29, wherein said plurality of machines comprises at least one of a tripping machine, a heater installation machine, a casing drilling machine, a casing machine, a cementing machine, a workover machine, a coil tubing unit, or an auxiliary drilling unit.

47. The method of claim 46, further comprising performing at least one of a completions operation or a workover operation using said workover machine.

48. The method of claim 46, further comprising performing at least one of a drilling operation, a completions operation or a workover operation using said coil tubing unit.

49. The method of claim 46, further comprising drilling an upper portion of a wellbore using an auxiliary drilling unit disposed proximate said rig structure.

50. The method of claim 29, wherein said multi-function rig further comprises at least one of a degasser or a centrifuge disposed proximate said rig structure.

51. The method of claim 29, wherein said multi-function rig further comprises at least one of a de-sander or de-silter disposed proximate said rig structure.

52. The method of claim 29, further comprising installing a heater apparatus in a drilled wellbore using a heater installation machine operatively coupled to said rig structure.

53. The method of claim 29, further comprising automatically operating said plurality of machines using a control system.

54. The method of claim 29, further comprising performing a tripping operation on at least one of said plurality of spaced-apart wellbore locations.

55. The method of claim 29, further comprising utilizing said plurality of machines to drill a plurality of wellbores and perform tripping operations at each of said plurality of drilled wellbores.

56. The method of claim 29, further comprising producing a cased wellbore using a casing drilling machine operatively coupled to said rig structure.

57. The method of claim 29, further comprising casing a previously drilled wellbore using a casing machine operatively coupled to said rig structure.

58. The method of claim 29, further comprising cementing a previously cased wellbore using a cementing machine operatively coupled to said rig structure.

59. The method of claim 29, wherein performing said drilling operation comprises supporting said at least one of said plurality of machines configured as a drilling machine by removably coupling said machine to at least one of said separate machine supports.

60. A multi-function rig for performing rig operations on a plurality of spaced-apart wellbore locations at a single wellbore location site, said multi-function rig configured to be movable between multiple wellbore location sites, the multi-function rig comprising:

a rig structure configured to be positioned over said plurality of spaced-apart wellbore locations at said single wellbore location site;

at least one tubular movement apparatus disposed proximate said rig structure;

a plurality of machines operatively coupled to said rig structure and configured to perform at least one of said rig operations on at least one of said plurality of spaced-apart wellbore locations, wherein each of said plurality of machines comprises a support attachment having a same attachment configuration that is adapted to be supported by removably coupling said support attachment to a separate machine support at each of said plurality of spaced-apart wellbore locations while performing said at least one of said rig operations, wherein each of said separate machine supports comprises a same support configuration that is adapted to matingly engage said same attachment configuration of each of said support attachments of each of said plurality of machines, and wherein at least one of said plurality of machines is configured to be movable relative to said rig structure to positions proximate at least one of said plurality of spaced-apart wellbore locations without moving said multi-function rig from said single wellbore location site;

at least one pressure-retaining device disposed proximate each of said plurality of spaced-apart wellbore locations, wherein said at least one pressure-retaining device comprises at least one of a wellhead and pressure control equipment;

a frame structure disposed proximate said at least one pressure-retaining device, wherein said frame structure comprises said separate machine support; and at least one of said plurality of machines being configured as a drilling machine to perform a drilling operation, and configured to be movable relative to said rig structure to positions proximate at least one of said plurality of spaced-apart wellbore locations.

* * * * *